US006731764B2

(12) United States Patent
Asada et al.

(10) Patent No.: US 6,731,764 B2
(45) Date of Patent: May 4, 2004

(54) SPEAKER APPARATUS AND ELECTRONIC APPARATUS HAVING SPEAKER APPARATUS ENCLOSED THEREIN

(75) Inventors: Kohei Asada, Tokyo (JP); Tooru Sasaki, Tokyo (JP); Akira Kimura, Kanagawa (JP); Takayuki Mizuuchi, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/884,417

(22) Filed: Jun. 19, 2001

(65) Prior Publication Data

US 2002/0191807 A1 Dec. 19, 2002

Related U.S. Application Data

(62) Division of application No. 09/381,475, filed on Sep. 16, 1999.

(30) Foreign Application Priority Data

| | | |
|---|---|---|
| Jan. 16, 1998 | (JP) | P10-007012 |
| Jan. 30, 1998 | (JP) | P10-019954 |
| Feb. 26, 1998 | (JP) | P10-045910 |
| Apr. 2, 1998 | (JP) | P10-090245 |
| Jan. 18, 1999 | (WO) | PCT/JP99/00136 |

(51) Int. Cl.[7] ..... H04R 25/00

(52) U.S. Cl. ..... 381/152; 381/190; 381/306; 381/333; 381/431

(58) Field of Search ..... 381/152, 182, 381/190, 191, 306, 332, 333, 388, 431; 181/157, 166, 199

(56) References Cited

U.S. PATENT DOCUMENTS

| | | | | |
|---|---|---|---|---|
| 5,638,456 A | * | 6/1997 | Conley et al. | 381/190 |
| 5,930,376 A | * | 7/1999 | Markow et al. | 381/333 |
| 6,324,052 B1 | * | 11/2001 | Azima et al. | 381/303 |
| 6,332,029 B1 | * | 12/2001 | Azima et al. | 381/152 |

* cited by examiner

*Primary Examiner*—Suhan Ni
(74) *Attorney, Agent, or Firm*—Jay H. Maioli

(57) ABSTRACT

A speaker apparatus in which the acoustic sound is radiated by flexural oscillations of a diaphragm in the form of a panel having a substantially flat surface. The speaker apparatus includes a panel-shaped diaphragm the outer rim of which can be oscillated substantially freely at least in the direction along the diaphragm thickness and at least one driver unit constituting an oscillation source secured to the diaphragm surface for imparting oscillations to the diaphragm. The diaphragm is set into flexural oscillations by oscillations applied from the driver unit driven on the basis of the playback input signal. By flexurally oscillating the diaphragm to radiate the acoustic sound, optimum frequency response characteristics can be obtained over a wide frequency range from the low to high frequency range. Moreover, the acoustic sound of optimum sound quality may be radiated in a state of minimum sound pressure level fluctuations over a frequency range from the low to high frequency range.

9 Claims, 37 Drawing Sheets

SPEAKER APPARATUS AND ELECTRONIC APPARATUS HAVING SPEAKER APPARATUS ENCLOSED THEREIN

This is a division of application Ser. No. 09/381,475 filed Sep. 16, 1999.

TECHNICAL FIELD

This invention relates to a speaker apparatus having a panel-shaped diaphragm and an electronic apparatus employing this speaker apparatus. More particularly, it relates to a speaker apparatus in which flexural oscillations (bending wave vibrations) are produced in the panel-shaped diaphragm by the oscillations applied from a driver unit to reproduce the acoustic sound.

BACKGROUND ART

Up to now, a conically-shaped dynamic speaker or a horn-shaped dynamic speaker is used extensively as a speaker apparatus.

The conically-shaped dynamic speaker is made up of a conically-shaped diaphragm, a driver unit driving this diaphragm and a cabinet for housing these components. The driver unit is made up of a voice coil placed on the proximal end of a voice coil bobbin mounted as-one on a mid portion on the proximal end of the diaphragm and an external magnet type magnetic circuit unit. The magnetic circuit unit is made up of a yoke having a center pole, a magnet arranged on the yoke for surrounding the center pole, and a top plate arranged on the magnet and adapted for defining a magnetic gap between it and the center pole. The diaphragm is supported, via a washer, by a frame secured at an external end on the proximal end on the magnetic circuit unit by inserting a voice coil placed around the voice coil bobbin into the magnetic gap of the magnetic circuit unit, The diaphragm is supported by a damper mounted across the voice coil bobbin and the frame. The damper supports the diaphragm so that, when the diaphragm is set into vibrations, it will be oscillated uniformly parallel to the center axis of the diaphragm. On the inner periphery of the diaphragm is mounted a center cap for closing an opening end of the tubular voice coil bobbin. The center cap constitutes a portion of the diaphragm.

If, with the conical dynamic speaker, as described above, an acoustic playback input signal is supplied to a voice coil, the diaphragm is set into vibrations by the force generated by the interaction between the driving current flowing in the voice coil and the magnetic flux radiated from the magnetic circuit unit to radiate the acoustic sound.

The diaphragm used for a conical dynamic speaker is formed in a conical shape from a lightweight material which undergoes significant internal losses. The frame supporting the diaphragm is provided with a hole for releasing the sound radiated from the back side of the diaphragm. The function of this hole is to prevent adverse effects otherwise caused by the oscillations of the diaphragm by the sound radiated from the back side of the diaphragm being reflected by the frame to get to the diaphragm. The function of the washer is to support the diaphragm with respect to the frame and to prevent the diaphragm from directly contacting with a cabinet mounting section when the diaphragm is set into oscillations.

On the other hand, a horn-shaped dynamic speaker has a horn on the front side of the diaphragm for enhancing the acoustic sound from the diaphragm for radiating the enhanced sound.

The horn-shaped dynamic speaker includes a dome-shaped diaphragm and a driving unit for driving this diaphragm. This driver unit includes an internal magnet type magnetic circuit unit made up of a voice coil placed around a voice coil bobbin mounted as-one on the diaphragm, a pot-shaped yoke, a magnet arranged centrally of the yoke, a pole arranged on the magnet, and a top plate arranged on the yoke for facing the pole and which defines a magnetic gap between it and the pole.

The diaphragm of the speaker is arranged by inserting the voice coil placed around the voice coil bobbin into a magnetic gap of the magnetic circuit unit and by having its rim supported on a top plate constituting the magnetic circuit unit.

With the hone-shaped dynamic speaker, as in the cone-shaped dynamic speaker, the diaphragm is set into oscillations to radiate acoustic sound when the driving current corresponding to the acoustic signals is fed to the voice coil, by the force produced by the interaction between the driving current flowing in the voice coil and the magnetic flux radiated from the magnetic circuit unit.

The dome-shaped diaphragm, used in the hone-shaped dynamic speaker, is formed of light metal, such as aluminum, or synthetic resin, higher in toughness than the conical diaphragm, and hence can be set uniformly into oscillations, in a direction parallel to the center axis, when the diaphragm is supported only at the rim portion.

With the above-described cone-shaped dynamic speaker or hone-shaped dynamic speaker, in which the diaphragm is conically-shaped or dome-shaped, the speaker apparatus in its entirety is increased in thickness.

For reducing the thickness of the apparatus, there is used a speaker apparatus employing a flat-plate-shaped diaphragm. Among the speaker apparatus of this type, there is a capacitor type speaker, in which a diaphragm made up of a flat-plate-shaped substrate and an electrically conductive thin metal film deposited thereon is arranged facing a fixed pole with a small gap in-between. In this speaker, a dc bias voltage of hundreds of volt is applied across the diaphragm and the fixed pole. When acoustic signals are inputted to the fixed pole, the diaphragm is set into oscillations as a result of change in the electrostatic force of attraction between the diaphragm and the fixed pole.

With the capacitor type speaker, in which hundreds volt needs to be applied across the diaphragm and the fixed plate, not only limitations are imposed on the floor space, but also stable driving is rendered difficult due to changes in temperature or humidity. Also, in the capacitor type speaker, in which the input voltage is prescribed by the dc bias voltage, the maximum distortionless output sound pressure level, obtained for a given input voltage, is small in comparison with that of the above-mentioned dynamic speaker apparatus, such that a large sound cannot be produced. Moreover, in the capacitor type speaker, the diaphragm needs to be increased in size to acquire a stable frequency response in the audible frequency range. However, it is difficult to drive the large-sized diaphragm in stability.

In the above-described conventional speaker apparatus, acoustic reproduction is achieved by uniformly oscillating the diaphragm by a driver unit. In such speaker apparatus, it is necessary for the diaphragm to be oscillated uniformly, without generating resonant modes, when the diaphragm is oscillated by the driver unit.

In order for the diaphragm to be oscillated uniformly without inducing its resonant mode, the diaphragm needs to be formed of a sufficiently tough material. Moreover, for suppressing the resonant mode of the diaphragm, it is necessary to select the shape of the diaphragm or the supporting structure for the frame in many ways to render designing or manufacture difficult. In the speaker apparatus employing a flat-plate-shaped diaphragm, the driving point by the driving unit needs to be adjusted to the material or size of the diaphragm, again to render designing or manufacture difficult.

Also, a speaker configured to cause uniform oscillations of the diaphragm by the driver unit is termed a dipole sound source, and generates the oppositely phased sounds on the front and back sides of the diaphragm. These oppositely phased sounds, in particular the sounds of the mid to low frequency ranges with low directivity, interfere with each other to degrade the frequency response characteristics. Thus, in this type of the speaker apparatus, a speaker unit is mounted on a baffle plate, and the back side of the speaker unit is covered by an enclosure, which is a hermetically sealed cabinet, in order to prevent the sound waves emanating from the front and back sides of the diaphragm from interfering with each other.

Thus, with the conventional speaker apparatus, employing a baffle plate or an enclosure, is placed under limitations as to the mounting position or site.

DISCLOSURE OF THE INVENTION

It is an object of the present invention to provide a novel speaker apparatus different in its driving system from the routinely used speaker apparatus.

It is another object of the present invention to provide a speaker apparatus which is able to be driven with optimum response properties with respect to the playback input signals of a broad frequency range to realize optimum frequency response characteristics and the playback sound of optimum sound quality.

It is a further object of the present invention to provide a speaker apparatus which can be reduced in thickness and size.

It is a further object of the present invention to provide a speaker apparatus which is not limited as to the mounting position or setting position.

It is yet another object of the present invention to provide a speaker apparatus that can be easily unified to electronic equipments, such as a personal computer, a radio receiver or a television receiver, and an electronic equipment into which is unitarily built the present speaker apparatus.

The speaker apparatus of the present invention reproduces the acoustic sound by exploiting the flexural oscillations (bending wave vibrations) of a panel-shaped diaphragm having a substantially flat surface and moderate toughness. In this flexural oscillations, a flat-plate-shaped diaphragm is flexurally oscillated in its entirety or partially to radiata the acoustic sound. The oscillation system by the flexural oscillations differs from the system in which the diaphragm is uniformly oscillated by a piston movement obtained on reciprocating the diaphragm in a direction parallel to its center axis by a driver unit.

The panel-shaped diaphragm is formed of a material having toughness which is sufficient for enabling the operation as a diaphragm by itself and which is of a small attenuation factor such as to cause propagation of the oscillations accorded by the driver unit flexurally oscillating the diaphragm to respective portions of the diaphragm. Therefore, a thin film or a paper sheet that cannot operate by itself as a panel-shaped diaphragm or clay low in toughness and unable to propagate oscillations is not used as a diaphragm.

If, in a speaker employing a panel-shaped diaphragm and adapted to perform acoustic reproduction by flexural oscillations thereof, the oscillations are applied to the diaphragm, the diaphragm undergoes flexural oscillations so that the oscillation mode corresponding to the frequency of the applied oscillations is produced on the entire diaphragm. If oscillations over a wide frequency range from the low to high frequencies are applied to the diaphragm, complex oscillation modes corresponding to the applied frequencies are produced in the diaphragm. The frequency response characteristics of the speaker apparatus employing the panel-shaped diaphragm are characterized by analyses of the physical properties of the flexural oscillations of the diaphragm of a limited size, speed versus frequency characteristics of the flexural oscillations and by the driving point impedance characteristics.

With a speaker employing a panel-shaped diaphragm, diaphragms of a bending toughness, the parameters of which have been optimized depending on the estimated applications, is used to enable the operation of the apparatus up to the minimum fundamental frequency. This minimum fundamental frequency prevails if the entire panel-shaped diaphragm undergoes flexure corresponding to one-half wavelength. In the present speaker apparatus, oscillations from the driver unit are applied to the vicinity of the center point of the diaphragm to acquire the oscillations of the panel-shaped diaphragm at the minimum fundamental frequency. The size of the panel-shaped diaphragm, used for the speaker apparatus, specifically, the particular aspect ratio which gives the uniform mode density by finite element analysis, is found by a mathematic modelling tool. Also, for realizing the uniformity in the optimum oscillation mode produced in the diaphragm, the point of the panel-shaped diaphragm to which oscillations are applied from the driver unit is found on Fourier analysis. Although certain losses are produced in the high frequency range by expansion of the Fourier analysis, it is possible to drive a panel-shaped diaphragm of a larger area.

That is, the manner of flexure of the panel-shaped diaphragm, used in a speaker apparatus reproducing the acoustic sound using flexural oscillations of the diaphragm, is varied in dependence upon the material type, shape or size of the diaphragm, structure of the diaphragm, position of application of the oscillations from the driver unit and upon the diaphragm supporting method. In general, the higher the frequency, the larger is the number of resonant modes or the amount of the flexure. The speaker apparatus employing the panel-shaped diaphragm operates as a bipolar sound source for a low sound frequency area of the frequency of flexural oscillations of the diaphragm inclusive of the minimum fundamental frequency, with the reverse-phased sound wave being produced ahead and at back of the diaphragm to exhibit bi-directional characteristics. With increasing frequency of the flexural oscillations of the diaphragm, plural flexural oscillations are produced on the diaphragm surface at intricately changing positions, with the flexural oscillations being produced at the respective positions and radiated substantially without regard to the phase. Thus, the diaphragm in its entirety displays characteristics with low directivity. If the frequency of the flexural oscillations of the diaphragm is increased further, the diaphragm undergoes flexural oscillations to a larger extent. However, the oscillations applied to the diaphragm from the driver unit cannot reach the outer rim of the diaphragm due to propagation losses. Thus, it is mainly the vicinity of the driver unit that is mainly subjected to the flexural oscillations to contribute to sound radiation. Therefore, in the high frequency range, the diaphragm apparently operates as an extremely small sound source to exhibit omni-directivity.

It is thus possible with the speaker apparatus employing flexural oscillations of the panel-shaped diaphragm to reproduce the sound over a wide frequency range from lower to high frequency ranges, by a sole panel-shaped diaphragm driven by a sole driver unit. By forming the diaphragm of a material exhibiting moderate toughness and by suitably setting the point of the diaphragm to which are applied the oscillations from the driver unit, optimum frequency response characteristics can be obtained over a wide frequency range from lower to high frequency ranges.

If, with the speaker apparatus employing the panel-shaped diaphragm, the responsiveness to oscillations applied from the driver unit and the electrical loads with respect to the oscillations imparted by the driver unit are selected to be equal to those used conventionally, it is possible not only to realize interchangeability with respect to the amplifier used for driving the conventional speaker apparatus, but also to use a dynamic or piezoelectric driver unit to realize a radiation pattern of extremely wide sound field and a bi-directional radiation pattern.

The speaker apparatus employing the flexural oscillations of the panel-shaped diaphragm has a high conversion efficiency from the mechanical energy to the acoustic energy, while having omni-directional radiation characteristics not dependent on the frequency. That is, a constant large sound pressure level can be realized from the low frequency range to the high frequency range, with the sound pressure decease under distance limitations being minimum.

The speaker apparatus of the present invention reproduces the acoustic sound by flexural oscillations of the panel-shaped diaphragm by the oscillations applied from a driver unit driven by acoustic playback input signals.

More specifically, the speaker apparatus according to the present invention includes a diaphragm, in the form of a panel having a substantially flat surface, an outer rim portion of which can be oscillated substantially freely in the direction along the diaphragm thickness and at least one driver unit connected to the diaphragm surface for constituting an oscillation source imparting the oscillations to the diaphragm. With the present speaker apparatus, flexural oscillations are induced in the diaphragm by the oscillations imparted from the driver unit driven by the playback input signal to reproduce the acoustic sound. With the present speaker apparatus, the driver unit, supported by the supporting member, is mounted at a pre-set position.

On the panel-shaped diaphragm, mass weight components are arranged in a distributed fashion. The driver unit is connected to the diaphragm surface via connecting portions of pre-set size and shape. The portions of the diaphragm connected to the driver unit are different in material type from the remaining diaphragm portions. The diaphragm and the driver unit are interconnected via a connecting member. This connecting member is different in the shape of a connecting portion thereof to the diaphragm and in the shape of a connecting portion thereof to the diaphragm.

Around the panel-shaped diaphragm is mounted a protective frame for protecting the diaphragm. The diaphragm has its one outer rim portion secured to the protective frame, with the other outer rim portions being oscillatable substantially freely along the direction of the diaphragm thickness.

According to the present invention, a portion of the main body portion of an electronic equipment, such as a personal computer, or a portion of a lid mounted to the main body portion of an electronic equipment, is used as a diaphragm. The driver unit is arranged on the main body unit of the electronic equipment or in a lid and a portion of the main body unit or the lid is subjected to flexural oscillations by the oscillations applied from the driver unit driven by the playback input signal to reproduce the acoustic sound.

Other objects and advantages of the present invention will become clearer from the following description of the preferred embodiments and the claims.

BEST MODE FOR CARRYING OUT THE INVENTION

A specified embodiment of a speaker apparatus of the present invention is now explained with reference to the drawings.

Figure 1:
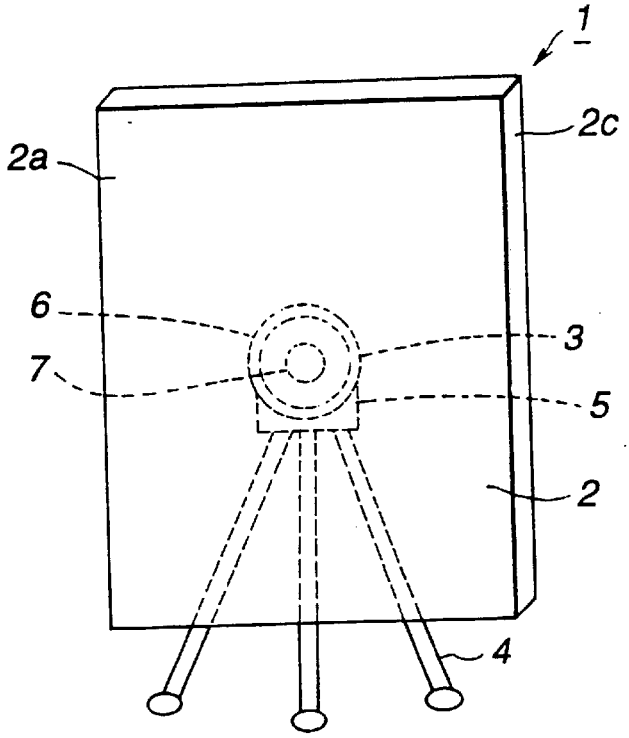
FIG. 1 is a perspective view showing a speaker apparatus according to the present invention.

Referring to FIG. 1, a speaker apparatus 1 according to the present invention includes a rectangular panel-shaped diaphragm 2, having opposite major surfaces as substantially planar surfaces, and a driver unit 3 for flexurally oscillating this diaphragm 2. The diaphragm 2 is formed of a material having toughness which is sufficient for operation as a diaphragm by itself and which is of small attenuation factor such as to cause propagation of the oscillations accorded by the driver unit 3 flexurally oscillating the diaphragm to respective portions of the diaphragm 2. Here, the diaphragm 2 is formed of styrene resin, and has a rectangular shape sized 25.7 cm by 36.4 cm and a thickness of 2 mm.

On the diaphragm 2 is mounted the driver unit 3 so that its one surface is a sound radiating surface 2*a* and its other surface is a driving surface 2*b*. The driver unit 3 is mounted substantially centrally of the surface 2*b* of the digital filter 2.

The diaphragm 2, on the driving surface 2*b* of which is mounted the driver unit 3, is mounted in position by the driver unit 3 being supported via a mounting plate 5 on a supporting leg 4.

The diaphragm 2, thus supported on the supporting leg 4 via the driver unit 3, has only its mid portion supported, with the outer rim 2*c* being oscillatable freely along the direction of thickness.

It suffices if the diaphragm 2 is formed as a panel having a substantially planar surface. The diaphragm 2 may be circular or elliptical in profile. Also, it suffices if the diaphragm 2 is formed of a material having toughness which is sufficient for operation as a diaphragm by itself and which is of small attenuation factor such as to cause the propagation of oscillations accorded by the driver unit to respective portions of the diaphragm 2. Thus, the diaphragm 2 may be formed by a variety of honey comb plates or balsam materials.

Figure 2:
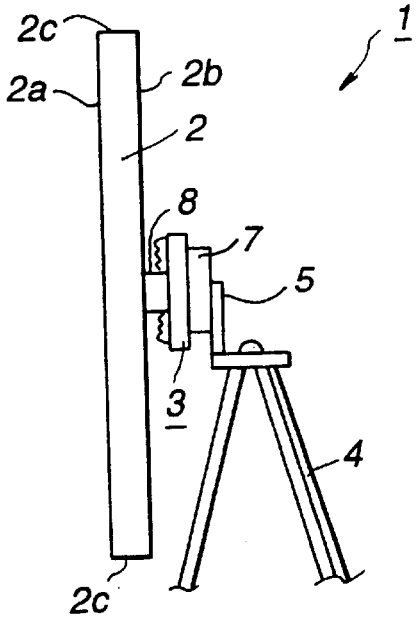
FIG. 2 is a side view of the speaker apparatus shown in FIG. 1.
Figure 3:
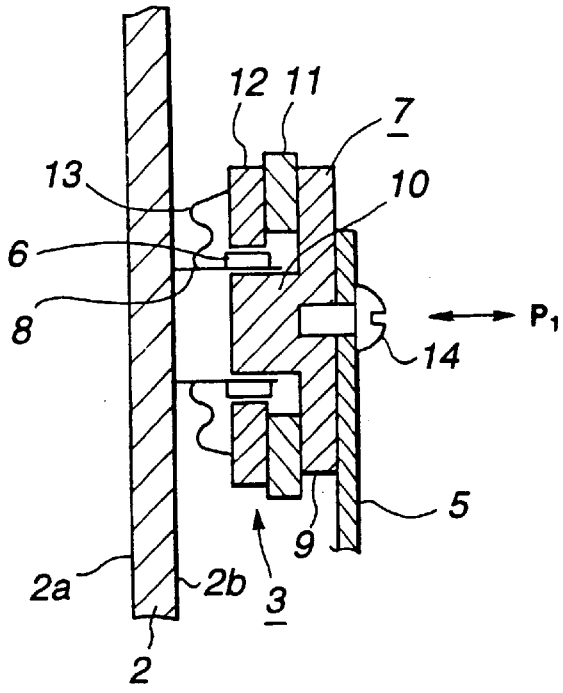
FIG. 3 is a schematic longitudinal cross-sectional view of the speaker apparatus.

The driver unit 3 for flexurally oscillating the diaphragm 2 may be similar to one used in the routinely used dynamic speaker apparatus. Referring to FIGS. 2 and 3, the driver unit 3 is constituted by a voice coil 6 wound about the outer peripheral surface of the proximal portion of the cylindrically-shaped voice coil bobbin 8 and an external magnet type magnetic circuit unit 7. Referring to FIG. 3, the voice coil bobbin 8 is made up of a yoke 9 having a centrally arranged center pole 10, a ring-shaped magnet 11 arranged on the yoke 9 for encircling the center pole 10, and a top plate 12 arranged on the magnet 11 and which defines a magnetic gap between it and the center pole 10. The voice coil bobbin 8 is mounted with the voice coil 6 inserted into the magnetic gap of the magnetic circuit unit 7, and is supported by the magnetic circuit unit 7 via a ring-shaped dumper 13. The voice coil bobbin 8 is supported for executing a piston movement in the direction parallel to the center axis, as indicated by arrow $P_1$ in FIG. 3, by the inner rim side of a damper 132 connected to the top plate 12 of the magnetic circuit unit 7 being connected to the outer periphery of the voice coil bobbin 8.

The driver unit 3 is mounted in position by the mid portion of the yoke 9 being mounted by a set screw 14 to a mounting plate 5 provided on the supporting leg 4.

Figure 4:
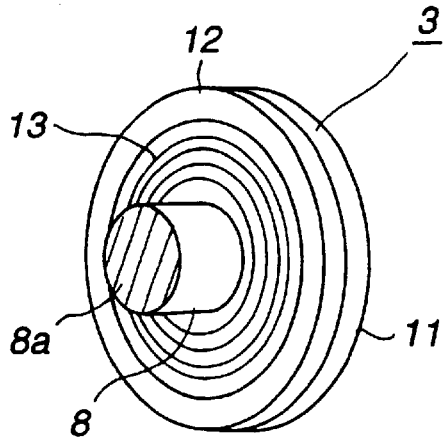
FIG. 4 is a perspective view showing a driver unit designed for causing flexural oscillations of the diaphragm.

The diaphragm 2 is supported on the driver unit 3 by connecting the mid portion of the opposite side surface 3*b* thereof to a distal end 8*a* of the voice coil bobbin 8 shown shaded in FIG. 4.

In the above-described embodiment, the diaphragm 2 is directly connected to the distal end 8*a* of the voice coil bobbin 8. Alternatively, the diaphragm 2 may also be supported by the driver unit 3 by being connected to a ring-shaped or flat-plate-shaped connecting member connected in turn to the distal end 8*a* of the voice coil bobbin 8.

With the above-described speaker apparatus 1 according to the present invention, if a playback input signal is sent to the voice coil 6 of the driver unit 3 from a playback input signal circuit, not shown, the voice coil bobbin 8 performs piston movement in the direction indicated by arrow $P_1$ in FIG. 3. If the oscillations corresponding to the piston movement of the voice coil bobbin 8 is accorded to the diaphragm 2, the diaphragm is flexurally oscillated, about its mid portion connected to the voice coil bobbin 8 as a driving point, to radiate the sound corresponding to the playback input signal.

Figure 5A:
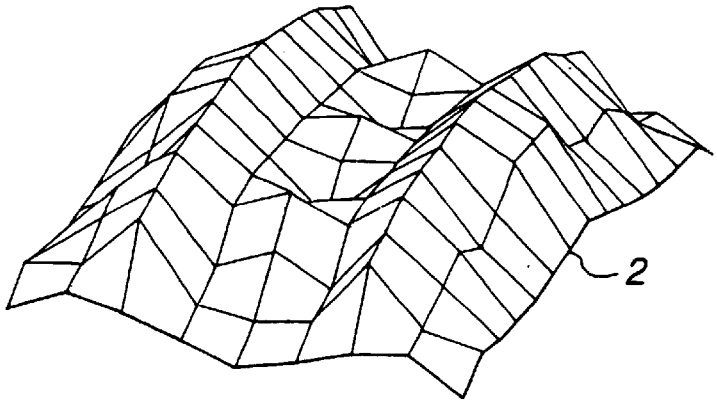
FIGS. 5A to 5C are perspective views showing the oscillating modes produced in the diaphragm when the diaphragm is set into flexural oscillations.
Figure 5B:
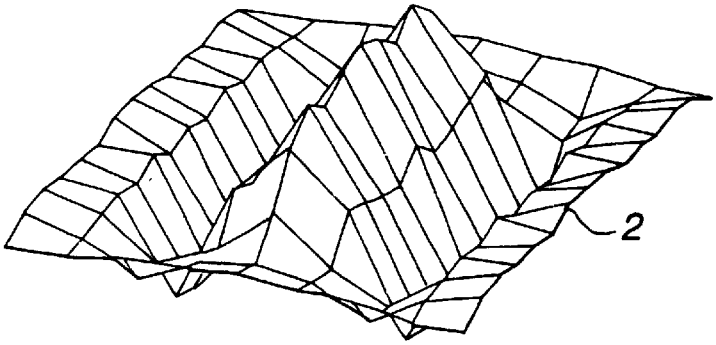
Figure 5C:
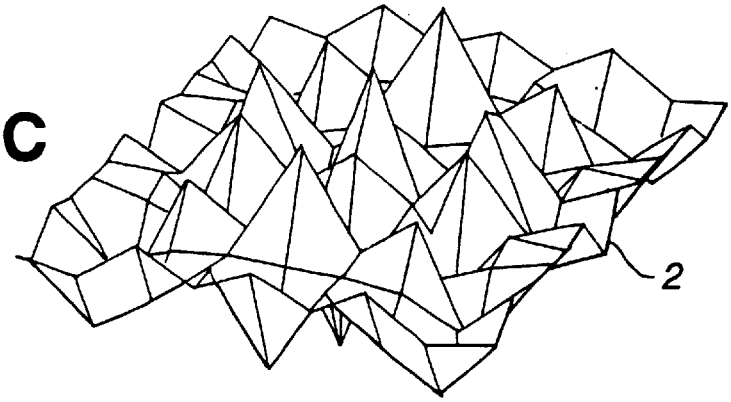

The diaphragm 2 undergoes flexible oscillations, as shown in FIGS. 5A, 5B and 5C, responsive to the frequency of the playback input signal.

If the playback input signal of 62 Hz is inputted to the driver unit 3 for driving, the diaphragm 2 is flexurally oscillated as shown in FIG. 5A. On the other hand, if the playback input signal of 151 Hz or the playback input signal of 501 Hz is inputted to the driver unit 3 for driving, the diaphragm 2 is flexurally oscillated as indicated in FIGS. 5B and 5C, respectively. As may be seen from FIGS. 5A to 5C, if the playback input signal is supplied to drive the driver unit 3, the diaphragm 2 undergoes flexural oscillations, depending on the frequency of the playback input signal, thus generating complicated oscillating modes. Also, the oscillating mode is such that, the higher the frequency of the playback input signal inputted to the driver unit 3, the more numerous is the number of crests and recesses existing in the generated oscillating mode.

Figure 6A:
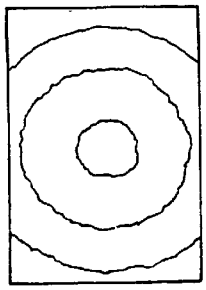
FIGS. 6A to 6H are plan views showing respective oscillation modes of the diaphragm dependent on the frequencies of the playback input signals.
Figure 6E:
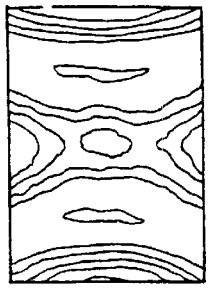
Figure 6B:
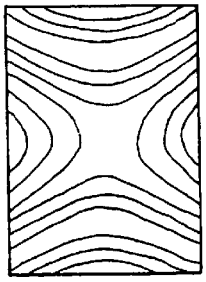
Figure 6F:
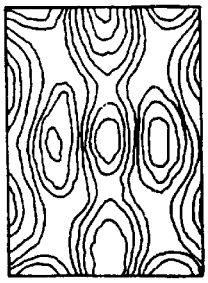
Figure 6C:
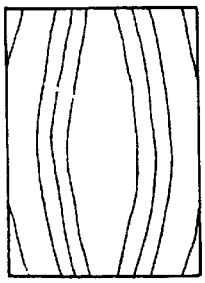
Figure 6G:
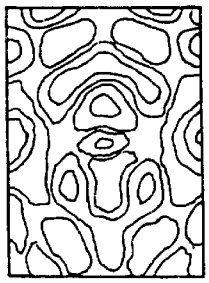
Figure 6D:
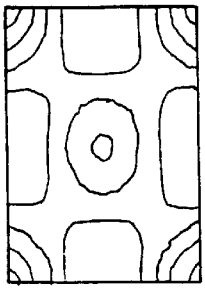
Figure 6H:
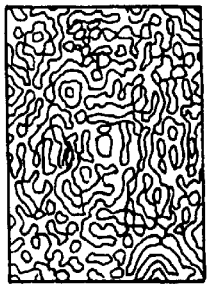

FIGS. 6A to 6H show the results of measurement by a laser Doppler measurement unit of the oscillating mode produced in the diaphragm 2 when the playback input signals of different frequencies are inputted to the speaker apparatus of the present invention. FIG. 6A shows the operating state of the diaphragm 2 when the playback input signal with the input frequency of 33 Hz is sent to the driver unit 3. It may be seen that a circular oscillating mode centered about the driver unit 3 and a transversely elongated rectangular oscillating mode corresponding to the profile of the diaphragm 2 around the outer rim of the circular oscillating mode are observed. FIG. 6B shows the operating state of the diaphragm 2 when the playback input signal with the input frequency of 89 Hz is sent to the driver unit 3. It may be seen that a hyperbolic oscillating mode symetrical in the up-and-down direction in meeting with the driver unit 3 is observed in a vertically elongated rectangle which is in meeting with the profile of the diaphragm 2. FIG. 6C shows the operating state of the diaphragm 2 when the playback input signal with the input frequency of 123 Hz is sent to the driver unit 3. It may be seen that a substantially vertical elongated spindle-shaped oscillating mode, centered about the driver unit 3 connected to the diaphragm 2, is observed. FIG. 6D shows the operating state of the diaphragm 2 when the playback input signal with the input frequency of 275 Hz is sent to the driver unit 3, while FIG. 6E shows the operating state of the diaphragm 2 when the playback input signal with the input frequency of 408 Hz is sent to the driver unit 3. FIG. 6F shows the operating state of the diaphragm 2 when the playback input signal with the input frequency of 554 Hz is sent to the driver unit 3, while FIG. 6G shows the operating state of the diaphragm 2 when the playback input signal with the input frequency of 1785 Hz is sent to the driver unit 3. In the case of FIG. 6G, an oscillating mode having a large peak at a substantially equal distance from the center of a vertically elongated rectangle centered about the driver unit 3 is observed. FIG. 6H shows the operating state of the diaphragm 2 when the playback input signal with the input frequency of 20 kHz is sent to the driver unit 3. It may be seen that a highly dense oscillating mode is observed, in which large peaks ascribable to flexural oscillations are produced in a complicated fashion in a vertically elongated rectangle which is in meeting with the driver unit 3.

The manner of flexing of the panel-shaped diaphragm 2 is varied depending on the material or size of the diaphragm 2, the structure of the digital filter 2 itself, the position of the driving point to which oscillations are applied from the driver unit 3, or the supporting structure of the diaphragm 2. As may be seen from the measured results of FIGS. 6A to 6H, the higher the frequency of the playback input signal inputted to the driver unit 3, the larger is the number of the resonant modes or the number of oscillating modes associated with the flexure. That is, if the frequency of the oscillations accorded to the driver unit 3 is increased, plural flexural oscillation are produced in the diaphragm 2 at intricately changing positions, with the phases of these flexural oscillations being irrelevant of one another. Thus, with the speaker apparatus 1 of the present invention employing the flexural oscillations of the panel-shaped diaphragm 2, directivity is lower in the higher frequency range.

Also, the diaphragm 2 of the present speaker apparatus operates as a bipolar sound source in the low frequency range including the lowest harmonics, thus producing oppositely phased sound waves on the front and back surfaces of the diaphragm 2. That is, the sound radiating surface 2*a* and the driving surface 2*b* of the diaphragm 2 radiate the sound wave of opposite phases, thus exhibiting substantially bi-directional sound-radiating characteristics.

Figure 7:
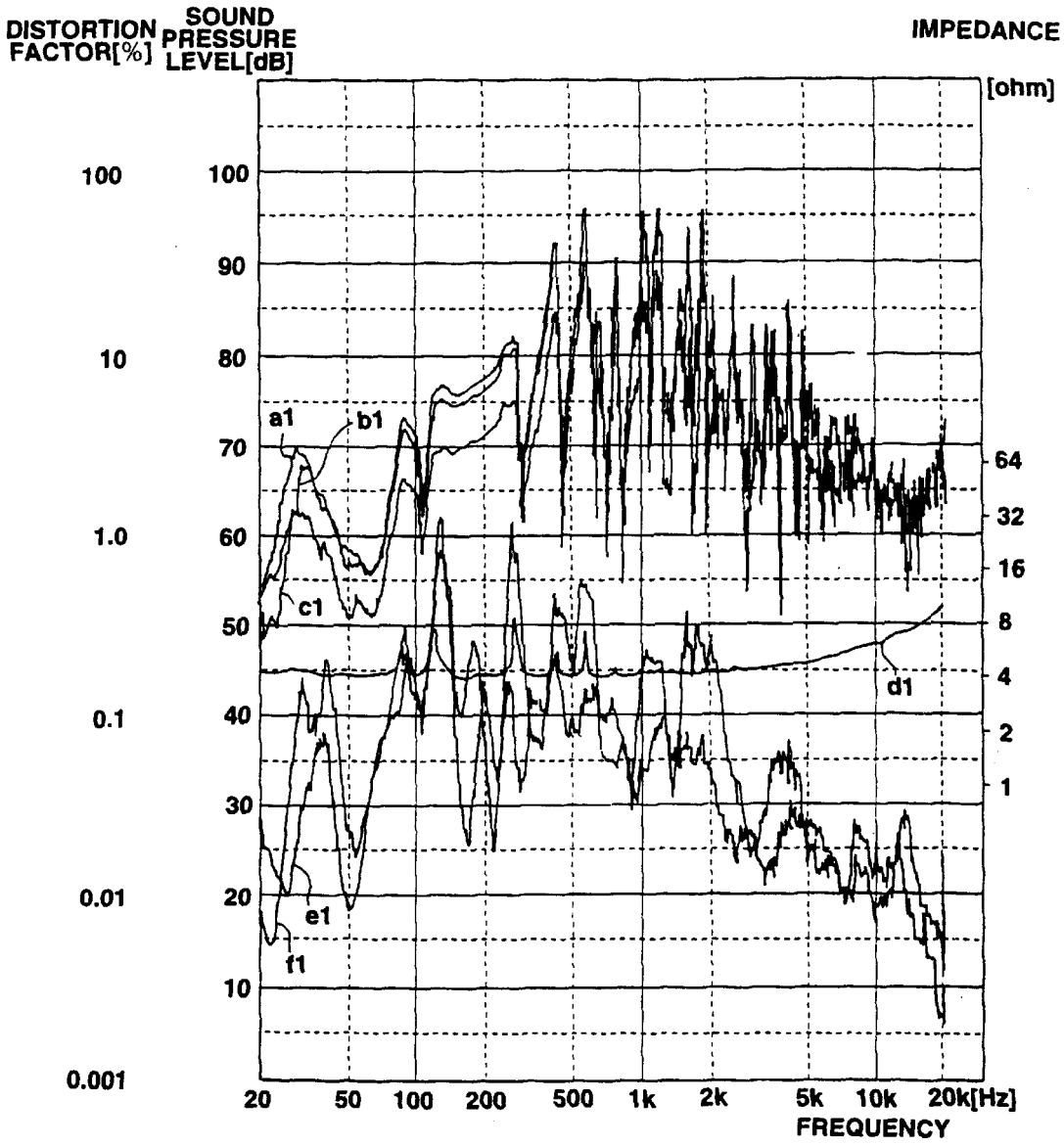
FIG. 7 is a graph showing frequency response characteristics of the speaker apparatus according to the present invention.

FIG. 7 shows the measured results of the frequency response characteristics of the playback input signal of the above-described speaker apparatus 1 according to the present invention. In FIG. 7, lines a1, b1 and c1 represent measured values of the sound pressure levels of the respective playback outputs at a front position, a 30° position and at a 60° position with respect to the sound radiating surface 2*a*. A line d1 represents a measured value of the impedance of the speaker apparatus 1 according to the present invention, while lines e1 and f1 represent measured values of the third harmonic distortions of the playback output.

As may be seen from FIG. 7, the speaker apparatus 1 according to the present invention renders high-sensitivity reproduction possible even if the input frequency of the playback input signal to the driver unit 3 is as low as 200 Hz or less.

Also, in the present speaker apparatus 1, plural flexural oscillations are generated on the diaphragm 2 at intricately changing positions with the increased frequency of the playback input signal. Since these flexural oscillations radiate the sound substantially without regard to phase, the diaphragm 2 in its entirety represents characteristics with diminished directivity. Thus, the speaker apparatus 1 of the present invention is able to radiate the sound over a wide range even in higher frequencies.

Since the speaker apparatus 1 of the present invention is not in need of a resonance box, such as a cabinet, or an acoustic tube, in contradistinction from the conventional speaker apparatus, the speaker apparatus can be designed to a small size and a reduced thickness. Since the diaphragm 2 of the speaker apparatus 1 of the present invention is designed as a substantially flat panel, the outer shape or the surface design of the speaker apparatus 1 can be designed with relative freedom. Specifically, pictures can be drawn, or photos or pictures can be bonded on the sound radiating surface 2*a*. In addition, the diaphragm 2 can be utilized as a projecting surface, or pictures can be projected from an image pickup device.

Since the diaphragm 2 of the speaker apparatus 1 of the present invention is shaped as a panel, and has a larger area of oscillation, low-range sounds can be outputted at a higher sound pressure level than is possible with the conventional dynamic speaker apparatus employing the driver unit 3 of the same design parameters. Since the speaker apparatus 1 of the present invention is not in need of washers for supporting the rim 2*c* of the diaphragm 2 or a supporting member such as frame, in contradistinction from the conventional speaker apparatus, the speaker apparatus can be manufactured with a smaller number of component parts by a rationalized process to enable cost reduction.

In the speaker apparatus 1 of the present invention, the diaphragm 2 is mounted in position by having the mid portion of the surface 2*b* bonded to the ring-shaped distal end 8*a* of the voice coil bobbin 8 making up the driver unit 3. Since the diaphragm 2 undergoes flexural oscillations with its mid portion corresponding to the bonding portion to the voice coil bobbin 8 as a driving point, large oscillations can hardly be transmitted to the outer side of the connecting portion due to the provision of weight mass components or viscous components of the diaphragm 2 when the diaphragm 2 is driven with the high frequency range playback input signal is supplied to the driver unit 3. Thus, with the speaker apparatus 1 of the present invention, the majority of the energy of the sound pressure of the sound radiated from the diaphragm 2 is concentrated on the bonding portion to the voice coil bobbin 8, rather than being extended over the entire diaphragm 2, when the high frequency range playback input signal is inputted to the driver unit 3 to cause oscillations of the diaphragm 2, with the bonding portion substantially operating as a point sound source. Thus, the speaker apparatus 1 exhibits omni-directivity.

Figure 8:
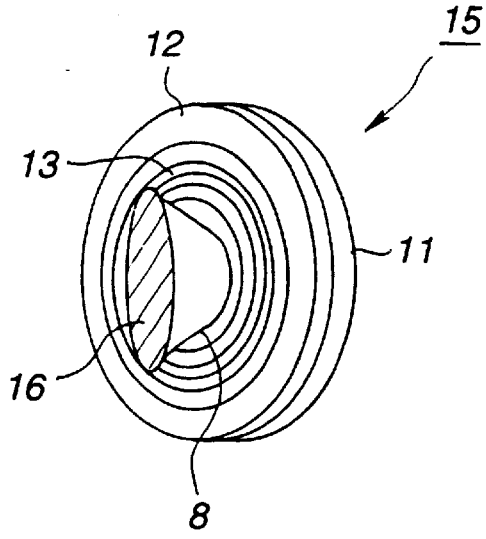
FIG. 8 is a perspective view of a driving unit showing an example of forming the distal end of the voice coil bobbin connected to the diaphragm to an elliptical shape.
Figure 9:
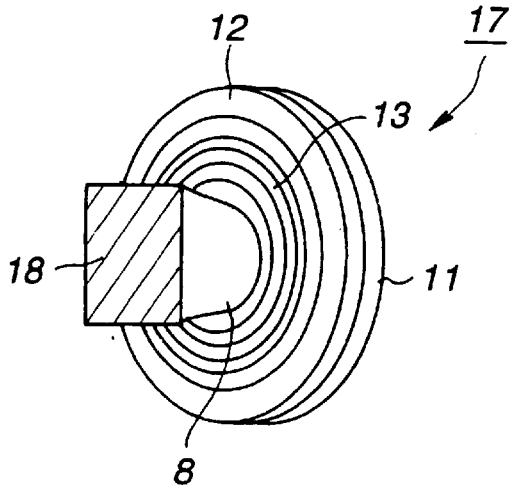
FIG. 9 is a perspective view of a driving unit showing an example of forming the distal end of the voice coil bobbin connected to the diaphragm to a rectangular shape.

For extending the effective range in the high frequency range, the present speaker apparatus 1 employs a driver unit 15 shown in FIG. 8 or a driver unit 17 shown in FIG. 9. Since the basic structures of these driver units 15, 17 are basically equivalent to that of the above-described driver unit 3, the respective components of the driver units 15, 17 are indicated by the same reference numerals and are not explained specifically. The feature of the driver units 15, 17 resides in the shape of connecting ends 16, 18 on one sides of the voice coil bobbin 8 operating as connecting portions to the diaphragm 2.

The driver unit 15, shown in FIG. 8, has the connecting end 16 of the voice coil bobbin 8 to the diaphragm 2 which is configured in an elliptical ring shape, as shown shaded in FIG. 8.

The driver unit 17, shown in FIG. 9, has the connecting end 18 of the voice coil bobbin 8 which is configured as a rectangular ring, as shown shaded in FIG. 9.

With the present speaker apparatus 1, having the driver units 15, 17 having in turn the connecting ends 16, 18, as shown in FIGS. 8 and 9, respectively, the connecting portions between the diaphragm 2 and these driver units 15, 17 are changed in area thus changing the characteristics the high frequency range. With the present speaker apparatus 1, the lowering of the sound pressure level in the low to mid frequency range or adjustment of the amplitude of the sound pressure level in the low to mid frequency range can be achieved by suitably selecting the driver units 3, 15 or 17 to render it possible to maintain continuity with the sound pressure frequency characteristics of the low to mid frequency ranges to realize optimum sound pressure to frequency characteristics in the mid to low frequency ranges.

If a ring-shaped connecting member is used when connecting the diaphragm 2 to the voice coil bobbin 8 of the driver unit 3, the lowering or adjustment of the amplitude of the sound pressure level in the high frequency range can be achieved by using an elliptical or rectangular connecting member.

Figure 10:
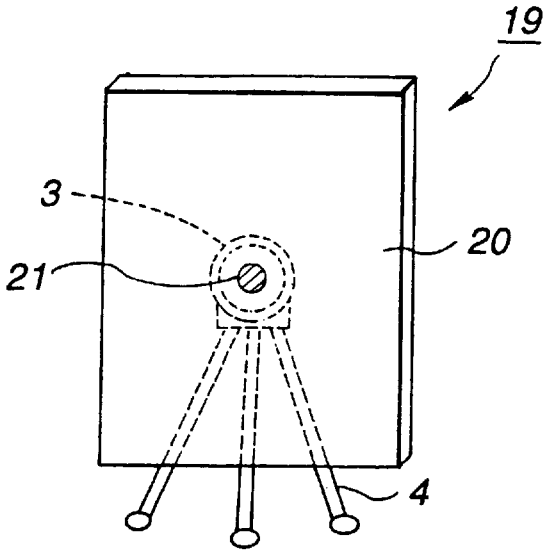
FIG. 10 is a perspective view showing an example of the connecting portion of the voice coil bobbin of the diaphragm formed of a different material.

For improving frequency response characteristics in the high frequency range of a speaker apparatus according to the present invention, the speaker apparatus may be configured as shown in FIG. 10. The feature of the speaker apparatus 19 shown in FIG. 10 resides in a diaphragm 20 connected to the voice coil bobbin 8 of the driver unit 3. That is, the portion of the driver unit 3 configured to be connected to the voice coil bobbin 8 is of a material different from the material of the remaining portions of the driver unit 3. Specifically, the connecting portion to the voice coil bobbin 8 is provided with a connecting plate 21 formed of a different material. This connecting plate 21 is formed as-one with the diaphragm 20, by insert molding, at the time of molding of the diaphragm 20. The material of the connecting plate 21 is selected to improve the response characteristics to the playback input signal of a specified frequency. By providing the connecting plate 21 of a material different from that of the remaining portions, the diaphragm 20 and the connecting plate 21 have respective different oscillation characteristics thus realizing a function equivalent to that of a two-way type speaker apparatus.

Figure 11:
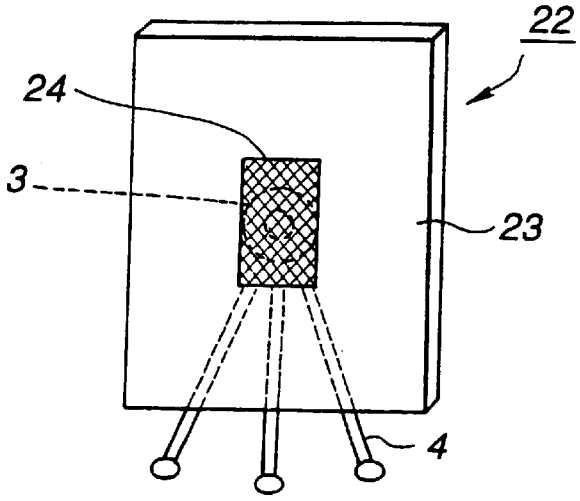
FIG. 11 is a perspective view showing an example of the connecting portion of the voice coil bobbin of the diaphragm and the peripheral part of the apparatus formed of a different material.

For improving the frequency response characteristics in the high frequency range, the present speaker apparatus 22 may be configured as shown in FIG. 11. The speaker apparatus 22 shown in FIG. 11 is designed so that its connecting portion to the voice coil bobbin 8 of the driver unit 3 and its neighboring portions are formed of a material different from that of the remaining portions. Specifically, the connecting plate 24, connected to the voice coil bobbin 8, is selected to be as large as the connecting portion to the voice coil bobbin 8 and its neighboring portions. This connecting plate 24, similarly to the connecting plate 21, is formed as-one with the diaphragm 20, by insert molding, at the time of molding of the diaphragm 20. The material of the connecting plate 21 is selected to improve the response characteristics to the playback input signal of a specified frequency. By suitably selecting not only the material but also the size or the shape of the connecting plate 24, the oscillating mode in the high frequency range can be modified to improve frequency response characteristics in the high frequency range.

Since the diaphragm of the speaker apparatus of the present invention is formed as a panel, solely the mid portion of which is supported by the driver unit so as to permit free oscillations at an outer rim portion at least along its thickness, it can be easily damaged by, for example, an impact from outside.

Figure 12:
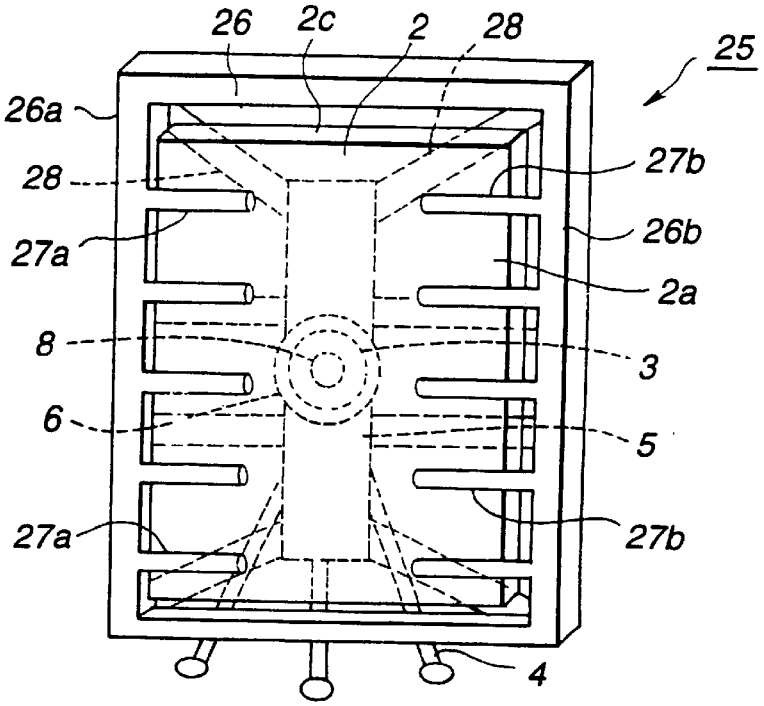
FIG. 12 is a perspective view of a speaker apparatus showing an example of providing a protective frame for protecting the diaphragm.
Figure 13:
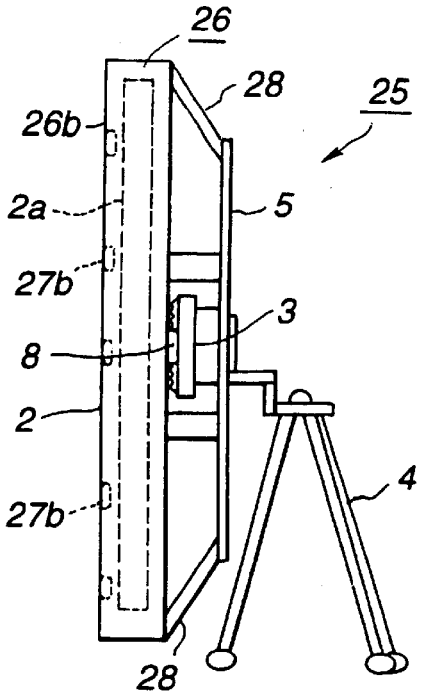
FIG. 13 is a side view thereof.

Thus, a modified speaker apparatus 25 of the present invention is provided with a protective frame 26, as a protective member for protecting the diaphragm 2, as shown in FIGS. 12 and 13.

The portions of the speaker apparatus 25 shown in FIGS. 12 and 13 other than the protective frame 26 are configured similarly to those of the speaker apparatus 1 described above and hence the detailed description is omitted by depicting the common portions by the same reference numerals.

The protective frame 26, provided for protecting the diaphragm 2, is formed in a rectangular shape sized to be large enough to surround the entire periphery of the outer rim 2*c* of the rectangular diaphragm 2, and is formed of a synthetic resin having sufficient toughness to guarantee a high mechanical strength. A pair of pillar-shaped portions 26*a*, 26*b*, facing the protective frame 26, are formed with a number of inwardly projecting cantilevered comb-shaped diaphragm protecting pieces 27*a*, 27*b* as shown in FIG. 12. On the back sides of the pillar-shaped portions 26*a*, 26*b* are integrally formed plural supporting pieces 28, as shown in FIG. 13.

The diaphragm 2, connected to the voice coil bobbin 8 of the driver unit 3, is arranged within this protective frame 26 so that its outer rim 2*c* is surrounded by the protective frame 26. The protective frame 26, surrounding the rim 2*c* of the diaphragm 2, is mounted on the supporting legs 4 by having the supporting pieces 28 fastened to the mounting piece 5 carrying the driver unit 3 supporting the diaphragm 2.

Since the diaphragm 2 has its outer rim 2*c* surrounded by the protective frame 26 and has its one surface 2*a* faced by the diaphragm protecting pieces 27*a*, 27*b*, it is possible to prevent the diaphragm 2 from being injured by inadvertent collision to a near-by article. Since the diaphragm protecting pieces 27*a*, 27*b* are arranged at a distance from the surface 2*a* of the diaphragm 2, there is no risk of the protecting pieces 27*a*, 27*b* obstructing the oscillations of the diaphragm 2.

Figure 14:
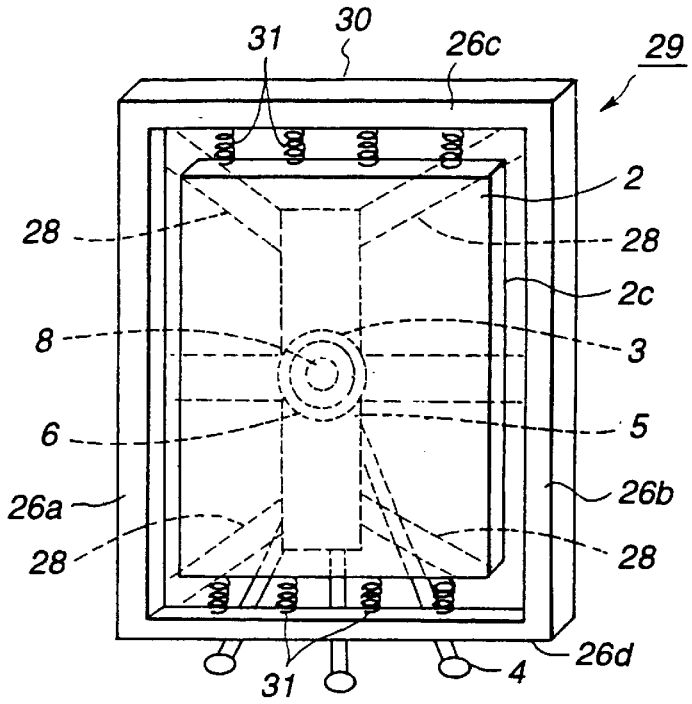
FIG. 14 is a perspective view of a speaker apparatus showing another example of the protective frame.
Figure 15:
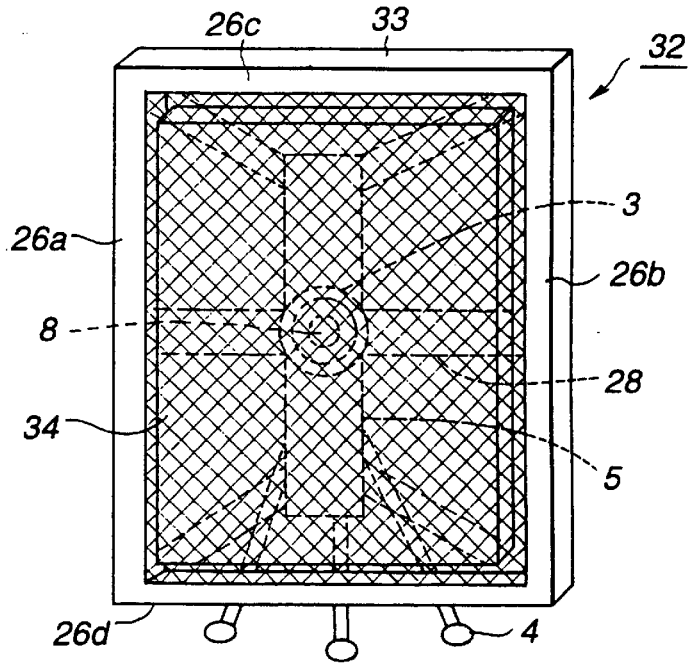
FIG. 15 is a perspective view of a speaker apparatus showing still another example of the protective frame.

For protecting the diaphragm 2, the speaker apparatus 29 of the present invention may be configured as shown in FIG. 14. With the speaker apparatus 29, shown in FIG. 14, a protective frame 30 is arranged surrounding the outer rim 2*c* of the diaphragm 2, and the diaphragm 2 is supported by this protective frame 30 via plural coil springs 31.

Similarly to the protective frame 26, this protective frame 30 is formed of a synthetic resin having sufficient toughness to guarantee a high mechanical strength, and is formed in a rectangular shape sized to be large enough to surround the entire periphery of the outer rim 2*c* of the rectangular diaphragm 2. On the back surfaces of the paired pillar-shaped portions 26*a*, 26*b*, facing the protective frame 26, there are integrally formed plural supporting pieces 28, as shown in FIG. 14.

The diaphragm 2 is arranged within the protective frame 30, so that its outer rim 2*c* is surrounded by the protective frame 30, and is supported by plural coil springs 30 installed in a stretched state between connecting portions 26*c*, 26*d* interconnecting the pillar-shaped portions 26*a*, 26*b* and the outer rim 26*c*. These coil springs 31 are selected to be of elasticity not high enough to impede flexural oscillations of the diaphragm 2.

The protective frame 30, surrounding the outer rim 2*c* of the diaphragm 2, is mounted on the supporting legs 4 by securing supporting pieces 28 to the mounting piece 5 carrying the driver unit 3 supporting the diaphragm 2.

Since the diaphragm 2 is connected to the protective frame 30 via the coil springs 30 which absorb the load of the diaphragm 2 to distribute it over the protective frame 30, it is possible to relieve the load of the connection portions to the driver unit to keep the diaphragm 2 connected reliably to the driver unit 3.

For protecting the diaphragm 2 in the speaker apparatus 32 of the present invention a net 34 may be arranged on the front side of the protective frame 30 for surrounding the outer rim 2*c* of the diaphragm 2 to cover the side 2*a* of the disc 2 by this net 34.

This net 34 used is such a one having acoustic impedance low enough not to affect the oscillations of the diaphragm 2 to prevent attenuation of the sound radiated by the diaphragm 2.

Figure 16:
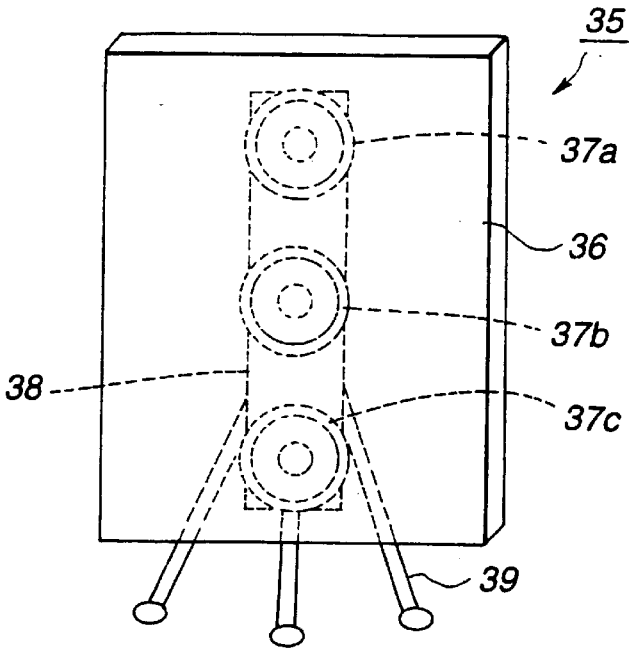
FIG. 16 is a perspective view of a speaker apparatus of the present invention having three driving units.
Figure 17:
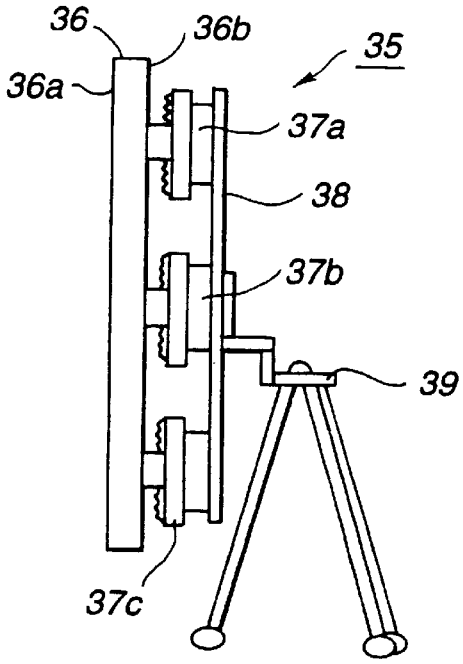
FIG. 17 is a side view thereof.

Although the above-described respective speaker apparatus according to the present invention are configured for flexurally oscillating the diaphragm by the sole driver unit, a plurality of, for example, three driver units may be used to oscillate the diaphragm 2, as shown in FIGS. 16 and 17.

The driver units 37*a*, 37*b*, 37*c* are configured similarly to the driver unit 3 and hence the common portions are depicted by the same reference numerals and are not explained specifically.

In the speaker apparatus 35, shown in FIGS. 16 and 17, three driver units 37*a*, 37*b*, 37*c* are arranged in a vertically extending column along the height of the diaphragm 2 at a center in the left-and-right direction of the diaphragm 2. The driver units 37*a*, 37*b*, 37*c* are arranged at a separation of 70 mm from the neighboring driver units. The diaphragm 2 is supported by being connected to one ends 8*a* of the voice coil bobbins 8 of the respective driver units 37*a*, 37*b*, 37*c*.

The driver units 37*a*, 37*b*, 37*c*, supporting the diaphragm 2, are secured with fasteners, such as set screws, to a mounting plate 39 provided for the supporting legs 38.

The driver units 37*a*, 37*b*, 37*c* of the respective speaker apparatus 35 are driven by a playback input signal of the same amplitude and phase inputted from a playback signal inputting circuit, not shown. The frequency response characteristics, when the playback input signal is sent to the respective driver units 37*a*, 37*b*, 37*c*, are as shown in FIG. 18, in which a2 depicts measured values of the sound pressure level of the playback output at the front surface position with respect to the sound radiating surface 36*a* of the diaphragm 36, d2 depicts measured values of the impedance of the playback output of the speaker apparatus 35, e2 depicts the measured values of the distortion due to second harmonics of the playback output of the speaker apparatus 35 and f2 depicts the measured values of the distortion of the third harmonics of the playback output of the speaker apparatus 35.

Meanwhile, in the speaker apparatus 1 having the sole driver unit 3, the frequency and the number of orders of the oscillating mode on flexural oscillations of the diaphragm 2 are determined by the shape or properties of the material of the diaphragm 2 and the mounting position of the driver unit 3, such that an acute peak dip shown in FIG. 7 is produced. With the speaker apparatus 1, employing the sole driver unit 3, there is observed a dip in the frequency response when the driver unit 3 is mounted at a position corresponding to the node in a given input frequency f since then the oscillations are not transmitted to the entire diaphragm 2. The flexural oscillations, reflecting characteristics of the diaphragm material, are produced in the portions of the diaphragm 2 other than the connecting portion thereof to the voice coil bobbin 8, to which the oscillations from the driver unit 3 are transmitted, as shown in FIG. 6. Thus, the playback output is in keeping with the resonant mode of the diaphragm material. Therefore, with the speaker apparatus 1 employing the sole driver unit 3, the sound proper to the diaphragm material, inclusive of the peak dip, is reproduced.

On the other hand, in the speaker apparatus 35 employing plural, for example, three, driver units 37*a*, 37*b*, 37*c*, the diaphragm 36 is flexurally oscillated by the respective driver units 37*a*, 37*b*, 37*c*. Thus, nodal position of the diaphragm 36 are not driven at the respective frequency ranges of the playback input signal by the respective driver units 37*a*, 37*b*, 37*c* unless the oscillations of the driver units 37*a*, 37*b*, 37*c* are applied to these nodal points. With the speaker apparatus 35, employing the plural driver units 37*a*, 37*b*, 37*c*, these driver units reciprocally complement the driving of the diaphragm 36 at the nodal points in the respective frequency ranges of the driver units 37*a*, 37*b*, 37*c* to suppress occurrence of acute peaks or dips in the frequency response characteristics at the respective nodal points.

Figure 18:
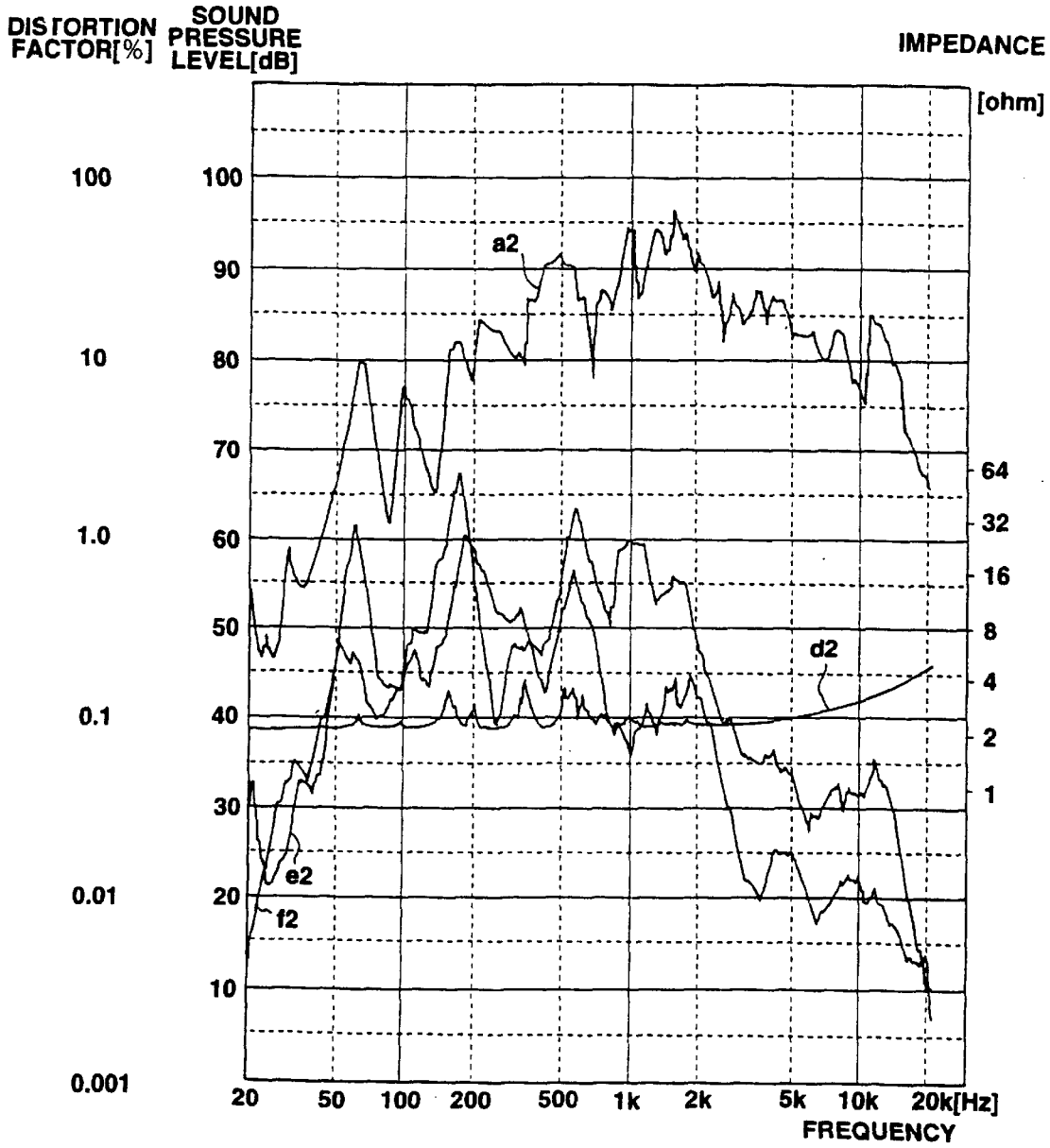
FIG. 18 is a graph showing frequency response characteristics of a speaker apparatus having three driving units.

With the speaker apparatus 35, employing plural driver units 37*a*, 37*b*, 37*c*, peaks or dips in the sound pressure level are decreased in the mid to high frequency ranges, in comparison with the speaker apparatus 1 employing the sole driver unit 3, as may be seen from FIG. 18. In the speaker apparatus 35, employing the three driver units 37*a*, 37*b*, 37*c*, since the diaphragm 36 is oscillated at three points, the playback output peculiar to characteristics of the size or the material of the diaphragm 36 is rarefied to enable reproduction of the sound having optimum sound quality free of affectation.

If the playback input signals having different frequencies f are inputted to the speaker apparatus 35 employing the three driver units 37*a*, 37*b*, 37*c*, the diaphragm 36 exhibits oscillating modes shown in FIGS. 19A to 19H illustrating the measured results of the oscillating mode of the diaphragm 36 by a laser Doppler meter.

Figure 19A:
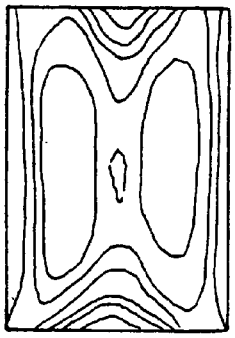
FIG. 19 is a plan view showing respective oscillating modes of the diaphragm dependent on the frequency of the playback input signal of the speaker apparatus having three driving units.
Figure 19B:
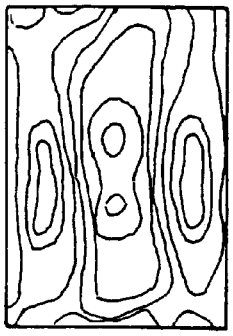
Figure 19C:
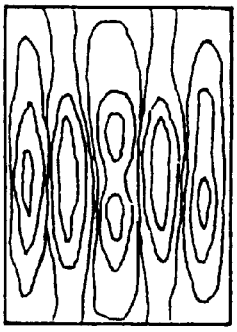
Figure 19D:
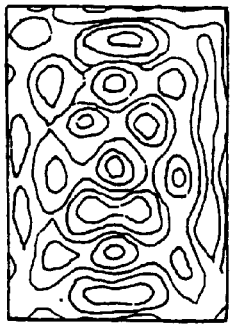
Figure 19E:
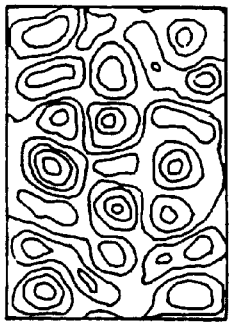
Figure 19F:
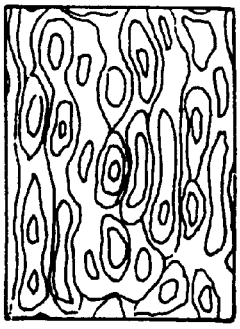
Figure 19G:
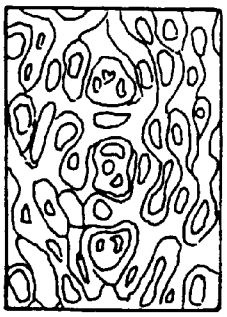
Figure 19H:
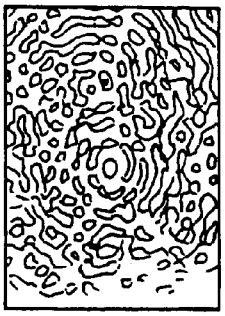

FIG. 19A shows the operating state of the diaphragm 36 when the playback input signal having the input frequency of 62 Hz is supplied to the driver units 37*a*, 37*b*, 37*c*. Similarly, FIG. 19B shows the operating state of the diaphragm 36 when the playback input signal having the input frequency of 150 Hz is supplied to the driver units 37*a*, 37*b*, 37*c*. FIG. 19C shows the operating state of the diaphragm 36 when the playback input signal having the input frequency of 315 Hz is supplied to the driver units 37*a*, 37*b*, 37*c*. FIG. 19D shows the operating state of the diaphragm 36 when the playback input signal having the input frequency of 501 Hz is supplied to the driver units 37*a*, 37*b*, 37*c*. FIG. 19E shows the operating state of the diaphragm 36 when the playback input signal having the input frequency of 630 Hz is supplied to the driver units 37*a*, 37*b*, 37*c*. FIG. 19F shows the operating state of the diaphragm 36 when the playback input signal having the input frequency of 795 Hz is supplied to the driver units 37*a*, 37*b*, 37*c*. FIG. 19G shows the operating state of the diaphragm 36 when the playback input signal having the input frequency of 1500 Hz is supplied to the driver units 37*a*, 37*b*, 37*c*. Finally, FIG. 19H shows the operating state of the diaphragm 36 when the playback input signal having the input frequency of 12 kHz is supplied to the driver units 37*a*, 37*b*, 37*c*.

With the speaker apparatus 35, employing the three driver units 37*a*, 37*b*, 37*c*, there are induced oscillations in the low frequency range of the input frequency f of 63 Hz in the vicinity of the outer rim of the diaphragm 36 which are reversely phased with respect to those induced at the center of the diaphragm where the oscillations from the driver units 37*a*, 37*b*, 37*c* are transmitted, as may be seen from FIGS. 19A to 19H. That is, since the outer rim of the diaphragm 36 can be oscillated substantially freely at least in the direction of thickness, as described previously, oscillations in the low frequency range are liable to be produced in the outer rim portion, thus realizing the stable playback output even in the low frequency range.

In the speaker apparatus 35, employing the three driver units 37*a*, 37*b*, 37*c*, in which the diaphragm 36 is connected to the voice coil bobbins 8 of the three driver units 37*a*, 37*b*, 37*c*, the mechanical strength is improved. In addition, since the speaker apparatus is driven by the three driver units 37*a*, 37*b*, 37*c*, the sound pressure frequency characteristics and the sound quality of the reproduced sound are improved. That is, in the speaker apparatus 1, employing the sole driver unit 3, since the totality of the load of the diaphragm 2 is applied to the connecting portion of the diaphragm 2 to the voice coil bobbin 8, the oscillating mode of the diaphragm 2 tends to be deviated from the linear movement under the load applied to the connecting portion to the voice coil bobbin 8 thus affecting the sound quality of the reproduced sound.

Conversely, with the speaker apparatus 35 employing the three driver units 37*a*, 37*b*, 37*c*, in which the load of the diaphragm 36 is distributed to the respective driver units 37*a,* 37*b,* 37*c,* the load applied to the connecting portion of the diaphragm 36 to the v36 is relieved to improve the mechanical strength and durability in the respective connecting portions.

With the speaker apparatus 35 employing the plural driver units 37*a,* 37*b,* 37*c,* the oscillating mode produced in the diaphragm 36 can be modified by suitably selecting the materials of the diaphragm 36 to suppress the excessively large load produced in the diaphragm 36 to enable the required oscillating mode to be produced. With the speaker apparatus 35 in which the respectively driver units 37*a,* 37*b,* 37*c* are arranged in the vertical column of the diaphragm 36, it is possible to suppress occurrence of the oscillation mode in which the transverse direction orthogonal to the arraying direction of the respective driver units 37*a,* 37*b,* 37*c* is split into respective nodes, as shown in FIGS. 19A to 19H. With the speaker apparatus 35, employing the driver units 37*a,* 37*b,* 37*c,* the oscillating mode at a specified frequency with respect to a particular direction is suppressed by suitably arranging the driver units 37*a,* 37*b,* 37*c,* thereby improving and stabilizing the sound quality to reinforce the vibrating mode in the specified frequency in a particular direction.

With the speaker apparatus 35, employing the driver units 37*a,* 37*b,* 37*c,* the oscillating mode shown in FIGS. 19A to 19H are produced in the diaphragm 36 responsive to the input frequency f of the playback input signal inputted to the driver units 37*a,* 37*b,* 37*c.* In the present speaker apparatus 35, there is produced a phenomenon in which, if the input frequency f of the playback input signal is as low as 62 Hz, the regions lying on both sides of the longitudinal area extending along the centerline interconnecting the driver units 37*a,* 37*b,* 37*c* are oscillated in reverse phase, as shown in FIG. 19A, thus improving sensitivity in the low frequency range. With the present speaker apparatus 35, outer edge regions of the diaphragm 36 are flexurally oscillated in reverse phase to the vicinity of the connecting regions of the driver units 37*a,* 37*b,* 37*c* to the diaphragm 36 to output the playback sound up to a still lower frequency range.

With the speaker apparatus 35 employing the driver units 37*a,* 37*b,* 37*c,* the one end 8*a* of the voice coil bobbin 8, operating as a connecting portion to the diaphragm 36, may be elliptical or rectangular, as shown in FIGS. 8 and 9. By forming the end 8*a* of the voice coil bobbin 8, operating as a connecting portion to the diaphragm 36, in a ring shape, the sound pressure energy is concentrated in the vicinity of the connecting portion, in the higher frequency range of the playback input signal on the order of 12 kHz, as shown in FIG. 19H, so that the sound is radiated from the vicinity of the connecting portion.

By forming the end 8*a* of the voice coil bobbin 8, operating as a connecting portion to the diaphragm 36, in a circular to an elliptical or rectangular shape, the bonding area between the diaphragm 36 and the voice coil bobbin 8 is varied, thus varying the sound pressure to frequency characteristics in the high frequency range.

With the speaker apparatus 35, employing the driver units 37*a,* 37*b,* 37*c,* the sound pressure frequency characteristics in the high range can be varied by suitably selecting the size of the connecting portion of the diaphragm 36 to the driver units 37*a,* 37*b,* 37*c* or the size of the driver units 37*a,* 37*b,* 37*c,* so that the playback sound of the optimum sound quality can be produced which has flat sound pressure frequency characteristics over a frequency range from the low to high range.

With the speaker apparatus according to the present invention, the frequency characteristics can be suitably changed by providing the diaphragm with a mass member.

Figure 20:
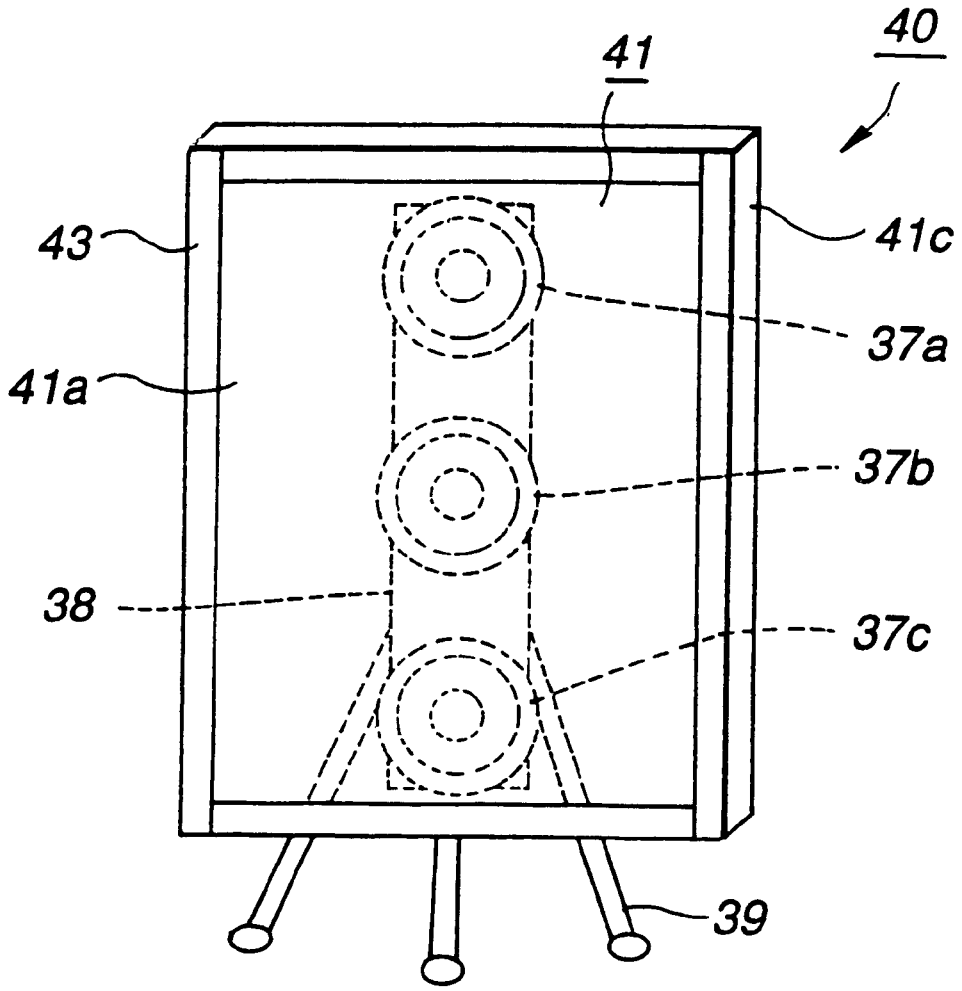
FIG. 20 is a perspective view showing a speaker apparatus having a mass weight member arranged on the diaphragm.

Referring to FIG. 20, a speaker apparatus having a mass member in the diaphragm is explained.

Similarly to the speaker apparatus shown in FIGS. 16 and 17, a speaker apparatus 40 shown in FIG. 20 has three driver units 37*a,* 37*b,* 37*c.* Since the speaker apparatus 40 has the basic structure in common with the speaker apparatus 35 shown in FIGS. 16 and 17, the common portions are depicted by the common reference numerals and are not explained specifically.

With the present speaker apparatus 40, a mass member 43, formed of sheet-shaped lead member of high specific gravity, is affixed to the entire periphery of the outer rim 41*c* of the sound radiating surface 41*a* on the opposite side to the surface of the diaphragm 41 carrying the driver units 37*a,* 37*b,* 37*c.*

The diaphragm 41 of the speaker apparatus 40, shown in FIG. 20, has only its mid portion supported by the driver units 37*a,* 37*b,* 37*c,* so that the outer rim 41*c* can be oscillated freely at least along the direction of thickness. Thus, the diaphragm 41 cannot be oscillated to follow the oscillations applied from the driver units 37*a,* 37*b,* 37*c* correctly to produce oscillations in the resonant mode proper to the diaphragm 41 to render it impossible to produce optimum frequency response characteristics. In particular, optimum frequency characteristics can be realized in the low frequency range by the diaphragm 41 being flexurally oscillated up to the outer rim 41 with high response to the oscillations applied from the driver units 37*a,* 37*b,* 37*c.* By providing the mass member 43 on the outer rim 41*c* of the diaphragm 41, the oscillations in the resonant mode proper to the diaphragm 41 can be suppressed, so that the flexural oscillations can be generated with high responsiveness to the oscillations applied from the driver units 37*a,* 37*b,* 37*c* even in the low frequency range to render it possible to reproduce up to the frequency range of the lower frequency.

Figure 21:
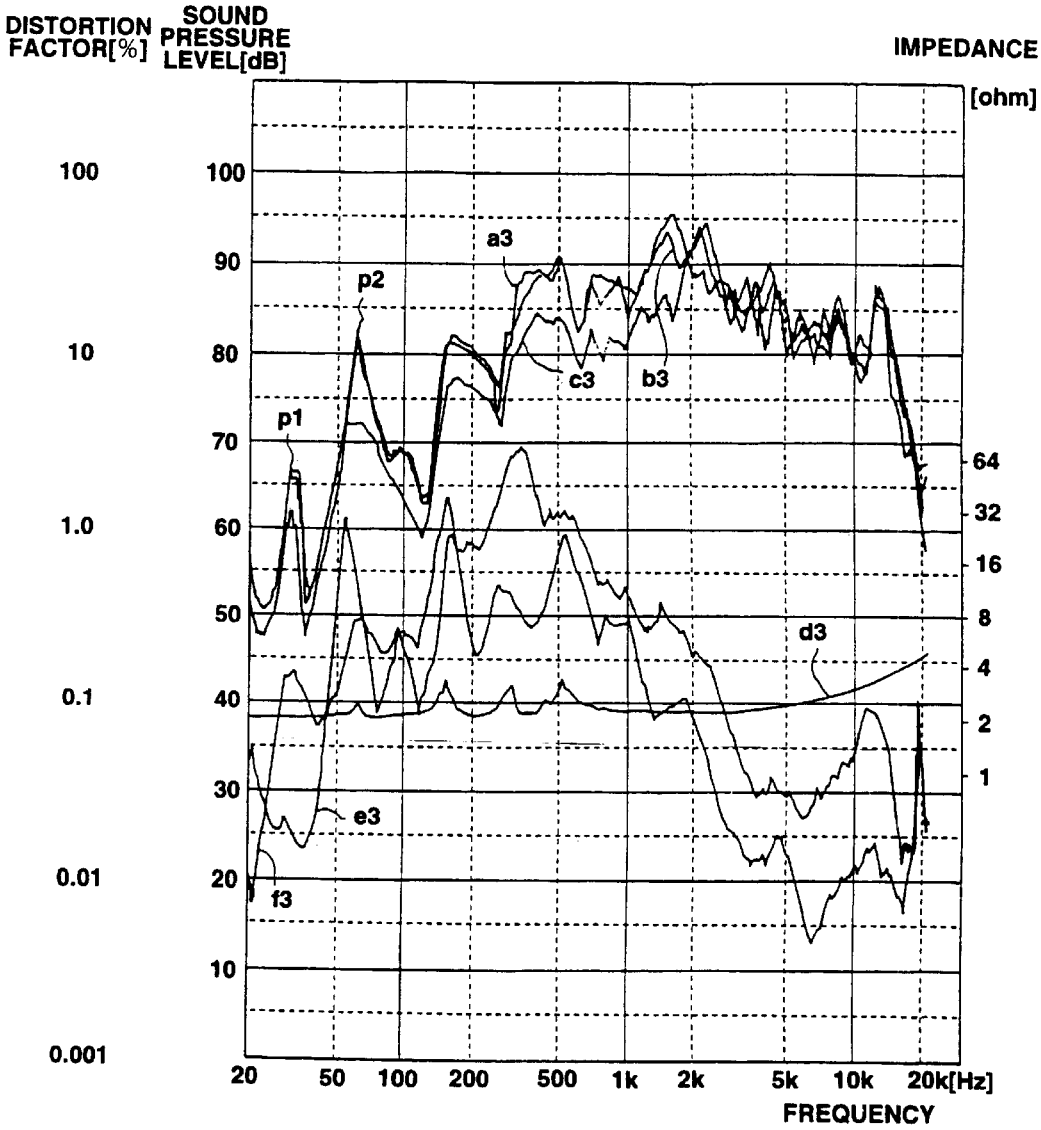
FIG. 21 is a graph showing frequency response characteristics of a speaker apparatus having a mass weight member arranged on the diaphragm.

With the present speaker apparatus 40, the playback input signal of the same amplitude and phase is inputted to the driver units 37*a,* 37*b,* 37*c* from a playback signal input circuit, not shown, for driving the driver units 37*a,* 37*b,* 37*c.* The frequency response characteristics when the playback input signal is inputted to the driver units 37*a,* 37*b,* 37*c* are as shown in FIG. 21. In FIG. 21, lines a3, b3 and c3 represent the measured values of the sound pressure level of the playback output at a front position with respect to the sound radiating surface 41*a* of the diaphragm 41, those at a 30° position with respect to the sound radiating surface 41*a* and those at a 60° position with respect to the sound radiating surface 41*a,* respectively. The line d3 represents the measured value of the impedance of the playback output of the speaker apparatus 40. Also, the lines e3 and f3 represent the measured values of the distortion due to the second harmonics of the playback output and the measured value of the distortion due to the third harmonics of the playback output, respectively. With the present speaker apparatus 40, the sound pressure level for the input frequency of 33 Hz as shown at p1 and that for the input frequency of 63 Hz shown at p2 in FIG. 21 are augmented in comparison with those of the speaker apparatus 35 not having the mass member in its diaphragm, thus indicating that the response characteristics are improved in the low frequency range. Therefore, with the speaker apparatus 40 provided with the mass member 43 on the outer rim 41*c* of the diaphragm 41, the frequency range that can be reproduced is further lower than is possible with a speaker apparatus having a diaphragm of the same size and material type as the present diaphragm 41.

Figure 22:
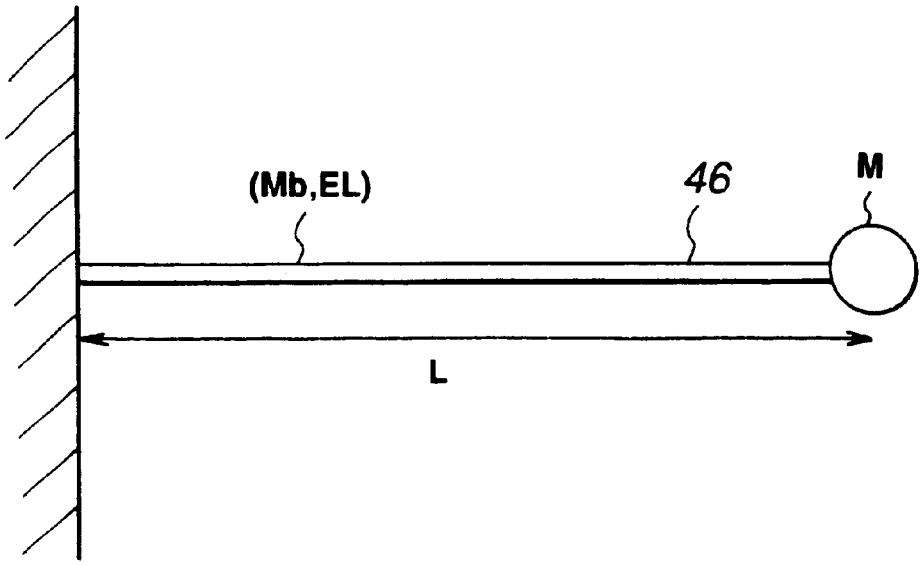
FIG. 22 illustrates the principle of improvement in response characteristics in the low frequency range when a mass weight member is arranged on the diaphragm.

The principle under which the response characteristics to the lower frequency range by using the diaphragm 41 having the mass member 43 can be explained by an oscillation model in a cantilevered beam 46 shown in FIG. 22. That is, if the cantilevered beam 46 with a weight mass Mb has a mass M at its free end, a length L and bending toughness EL, the resonant frequency Wn of the cantilevered beam 46 may be expressed by the following equation:

$$Wn\Lambda 2=k/(M+0.25Mb)$$

where k=3EL/LΛ3.

While the panel-shaped diaphragm 41 is oscillated with the two-dimensional oscillation mode, provision of the mass member 43 on its outer rim is equivalent to enlarging the mass Mb in the above equation of the resonant frequency Wn of the cantilevered beam 46 of the oscillation model. Thus, with the speaker apparatus 40 provided with the mass member 43, the denominator of the right side in the above equation indicating the resonant frequency of the cantilevered beam 46 is increased to decrease the resonant frequency, thus improving the response characteristics in the lower frequency range.

In the speaker apparatus 40, shown in FIG. 20, the mass member is attached to the outer rim 41*c* on the sound radiating surface 41*a* of the diaphragm 41. Alternatively, it may also be attached to other portions on the sound radiating surface 41*a*. By attaching the mass member 43 to an inner portion of the sound radiating surface 41*a*, the oscillations applied by the driver units 37*a*, 37*b*, 37*c* to the diaphragm 41 may be prevented from being transmitted to the outer rim 41*c*, thus enabling suppression of the oscillations in the resonant mode and frequency response characteristics exhibiting acute rise in the sound pressure level at a specified frequency. The result is the smooth sound pressure frequency response characteristics from a low frequency range to a higher frequency range and a reproduced sound of the spontaneous sound quality.

Meanwhile, the material of the mass member 43 provided on the diaphragm 41 is not limited to lead used in the sheet-shaped lead material. That is, such a material having large oscillation loss or oscillation resistant effects may be used. The mass member 43 may also be buried as-one with the diaphragm 41. That is, a lead material may be insert-molded at the time of molding the diaphragm 41.

With the above-described speaker apparatus 35, 40, the three driver units 37*a*, 37*b*, 37*c* are arranged in a column along the height at a mid portion in the left-and-right direction of the diaphragms 36, 41, a larger number of driver units may also be used.

Figure 23:
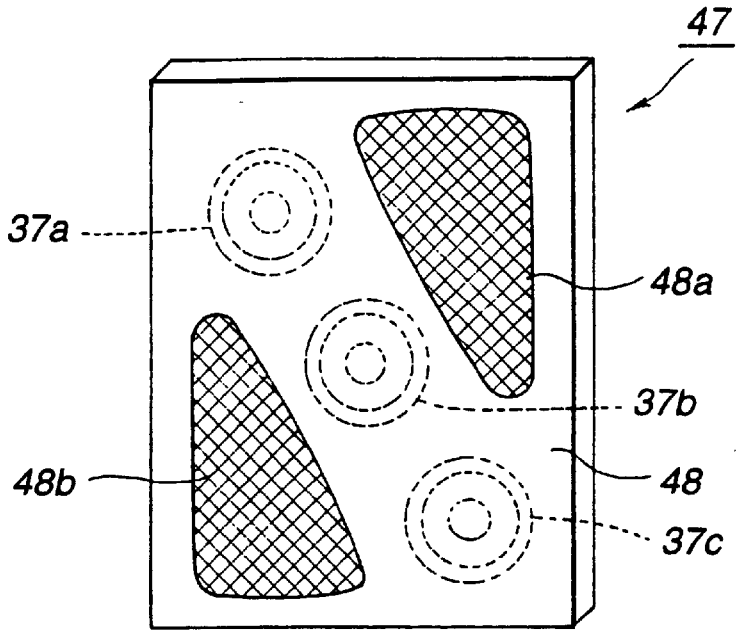
FIG. 23 is a perspective view showing an example of obliquely arranging three driving units on a rectangular diaphragm.

In a speaker apparatus 47 according to the present invention, three driver units 37*a*, 37*b*, 37*c* are arranged along a diagonal line of the rectangular diaphragm 48, as shown in FIG. 23. In the speaker apparatus 47, having the three driver units 37*a*, 37*b*, 37*c* arranged in this manner, since large oscillation areas 48*a*, 48*b* are defined in the neighborhood of the connecting portions of the diaphragm 48 to the driver units 37*a*, 37*b*, 37*c* adapted for flexurally oscillating the diaphragm 48, the playback input signal can be reproduced with high response characteristics up to a lower frequency range.

Figure 24:
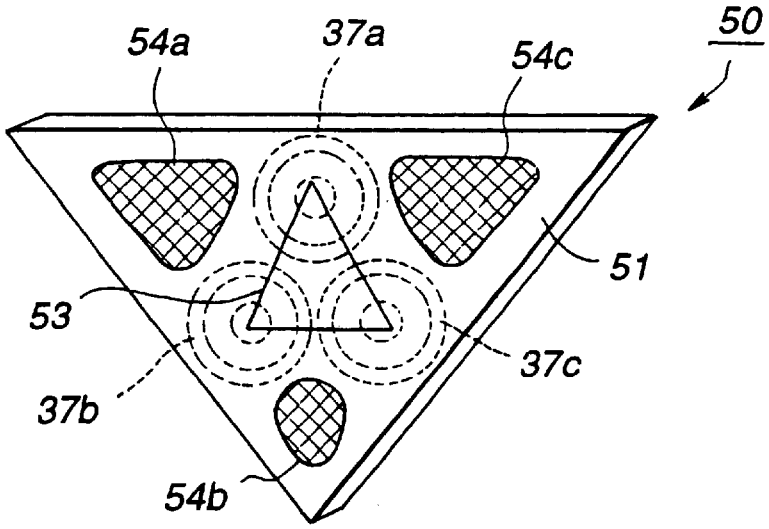
FIG. 24 is a perspective view showing an example of forming the diaphragm to a triangular shape.

A speaker apparatus 50 according to the present invention may use a diaphragm 51 in the shape of a triangular panel, as shown in FIG. 24. In this speaker apparatus 50, large oscillation areas 54*a*, 54*b*, 54*c* are defined in the neighborhood of the connecting portions of the diaphragm 48 to the driver units 37*a*, 37*b*, 37*c* adapted for flexurally oscillating this diaphragm 48, so that the playback input signal can be reproduced with high response characteristics up to a lower frequency range.

By arranging the plural driver units 37*a*, 37*b*, 37*c* in a mid portion of the diaphragms 48, 51, as shown in FIGS. 23 and 24, and by enlarging the oscillation areas in comparison with the areas of the connecting portions between the voice coil bobbins 8 of the driver units 37*a*, 37*b*, 37*c*, as shown in FIGS. 23, 24, the diaphragms 48, 51 can be flexurally oscillated to larger amplitude, thereby improving the frequency response characteristics in the low frequency range.

The speaker apparatus according to the present invention may be configured so that the portions of the diaphragm connected to the plural driver units is formed of a material other than that of the remaining portions.

Figure 25:
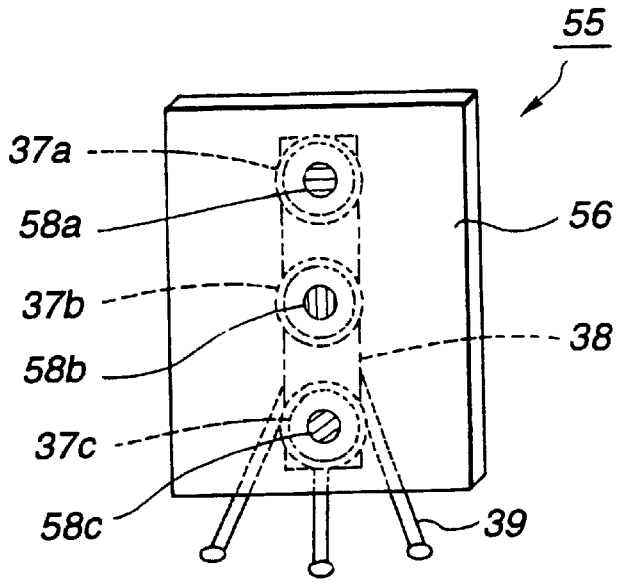
FIG. 25 is a perspective view showing a speaker apparatus in which the portion of each driving unit of the diaphragm connected to the voice coil bobbin is provided with a coupling member formed of a material different from the material of other portions.

In a speaker apparatus 55, shown in FIG. 25, the portions of the diaphragm 56 connected to the voice coil bobbins 8 of the driver units 37*a*, 37*b*, 37*c* are provided with connecting members 58*a*, 58*b*, 58*c* formed of a material different from the material of the remaining portions. These connecting members 58*a*, 58*b*, 58*c* are formed of a material that can sufficiently guarantee the connection strength to the voice coil bobbins 8, and are formed as-one with the diaphragm 56. The connecting members 58*a*, 58*b*, 58*c* are connected as-one to the diaphragm 56 by insert molding in which the connecting members 58*a*, 58*b*, 58*c* are placed from the outset in a metal mold used for molding the connecting members 58*a*, 58*b*, 58*c* when molding the diaphragm 56.

By providing the connecting members 58*a*, 58*b*, 58*c*, the portions of which connected to the voice coil bobbins 8 of the driver units 37*a*, 37*b*, 37*c* are formed of a material different from the material of the remaining diaphragm portions, it is possible to change the oscillating mode of the high frequency range to vary the frequency response characteristics.

Figure 26:
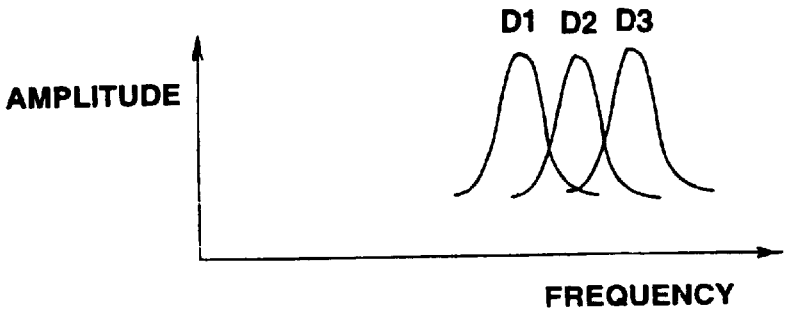
FIG. 26 is a graph showing the relation between the frequency and the amplitude for illustrating the state of the resonant frequency of the high range of the speaker apparatus shown in FIG. 25.

If the connecting members 58*a*, 58*b*, 58*c* are formed of respective different materials, the resonant frequencies of the high frequency range can be shifted at respective connecting portions D1 to D3 between the diaphragm 56 and the voice coil bobbins 8 of the driver units 37*a*, 37*b*, 37*c*, as shown in FIG. 26. By complementarily using the resonant frequencies of the driver units 37*a*, 37*b*, 37*c*, it becomes possible to suppress the peaks of the frequency response in the high frequency range to improve the frequency response characteristics in the high frequency range.

Figure 27:
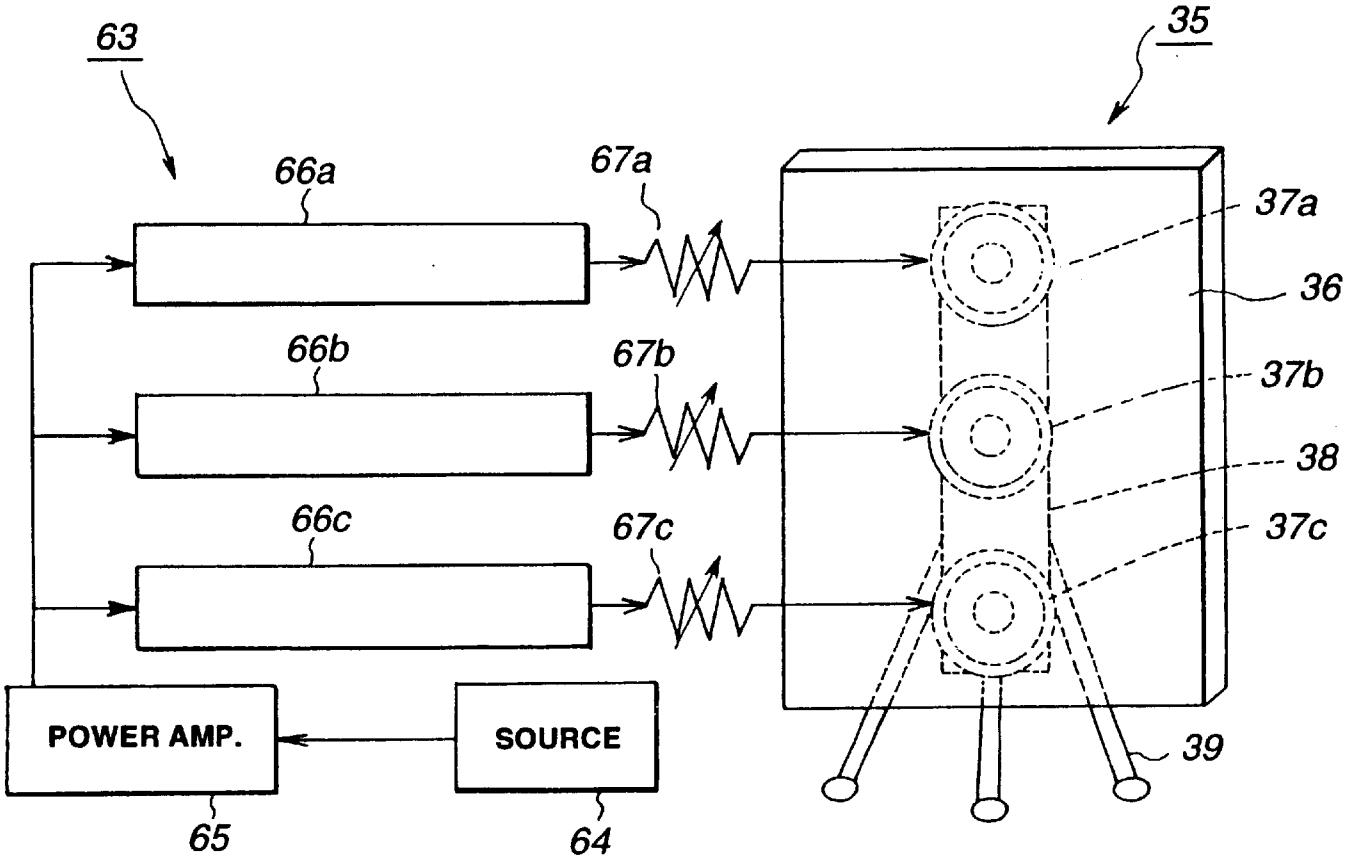
FIG. 27 is a circuit diagram of a playback signal input unit adapted for supplying playback input signals having three driver units.

The speaker apparatus 35, adapted to reproduce the acoustic sound by flexural oscillations of the diaphragm 36 using the plural driver units 37*a*, 37*b*, 37*c*, as shown in FIG. 16, is driven to reproduce the acoustic sound by the playback input signal being inputted from a playback signal inputting unit 63 of FIG. 27 being inputted to the respective driver units 37*a*, 37*b*, 37*c*.

The playback signal inputting unit 63, provided in the speaker apparatus 35, is configured for independently inputting the playback input signals to the driver units 37*a*, 37*b*, 37*c* and for switching the phase of the playback input signals inputted to the driver units 37*a*, 37*b*, 37*c*.

Specifically, the playback signal inputting unit 63 is made up of an amplifier 65 for amplifying the playback input signals outputted by a sound source 64, such as a disc player or a video tape recorder, and series connections of changeover switches 66*a*, 66*b*, 66*c* and volumes 67*a*, 67*b*, 67*c*, reciprocally independently connected between the amplifier 65 and the driver units 37*a*, 37*b*, 37*c*. The changeover switches 66*a*, 66*b*, 66*c* on/off switch the playback input signal inputted to the driver units 37*a*, 37*b*, 37*c*, while switching the phase of the playback input signal in the input on state. The volumes 67*a*, 67*b*, 67*c* adjust the level of the playback input signal inputted to the driver units 37*a*, 37*b*, 37*c* to adjust respective outputs of the respective driver units 37*a*, 37*b*, 37*c*.

The speaker apparatus 35, having the playback signal inputting unit 63, radiates the reproduced acoustic sound, by the playback input signals having required phase components being fed from the playback signal inputting unit 63 to the driver units 37*a*, 37*b*, 37*c*, and by the voice coil bobbins 8 of the driver units 37*a*, 37*b*, 37*c* performing piston movements to transmit oscillations to the portions of the diaphragm 36 connected to the voice coil bobbins 8 to cause the diaphragm 36 to be flexurally oscillated with the connecting portions to the respective voice coil bobbins 8 as the center of oscillations. The playback input signals, supplied from the playback signal inputting unit 63, are independently inputted to the driver units 37*a*, 37*b*, 37*c* and can be adjusted in level or switched in phase, so that the sound field or the sound quality of the reproduced acoustic sound can be suitably changed by an extremely simple operation without using special circuit elements or switching means to produce the playback sound suited to the user's taste.

Figure 28:
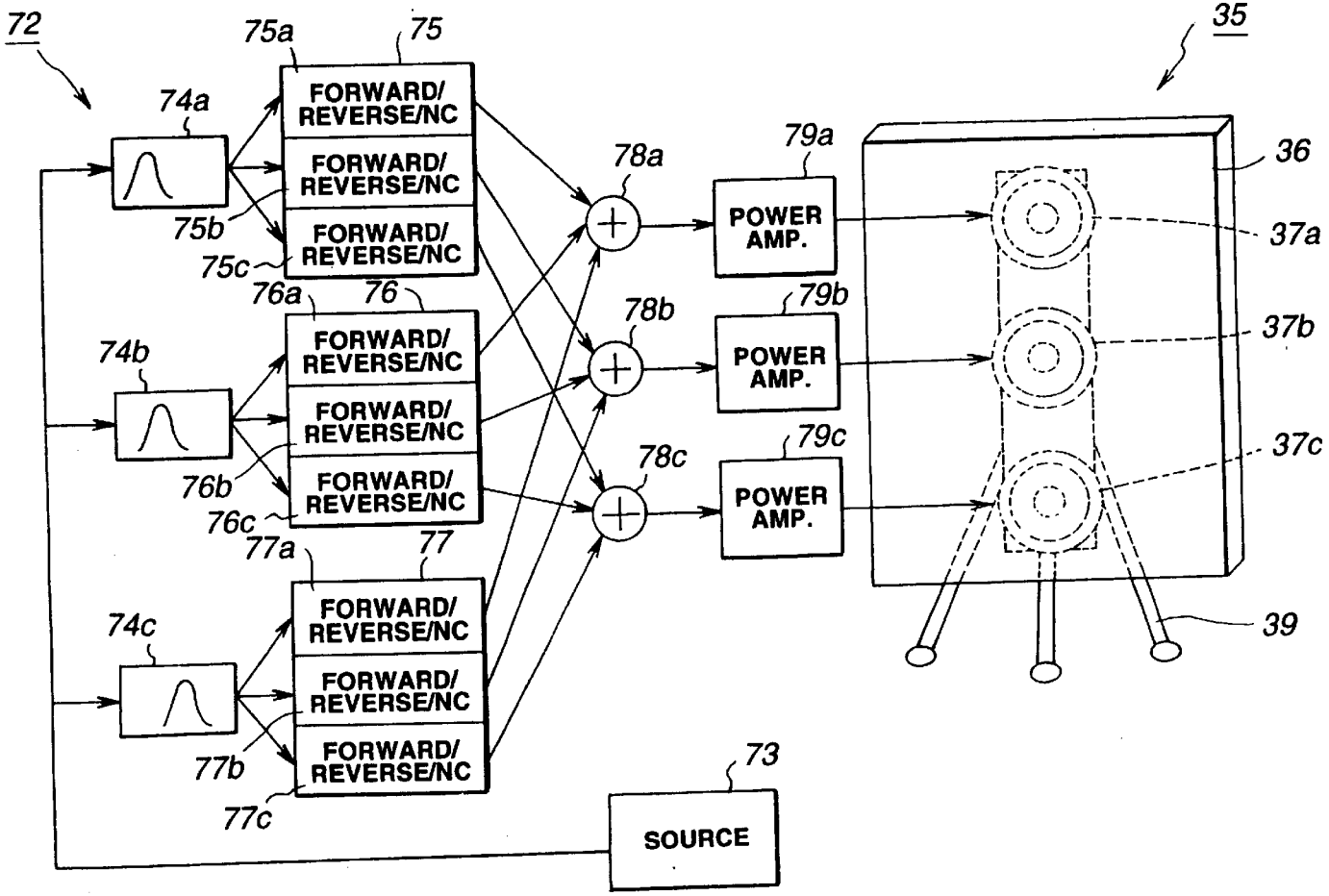
FIG. 28 is a circuit diagram of a playback signal input unit adapted for supplying playback input signals having three driver units.

The playback signal inputting unit, adapted to drive the speaker apparatus 35, may be configured as shown in FIG. 28.

A playback signal inputting unit 72, shown in FIG. 28, is configured so that the playback input signal outputted by a sound source 73 is split into three frequency bands and adjusted for phase, with the playback input signal, split into respective frequency bands, being synthesized and sent to the respective driver units 37*a*, 37*b*, 37*c*.

Specifically, the playback signal inputting unit 72, shown in FIG. 28, is made up of band-pass filters 74*a*, 74*b*, 74*c*, fed with the playback input signal from the sound source 73, changeover switch units 75, 76, 77, respectively connected to these bandpass filters 74*a*, 74*b*, 74*c*, mixers 78*a*, 78*b*, 78*c*, respectively fed with the playback input signals via these changeover switch units 75, 76, 77, and amplifiers 79*a*, 79*b*, 79*c* connected respectively between the mixers 78*a*, 78*b*, 78*c* and the driver units 37*a*, 37*b*, 37*c*. The band-pass filters 74*a*, 74*b*, 74*c* split the playback input signals supplied from the sound source 73 into respective frequency bands.

The changeover switch units 75, 76, 77 are constituted by each three changeover switches 75*a* to 75*c*, 76*a* to 76*c* and 77*a* to 77*c*, connected respectively to the mixers 78*a*, 78*b*, 78*c*. These changeover switches 75*a* to 75*c*, 76*a* to 76*c* and 77*a* to 77*c* on/off switch the playback input signals fed to the mixers 78*a*, 78*b*, 78*c*, while on/off switching the playback input signals inputted to the mixers 78*a*, 78*b*, 78*c*. The mixers 78*a*, 78*b*, 78*c* synthesize the playback input signals of pre-set frequency bands, supplied from the changeover switches 75*a* to 75*c*, 76*a* to 76*c* and 77*a* to 77*c*, to send the synthesized playback input signals to the amplifiers 79*a*, 79*b*, 79*c*, which then amplify the synthesized playback input signal to route the amplified signal to the driver units 37*a*, 37*b*, 37*c*.

With the speaker apparatus 35, provided with the playback signal inputting unit 72, constructed as shown in FIG. 28, the playback input signals from the playback signal inputting unit 72, split into three frequency bands and adjusted to the required phase components, are routed to the driver units 37*a*, 37*b*, 37*c* of the speaker apparatus 35. These driver units 37*a*, 37*b*, 37*c* are driven independently so that the voice coil bobbins 8 of the respective driver units 37*a*, 37*b*, 37*c* perform piston movement to transmit the oscillations to the portions of the diaphragm 36 connected to the voice coil bobbins 8. The diaphragm 36 is thereby flexurally oscillated, with the connecting portions to the voice coil bobbins 8 as the center of the oscillations, to radiate the playback acoustic sound.

At this time, in-phase playback input signals are inputted in the low frequency range to the driver units 37*a*, 37*b*, 37*c*, while reverse-phase playback input signals are fed in the mid to high frequency range to the driver units 37*a*, 37*b*, 37*c*. Specifically, the forward-phased playback input signals are sent to the driver units 37*a*, 37*c* at the upper and lower positions in FIG. 28, while the reverse-phased playback input signal is sent to the center driving unit 37*b*.

Figure 29:
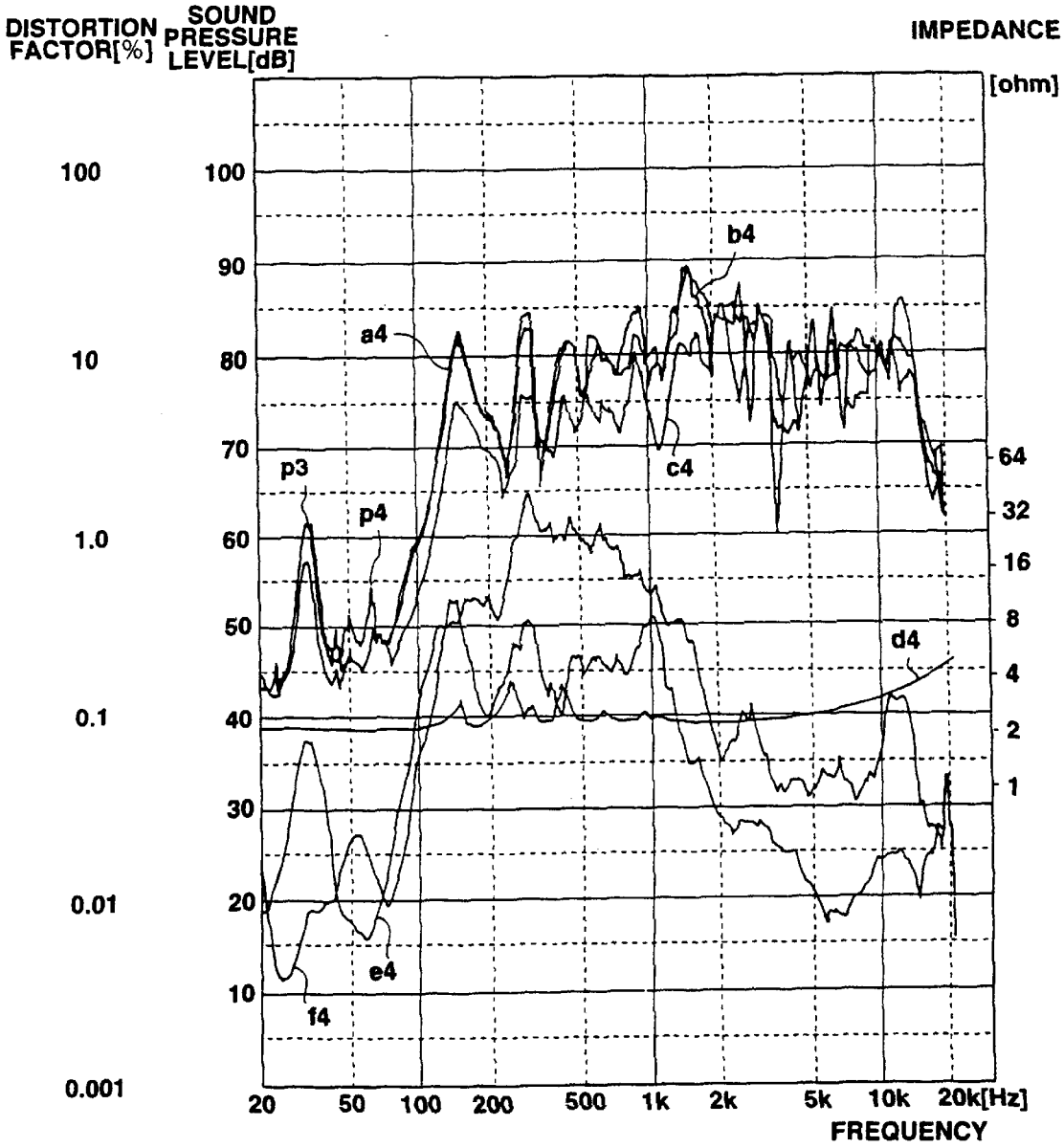
FIG. 29 is a graph showing frequency response characteristics when the driving units are driven using playback input signals supplied from a playback signal input unit shown in FIG. 28.

The response characteristics to the playback input signal of the speaker apparatus 35 having the playback signal inputting unit 72 constructed as shown in FIG. 28 were measured, and the characteristics shown in FIG. 29 were obtained. In FIG. 29 lines a4, b4 and c4 represent the measured values of the sound pressure level of the playback output at a front position with respect to the sound radiating surface 36*a* of the diaphragm 36, those at a 30° position with respect to the sound radiating surface 36*a* and those at a 60° position with respect to the sound radiating surface 36*a*, respectively. The line d4 represents the measure value of the impedance of the playback output of the speaker apparatus 35. Also, the lines e4 and f4 represent the measured value of the distortion due to the second harmonics of the playback output and the measured value of the distortion due to the third harmonics of the playback output, respectively.

In the speaker apparatus 35, constructed as shown in FIG. 28, large flexural oscillations are produced in the diaphragm 36 by the in-phase components of the playback input signal in the low frequency range being sent to the respective driver units 37*a*, 37*b*, 37*c* to produce larger flexural oscillations in the diaphragm 36. As may be seen from the graph of FIG. 29, there are generated peaks p3, p4 in a high sound pressure level in the low frequency range, as in the frequency characteristics of the speaker apparatus having a mass member attached to the diaphragm, thus improving low-range frequency characteristics.

In the speaker apparatus 35 of the present invention, reverse-phased playback input signals in the mid to high frequency range are sent to the driver units 37*a*, 37*b*, 37*c* to cause the frequency components of the oscillations applied from the driver units 37*a*, 37*b*, 37*c* to the diaphragm 36 to cancel one another to prevent the sound pressure level from being partially acute in the mid to high frequency range to realize flat frequency characteristics.

If the playback input signal opposite in phase from the playback input signal supplied to the driver units 37*a*, 37*c* is supplied to the center driving unit 37*b*, such that large flexural oscillations are produced in the diaphragm 36, the sound proper to the material of the diaphragm 36 is reproduced. The changeover switch units 75 to 77 are changed over to change the phases of the playback input signal to the driver units 37*a*, 37*b*, 37*c* to reproduce the sound proper to the material of the diaphragm 36 in a specified frequency range.

In the speaker apparatus 35, since the diaphragm 36, the outer rim of which is in a freely oscillatable state along the direction of thickness, is flexurally oscillated to produce the oscillation mode corresponding to the frequency of the playback input signal in the diaphragm 36, to reproduce the sound, dips or excess peaks are produced at a specified frequency, even if the diaphragm 36 is flexurally oscillated by the plural driver units 37*a*, 37*b*, 37*c*, as may be seen from the frequency response characteristics shown in FIG. 29.

Figure 30:
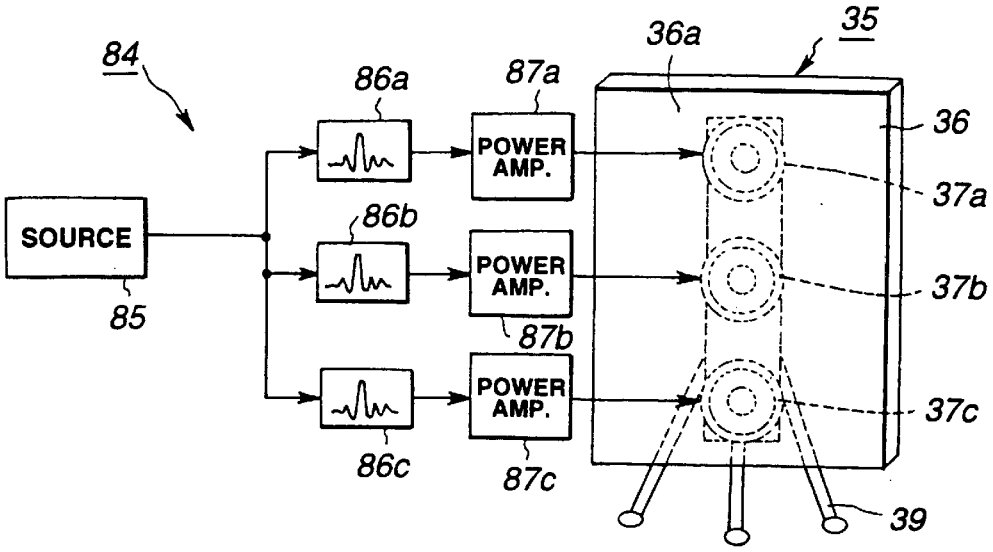
FIG. 30 is a circuit diagram showing a further example of a playback signal input unit provided in the speaker apparatus having three driving units.

For suppressing the dips or excess peaks for realizing flat sound pressure frequency characteristics from the low to high frequency ranges, there are provided filters 86*a*, 86*b*, 86*c* for suitably processing the playback input signals to the driver units 37*a*, 37*b*, 37*c*, as shown in FIG. 30. These filters 86*a* to 86*c* suitably process the playback input signals inputted to the driver units 37*a*, 37*b*, 37*c*. The playback input signals, processed by the filters 86*a* to 86*c,* are amplified by the amplifiers 87*a* to 87*c* before being inputted to the driver units 37*a* to 37*c*.

By providing the filters 86*a* to 86*c* in association with the driver units 37*a* to 37*c,* the reverse filter operation of the impulse response can be applied to the playback input signal to suppress dips or excess peaks to realize flat sound pressure frequency characteristics over a frequency range from the low to high frequency range. For the filters 86*a* to 86*c,* suitable digital or analog filters, performing not only the splitting of specified frequency bands for the playback input signal, but also the conversion of the amplitude or the phase of the playback input signal, can be used.

By according suitable delay components to the respective filter coefficients of the respective filters 86*a* to 86*c,* the oscillations accorded from the driver units 37*a,* 37*b,* 37*c* to the diaphragm 36 can be shifted to control the wavefront of the sound radiated from the diaphragm 36 to direct the main axis of the sound to other than the front side of the diaphragm 36 to control the directivity.

By according suitable amplitude components to the filter coefficients of the filters 86*a* to 86*c* associated with the respective driver units 37*a,* 37*b,* 37*c,* directivity can be accorded to the sound radiated from the diaphragm 36, as in the case of a speaker array. Thus, by flexurally oscillating the sole diaphragm 82 by the plural driver units 37*a,* 37*b,* 37*c,* respective directivities can be accorded to the plural input sound sources to enable directivity control of respective input sound sources.

Figure 31:
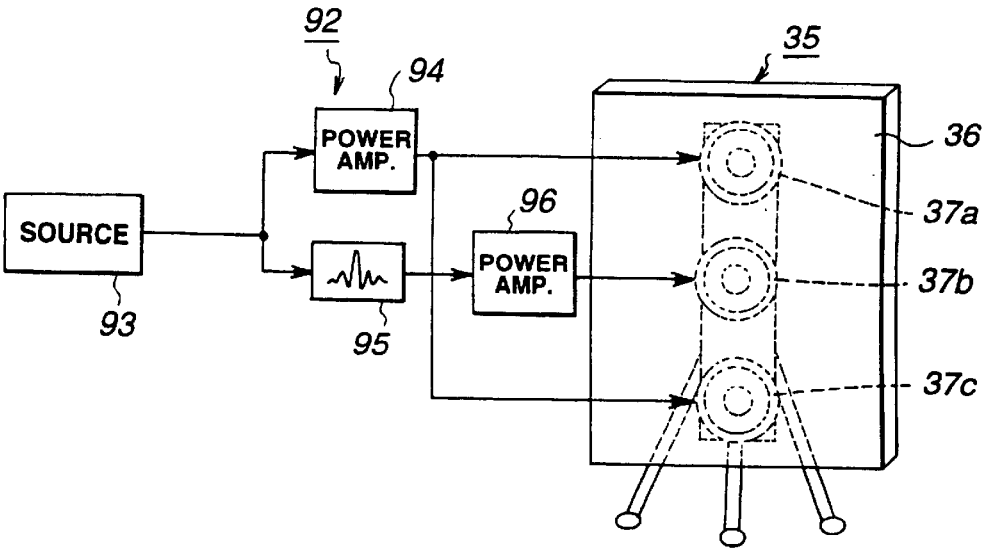
FIG. 31 is a circuit diagram showing a further example of the playback signal input unit provided in the speaker apparatus having three driving units.

For suppressing generation of the dips or excess peaks in the sound pressure level in a specified frequency, and for realizing flat sound pressure frequency characteristics from the low frequency range to the mid to high frequency range, a playback signal inputting unit 92 may be configured as shown in FIG. 31.

A playback signal inputting unit 92, shown in FIG. 31, includes a first amplifier 94 and a filter 95, fed with the playback input signal from a sound source 93, and a second amplifier 96 connected to the filter 95. Of the driver units 37*a,* 37*b,* 37*c,* adapted for driving the diaphragm 36, the first and third driver units 37*a,* 37*c,* arranged at an upper position and at a lower position in FIG. 31, are directly fed with the playback input signal from the sound source 93 via the first amplifier 94, while the centrally arranged second striver unit 37*b* is fed with the playback input signal processed in a pre-set fashion by the filter 95.

By the playback input signal supplied to the centrally arranged second driver unit 91*b* differing in phase from the playback input signal supplied to the first and third driver units 91*a,* 91*c,* it is possible to suppress the dips or excess peaks otherwise produced in the sound pressure level at a specified frequency to realize flat sound pressure frequency characteristics from the low frequency range to the high frequency range.

Also, in the speaker apparatus according to the present invention, in which oscillations are applied to the sole panel-shaped diaphragm from plural driver units to cause it to perform flexural oscillations to reproduce the sound, the plural driver units are arranged adjacent to one another and playback input signals of different phases are supplied to the respective driver units, the node of the oscillations can be compulsorily produced at mid portions of the driving units irrespective of the material types of the diaphragm. In the present speaker apparatus, it is possible to adjust the sensitivity in each frequency range, improve the characteristics of the playback frequency and to adjust the sound field or sound quality by positively generating the nodes of the oscillations in the diaphragm.

With the speaker apparatus according to the present invention, more than three driver units may be provided and fed with different playback input signals form plural sound sources for driving the driver units.

Figure 32:
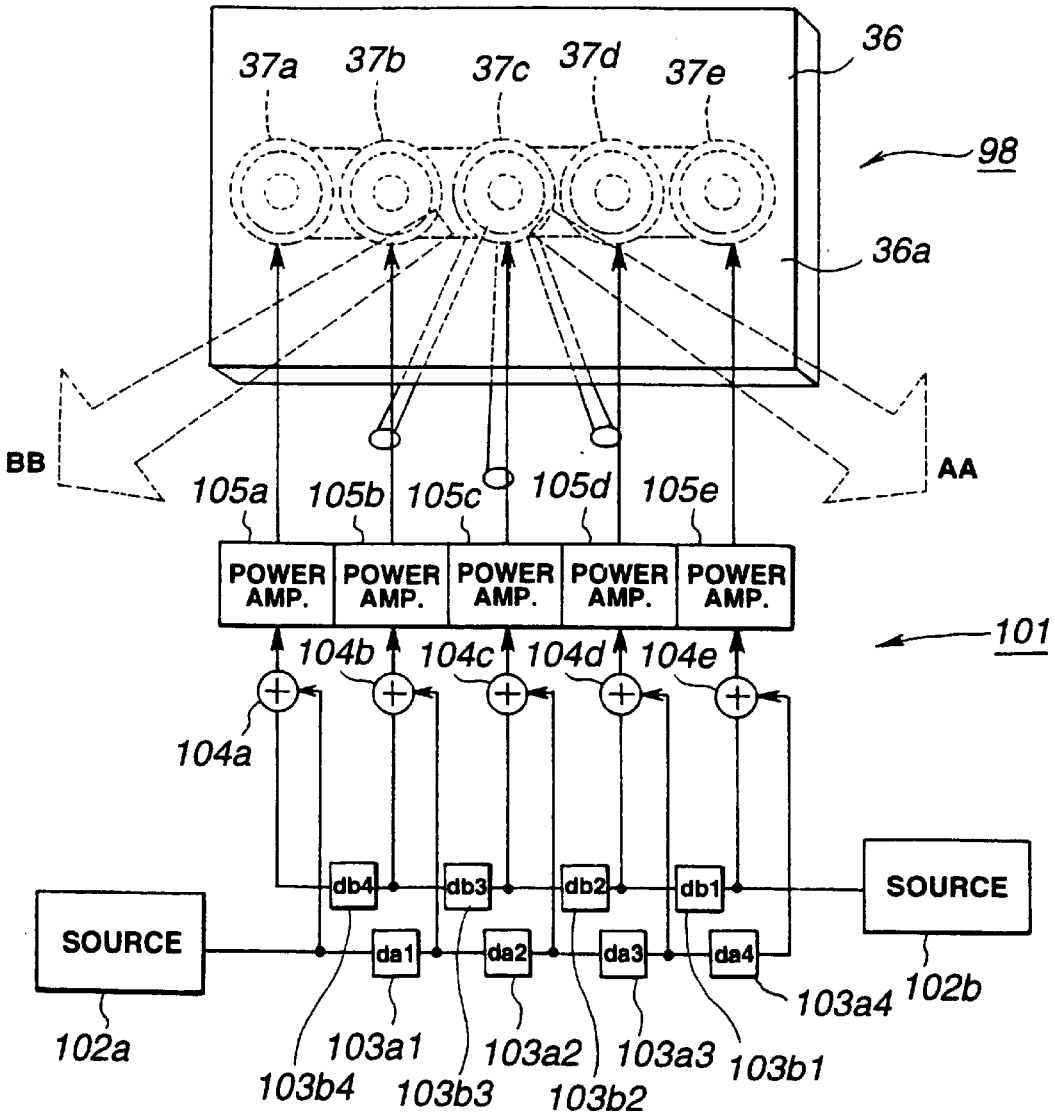
FIG. 32 is a circuit diagram showing a playback signal input unit adapted for supplying playback input signal to a speaker apparatus having five driving units.

A speaker apparatus adapted to be driven by the playback input signals from these plural sound sources is configured as shown in FIG. 32.

The speaker apparatus 98, shown in FIG. 32, is configured for driving a sole panel-shaped diaphragm 36 by five driver units 37*a* to 37*e*. These driver units 37*a* to 37*e* are arranged in a row along the longitudinal direction at a width-wise center of the diaphragm 36, and the diaphragm 36 is connected to the ends of the respective voice coil bobbins 8, as shown in FIG. 32.

A playback signal inputting unit 101, adapted for supplying a playback input signal to the speaker apparatus 98, includes a first sound source 102*a* and a second sound source 102*b,* such as a disc player or a tape recorder, as shown in FIG. 32. To the first and second sound sources 102*a,* 102*b* are connected delay component supplying circuits 103*a*1 to 103*a*4 and delay component supplying circuits 103*b*1 to 103*b*4 for according sequentially increasing delay components da1, da2, da3 and da4 and delay components db1, db2, db3 and db4 to the playback input signals supplied from the respective sound sources 102*a* and 102*b*. The playback signal inputting unit 101 also includes first to fifth mixers 104*a* to 104*e* for mixing playback input signals from the delay component supplying circuits 103*a*1 to 103*a*4 and the delay component supplying circuits 103*b*1 to 103*b*4, afforded with the delay components da1, da2, da3 and da4 and with the delay components db1, db2, db3 and db4, respectively, and first to fifth amplifiers 105*a* to 105*e* for amplifying the playback input signals mixed with the delay components by the mixers 104*a* to 104*e* for supplying the amplified signals to the first to fifth driver units 37*a* to 37*e*.

The first mixer 104*a,* constituting the playback signal inputting unit 101, mixes the playback input signal from the first sound source 102*a* with the playback input signal from the second sound source 102*b* afforded with the largest delay component db4. The second mixer 104*b* mixes the playback input signal from the first sound source 102*a* afforded with the delay component da1 with the playback input signal from the second sound source 102*b* afforded with the delay component db3. The third mixer 104*b* mixes the playback input signal from the first sound source 102*a* afforded with the delay component da2 with the playback input signal from the second sound source 102*b* afforded with the delay component db2. The second mixer 104*b* mixes the playback input signal from the first sound source 102*a* afforded with the delay component da3 with the playback input signal from the second sound source 102*b* afforded with the delay component db1. The second mixer 104*b* mixes the playback input signal from the first sound source 102*a* afforded with the delay component da4 with the playback input signal from the second sound source 102*b*.

In the speaker apparatus 98, shown in FIG. 32, in which the playback input signals supplied from the first sound source 102*a* and from the second sound source 102*b,* are sent to the first to fifth driver units 37*a* to 37*e,* as the weighting for the relay components is changed by the delay component supplying circuits 103*a*1 to 103*a*4 and the delay component supplying circuits 103*b*1 to 103*b*4. Thus, the first to fifth driver units 37*a* to 37*e* are sequentially driven with delays corresponding to the delay components d based on the playback input signals sent from the first sound source 102*a* and from the second sound source 102*b*.

Since the first to fifth driver units 37*a* to 37*e* are driven by the playback input signals supplied from the first sound source 102*a* and from the second sound source 102*b* and which are afforded with sequentially changing delay components, the first to fifth driver units 37*a* to 37*e* can be sequentially driven from the first driving unit 37*a* to the fifth driving unit 37*e* by the playback input signals supplied from the first sound source 102*a,* while the first to fifth driver units can be sequentially driven from the fifth driving unit 37*e* to the first driving unit 37*a* by the playback input signals supplied from the second sound source 102*b.* Thus, the playback sound derived from the playback input signal supplied from the first sound source 102*a* can be radiated in a direction shown by arrow AA or towards right of the diaphragm 36 in FIG. 32, while the playback sound derived from the playback input signal supplied from the second sound source 102*b* can be radiated in a direction shown by arrow BB or towards left of the diaphragm 36 in FIG. 32. By changing the directivity of the sound derived from the playback input signal supplied from the two sound sources 102*a,* 102*b* in this manner, the playback input signals sent from the two sound sources 102*a,* 102*b* can be reproduced simultaneously by the sole speaker apparatus 98, thus assuring optimum stereo reproduction with different fixed sound image position feeling.

Figure 33:
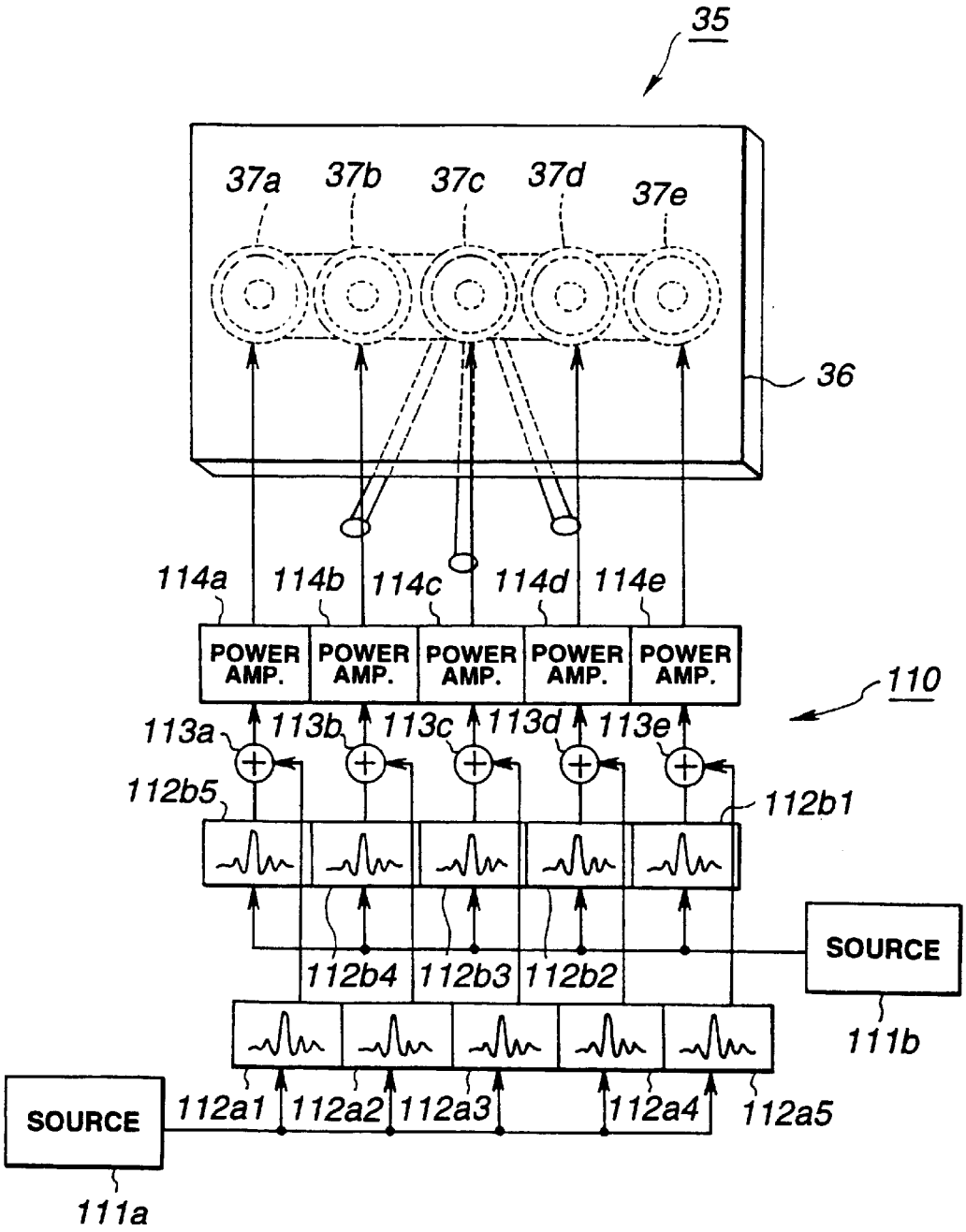
FIG. 33 is a circuit diagram showing another playback signal input unit adapted for supplying playback input signal to a speaker apparatus having five driving units.

For providing different directivities of the playback sound derived from the playback input signal supplied from the two sound sources, the playback signal imputting unit can be configured as shown in FIG. 33.

The playback signal inputting unit 110 shown in FIG. 33 includes first to fifth filters 112*a*1 to 112*a*5 for filtering the playback input signal supplied from a first sound source 111*a,* and first to fifth filters 112*b*1 to 112*b*5 for filtering the playback input signal supplied from a second sound source 111*b.* The playback signal inputting unit 110 also includes first to fifth mixers 113*a* to 113*e* for mixing the playback input signal supplied from the first sound source 111*a* via the first to fifth filters 112*a*1 to 112*a*5 and the playback input signal supplied from the second sound source 111*b* and first to fifth amplifiers 114*a* to 114*e* for supplying the signals mixed in the mixers 113*a* to 113*e* to the first to fifth driver units 37*a* to 37*e.*

The first mixer 113*a* is fed with the playback input signal supplied from the first sound source 111*a* and filtered by the first filter 112*a*1 and the playback input signal supplied from the second sound source 111*b* and filtered by the fifth filter 112*b*5, these signals being sent after channel synthesis to the first amplifier 114*a.* The second mixer 113*b* is fed with the playback input signal supplied from the first sound source 111*a* and filtered by the second filter 112*a*2 and the playback input signal supplied from the second sound source 111*b* and filtered by the fourth filter 112*b*4, these signals being sent after channel synthesis to the second amplifier 114*b.* The third mixer 113*c* is fed with the playback input signal supplied from the first sound source 111*a* and filtered by the third filter 112*a*3 and the playback input signal supplied from the second sound source 111*b* and filtered by the third filter 112*b*3, these signals being sent after channel synthesis to the third amplifier 114*c.* The fourth mixer 113*d* is fed with the playback input signal supplied from the first sound source 111*a* and filtered by the fourth filter 112*a*4 and the playback input signal supplied from the second sound source 111*b* and filtered by the second filter 112*b*2, these signals being sent after channel synthesis to the fourth amplifier 114*d.* The fifth mixer 113*e* is fed with the playback input signal supplied from the first sound source 111*a* and filtered by the fifth filter 112*a*5 and the playback input signal supplied from the second sound source 111*b* and filtered by the first filter 112*b*1; these signals being sent after channel synthesis to the fifth amplifier 114*e.*

The first to fifth filters 112*a*1 to 112*a*5 for filtering the playback input signal supplied from the first sound source 111*a* and the first to fifth filters 112*b*1 to 112*b*5 for filtering the playback input signal supplied from the second sound source 111*b* are those having filter coefficients for selecting pre-set frequency ranges for the input playback input signal and for performing signal processing with an optional phase or amplitude. If the first to fifth filters 112*a*1 to 112*a*5 and 112*b*1 to 112*b*5 are selected so as to have suitable characteristics, it is possible to change the directivity of the playback sound derived from the playback input signal supplied from the first and second sound sources 111*a,* 111*b.*

By changing the filter characteristics of the first to fifth filters 112*a*1 to 112*a*5 and 112*b*1 to 112*b*5, adapted for filtering the playback input signal supplied from the first sound source 111*a* and the second sound source 111*b,* it becomes possible to generate oscillating modes having a number of nodes and anti-nodes that are produced in the diaphragm 36. The sites of the anti-nodes of the oscillation mode can be deemed to be the sound radiating source to enable reproduction of the sound having reverse directivity.

The first to fifth filters 112*a*1 to 112*a*5 for filtering the playback input signal supplied from the first sound source 111*a* and the first to fifth filters 112*b*1 to 112*b*5 for filtering the playback input signal supplied from the second sound source 111*b* may be provided with a controller for chronologically controlling the filter coefficients to change the directivity characteristics. By using this configuration, it is possible with the present speaker apparatus 35 to produce special acoustic effects, such as rotation or movement of the sound radiating axis, without using special mechanical measures.

The speaker apparatus according to the present invention may be provided with an optional number of driving units depending on the size or shape of the panel-shaped diaphragm.

The driver unit, adapted for causing flexural oscillations of the diaphragm, may also be of a piezoelectric type, in addition to being of a dynamic type.

The speaker apparatus according to the present invention is provided with a panel-shaped diaphragm that can be flexurally oscillated by oscillations applied from the driver unit, so that, if the speaker apparatus is enclosed in a housing, the housing can be reduced in thickness. Thus, if the present speaker apparatus is used for a teleconferencing system or a telephone system, the sound generating device can be reduced in thickness, so that the sound generating device can be placed without special limitations as to mounting sites.

Figure 34:
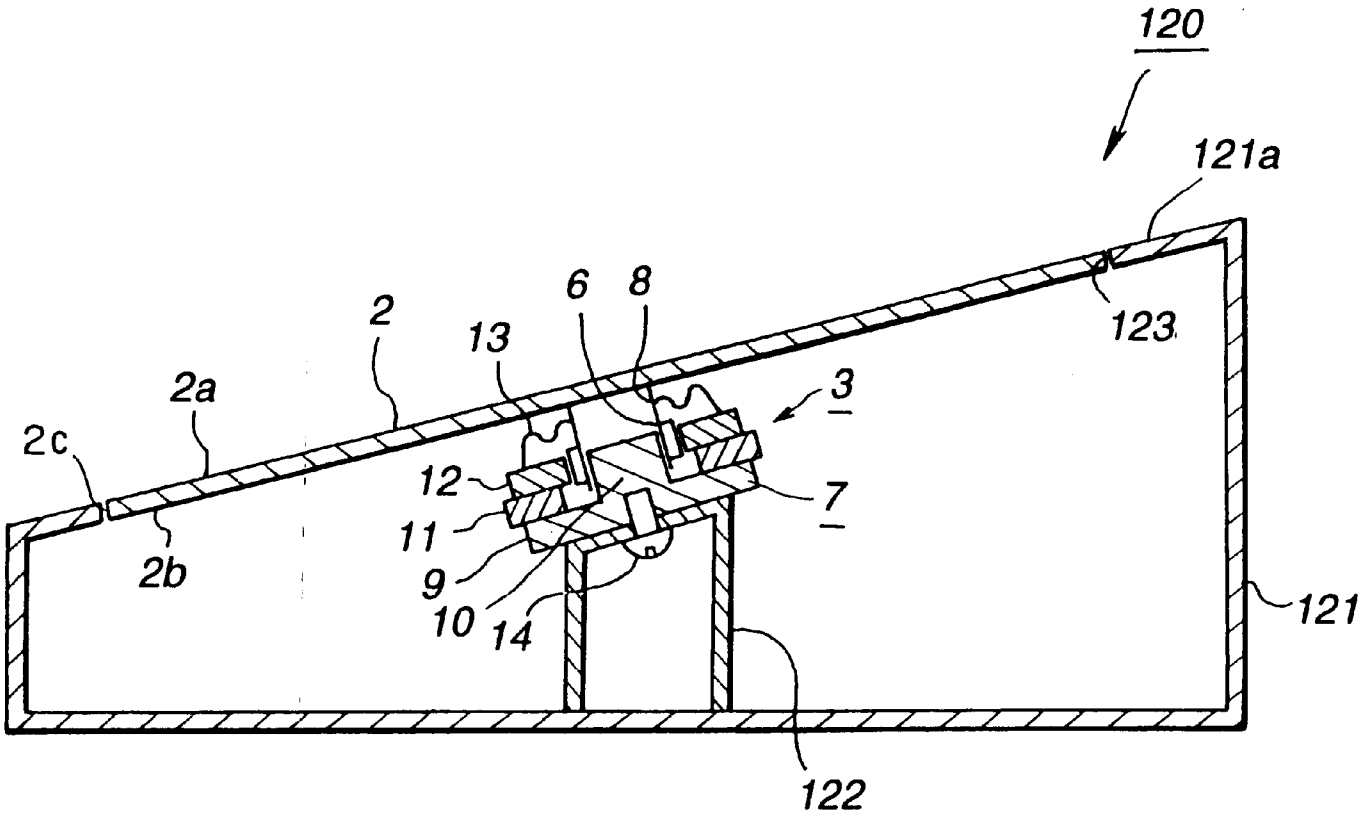
FIG. 34 is a longitudinal cross-sectional view showing an example of constructing a sound producing device comprised of a speaker apparatus of the present invention and which is used in a teleconferencing system.

FIG. 34 shows an embodiment in which the speaker apparatus 1 shown in FIGS. 1 to 3, configured so that the panel-shaped diaphragm 2 is flexurally oscillated by a sole driver unit 3, is used as a sound generating device 120 used in the teleconferencing system.

This sound generating device 120 has a casing 121 within which is enclosed the speaker apparatus 1 configured as shown in FIGS. 1 to 3. The casing 121, having the speaker apparatus 1 enclosed therein, has an opening 123 for mounting the diaphragm 2 in the top plate 121*a.* This opening 123 is sized to be slightly larger than the outer size of the diaphragm 2 to expose the sound radiating surface 2*a* of the digital filter 2 to outside.

Referring to FIG. 34, the speaker apparatus 1 has a supporting base block 122 provided in the casing 121. On this supporting base block 122 is secured a yoke 7 of the magnetic circuit unit 7 by a set screw 14. The diaphragm 2 is assembled into the casing 120 so that the diaphragm 2 is substantially flush with the top plate 121*a* of the casing 121. At this time, the diaphragm 2 is arranged so as not to collide against the inner peripheral surface of the opening 123 to permit free oscillation along the direction of thickness of the outer rim 2*c*. Since the panel-shaped diaphragm 2 constitutes a portion of the tip plate 121*a*, the diaphragm 2 is preferably formed of a material having substantially the same appearance as the top plate 121*a*.

Since the speaker apparatus of the present invention has the panel-shaped diaphragm 2 designed to constitute a portion of the casing of the sound generating device, it is possible to constitute the sound generating device with a further reduced casing thickness.

In the above-described speaker apparatus, the mid portions of the diaphragm is connected to the voice coil bobbin of the driver unit, or the mid portion along the width of the diaphragm is connected to the width-wise center of the diaphragm, in order to permit the entire outer rim of the panel-shaped diaphragm to be oscillated freely along its diaphragm. That is, although the diaphragm is supported only via the voice coil bobbin of the driver unit, it may also be supported with a portion of its outer rim fixedly supported by a supporting member to improve diaphragm supporting strength.

An embodiment in which the diaphragm is connected to the voice coil bobbin of the driver unit to connect a portion of the outer rim to the supporting member is explained.

Figure 35:
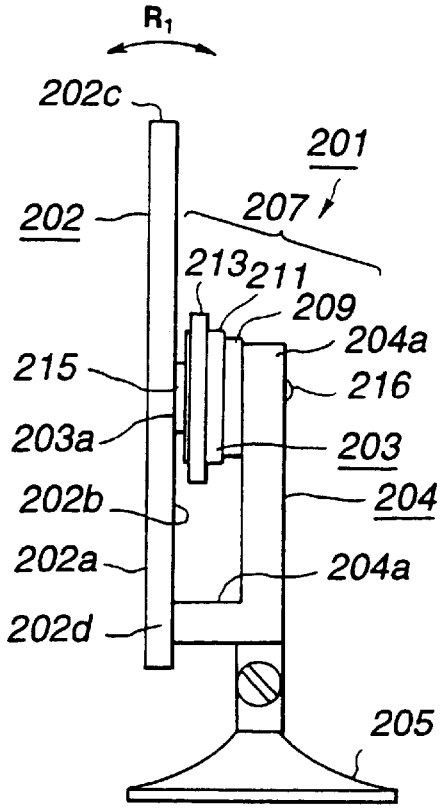
FIG. 35 is a side view showing a speaker device of the present invention in which a portion of the outer edge of a diaphragm is supported fixedly.
Figure 36:
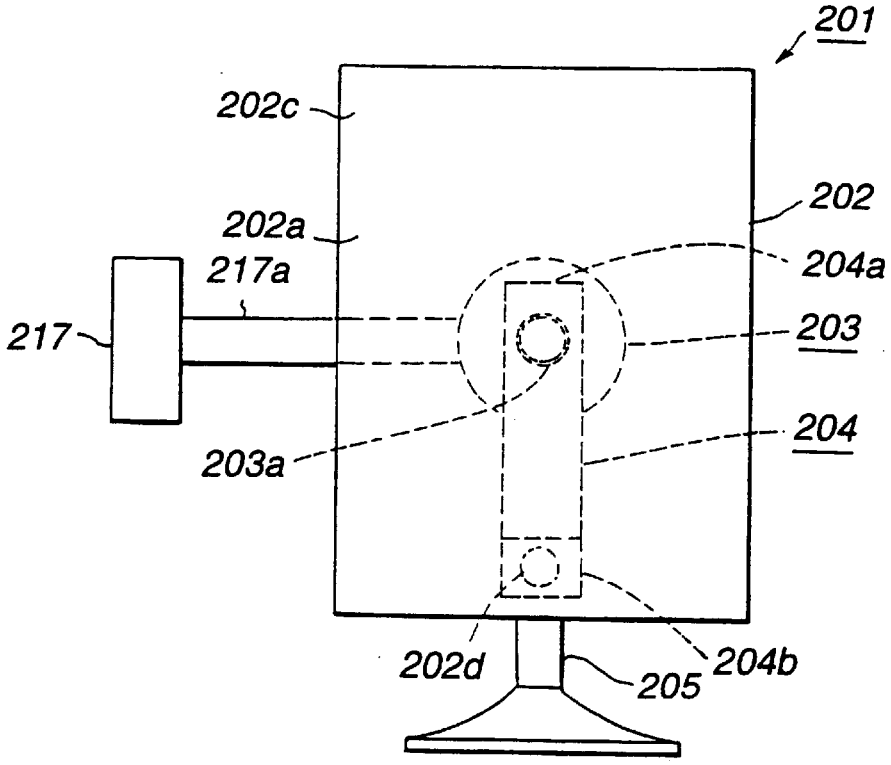
FIG. 36 is a front view of a speaker apparatus shown in FIG. 35.

A speaker apparatus 201, in which a portion of an outer rim 202*c* of the diaphragm 202 is supported fixedly, is configured as shown in FIGS. 35 and 36.

Similarly to the above-described respective speaker apparatus, the speaker apparatus 201 includes a rectangular panel-shaped diaphragm 202, having substantially flat opposing surfaces, and a driving unit 203 for flexurally oscillating the diaphragm 202. The diaphragm 202 is formed of a material having toughness which is more by itself and an attenuation factor small enough to permit propagation of the oscillation applied from the driving unit 203 adapted to flexurally oscillate the diaphragm 202 to respective portions of the diaphragm 202. The diaphragm 202 is formed of styrene resin and is of a rectangular shape 25.7 cm by 36,4 cm, with a thickness being 2 mm.

The diaphragm 202 has its one surface as a sound radiating surface 202*a* and its other surface as a driving surface 202*b*. The diaphragm 202 has the driving unit 203 mounted on its driving surface 202*b*.

Referring to FIGS. 35 and 36, the driving unit 203, carrying the diaphragm 202, is mounted on the distal end of a driving unit mounting portion 204*a* provided on a substantially L-shaped supporting member 204 rotationally supported by a supporting leg 205. The diaphragm 202, supported by the driving unit 203, has its lower mid portion secured to a diaphragm supporting portion 204*b* protruded from the proximal end of the driving unit mounting portion 204*a*. The diaphragm 202, thus connected to and supported by the driving unit 203 and the diaphragm supporting portion 204*b*, is in such a state in which an outer rim 202*c* other than the diaphragm supporting portion 204*b* can be oscillated freely in the direction of thickness.

It is sufficient if the diaphragm 202 is formed of a material having toughness which is more than is sufficient to enable the diaphragm 202 to operate as a diaphragm independently and an attenuation factor small enough to permit propagation of the oscillation applied from the driving unit 203 adapted to flexurally oscillate the diaphragm 202 to respective portions of the diaphragm 202. Thus, the diaphragm 202 may be formed of a variety of honeycomb plates or balsam materials.

Figure 37:
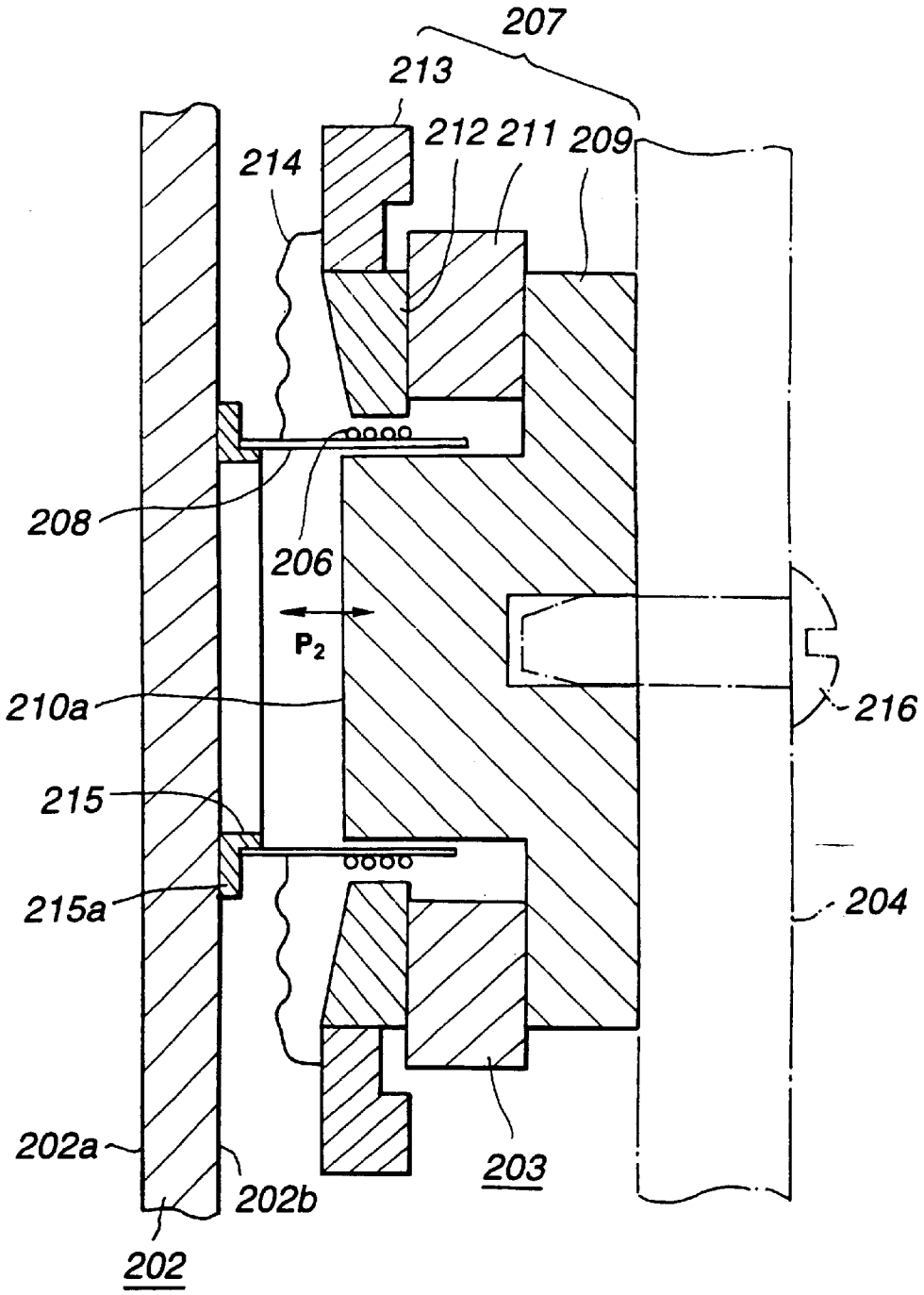
FIG. 37 is a schematic longitudinal cross-sectional view showing a driver unit of the speaker apparatus shown in FIG. 35.

The driving unit 203 adapted for flexurally oscillating the diaphragm 202 is configured similarly to that used for a conventional dynamic speaker. The driving unit 203 includes a voice coil 206 placed around the outer peripheral surface of the proximal end of a cylindrically-shaped voice coil bobbin 208 and an outer magnet type magnetic circuit unit 207, as shown in FIG. 37. The magnetic circuit unit 207 includes a yoke 209, having a center pole 210, a ring-shaped magnet 211 provided on the yoke 209 for encircling the center pole 210, a top plate 212 arranged on the magnet 211 for defining a magnetic gap between it and the center pole 210, and an auxiliary ring 213 fitted on the outer rim side of the top plate 212, as shown in FIG. 37. The voice coil bobbin 208 is arranged with the voice coil 206 inserted into the magnetic gap of the magnetic circuit unit 207 and is supported on the magnetic circuit unit 7 via a ring-shaped damper 214. The voice coil bobbin 208 is supported for performing a piston movement, in the direction indicated by arrow $P_2$ in FIG. 37, parallel to the center axis, by the inner rim side of the damper 214, having the outer rim side secured to the top plate 212 of the magnetic circuit unit 7, being connected to the outer rim of the voice coil bobbin 208.

The driving unit 203 is mounted with a set screw 216 to a distal end 204*a* of the supporting member 204 with a set screw 216. The supporting member 204 has the mid portion of the yoke 209 secured to a supporting leg 205.

The driving unit 203 is designed with the outer diameter of the auxiliary ring 213, as the maximum diameter portion, equal to approximately 35 mm, and with the height from the bottom of the yoke 209 to a connecting member 215 being approximately equal to 20 mm.

The diaphragm 202 is connected to the voice coil bobbin 208 of the driving unit 203 via the connecting member 215 attached to the distal end of the voice coil bobbin 208. The diaphragm 215 for connecting the diaphragm 202 to the voice coil bobbin 208 is formed as a ring having an outer diameter approximately equal to the inner diameter of the voice coil bobbin 208, as shown in FIG. 37. The connecting member 215 has its proximal end fitted in the distal end of the voice coil bobbin 208. The diaphragm 202 is connected tot the voice coil bobbin 208 by having its driving surface 202*b* connected to a flange 215*a* formed at the distal end of the connecting member 215.

The supporting member 204, carrying the driving unit 203, and fixedly supporting an end of the outer rim 202*c* of the diaphragm 202, carries the diaphragm 202 for rotation in the direction indicated by arrow R1 in FIG. 35 via a hinge unit, not shown. That is, the sound radiating surface 202*a* of the diaphragm 202 can be changed in its orientation in the up-and-down direction.

The diaphragm 202 can be adjusted in its orientation not only in the up-and-down direction but also in the left-and-right direction of the diaphragm 202 by the supporting member 204 being supported on the supporting leg 205 via e.g., a universal joint.

The supporting member 204, currying the lower mid portion of the outer rim 202*c* of the diaphragm 202 and the driving unit 203, is substantially L-shaped, by having a driver unit mounting portion 204*a* and a diaphragm supporting portion 204*b* protruded from the proximal end of the driver unit mounting portion 204*a*, as shown in FIGS. 35 and 36. The diaphragm supporting portion 204*b* has its length approximately equal to the height of the driving unit 203 and has its distal end secured to the lower mid portion of the diaphragm 202.

The outer rim 202*c* of the diaphragm 202, having its mid portion supported by the distal end of the voice coil bobbin 208 of the supporting member 204 and having the lower mid portion supported by the diaphragm supporting portion 204*b*, can be oscillated freely in a direction along the thickness except a portion 202*d* connected to the diaphragm supporting portion 204*b*.

If, with the above-described speaker apparatus 201, the playback input signal is supplied from the sound source 217 via input line 217*a* to the voice coil 206 of the driving unit 203, the voice coil bobbin 208 performs piston movement in the direction indicated by arrow $P_2$ in FIG. 37 under the action of the playback input signal supplied to the voice coil 206 and the magnetic field from the magnetic circuit unit 207. The oscillations corresponding to the piston movement of the voice coil bobbin 208 is imparted to the diaphragm 202 which then is flexurally oscillated about a first connecting portion 203*a* as a driving point to radiate the sound of a frequency corresponding to the playback input signal towards the sound radiating surface 202*a*. The first connecting portion 203*a* is a connecting portion of the diaphragm 202 to the connecting member 215 mounted on the distal end of the voice coil bobbin 208.

Figure 38:
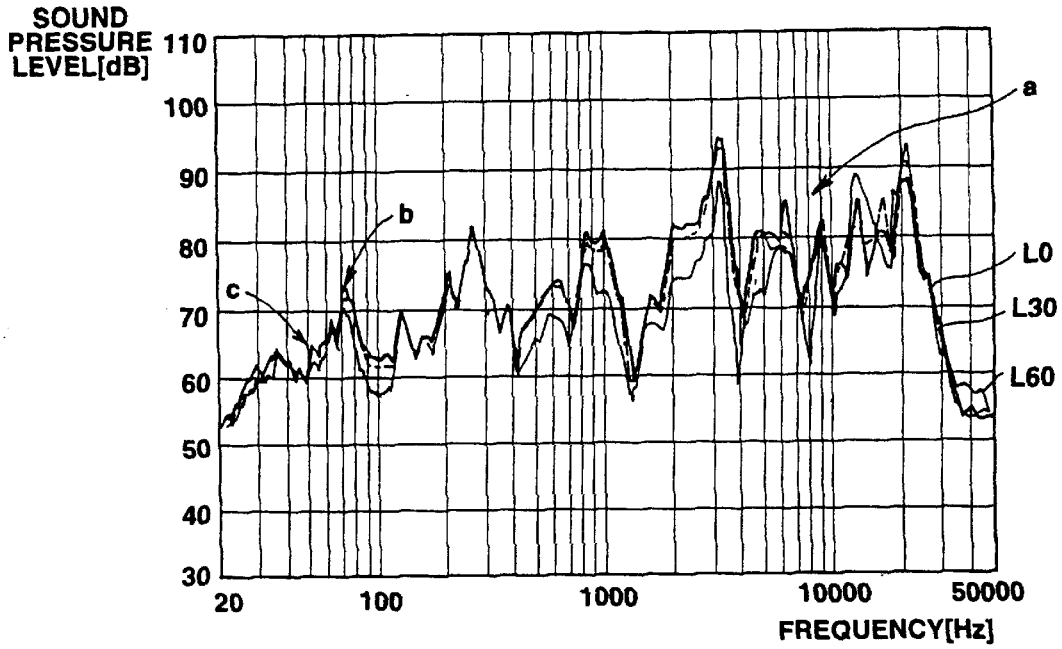
FIG. 38 is a graph showing frequency response characteristics of a speaker apparatus in which a portion of the outer edge of a diaphragm is supported fixedly.

The frequency response characteristics of the speaker apparatus 201 to the playback input signal are as shown in FIG. 38, in which the abscissa and the ordinate represent the frequency f (Hz) of the playback input signal and the output sound pressure level of the frequency response characteristics as measured for this frequency f, respectively. In FIG. 38, lines L0, L30 and L60 depict the frequency response characteristics at the front position to the diaphragm 202, at a 30° position to the diaphragm 202 and at a 60° position to the diaphragm 202, respectively.

FIG. 38 shows frequency response characteristics of a speaker apparatus the entire periphery of the outer rim 202*c* of which can be freely oscillated in the direction along the thickness without a portion of the outer rim 202*c* of the diaphragm 202 being connected to the diaphragm supporting portion 204*b*. In FIG. 38, lines LL0, LL30 and LL60 depict frequency response characteristics at the front position to the diaphragm 202, at a 30° position to the diaphragm 202 and at a 60° position to the diaphragm 202, respectively.

Figure 39:
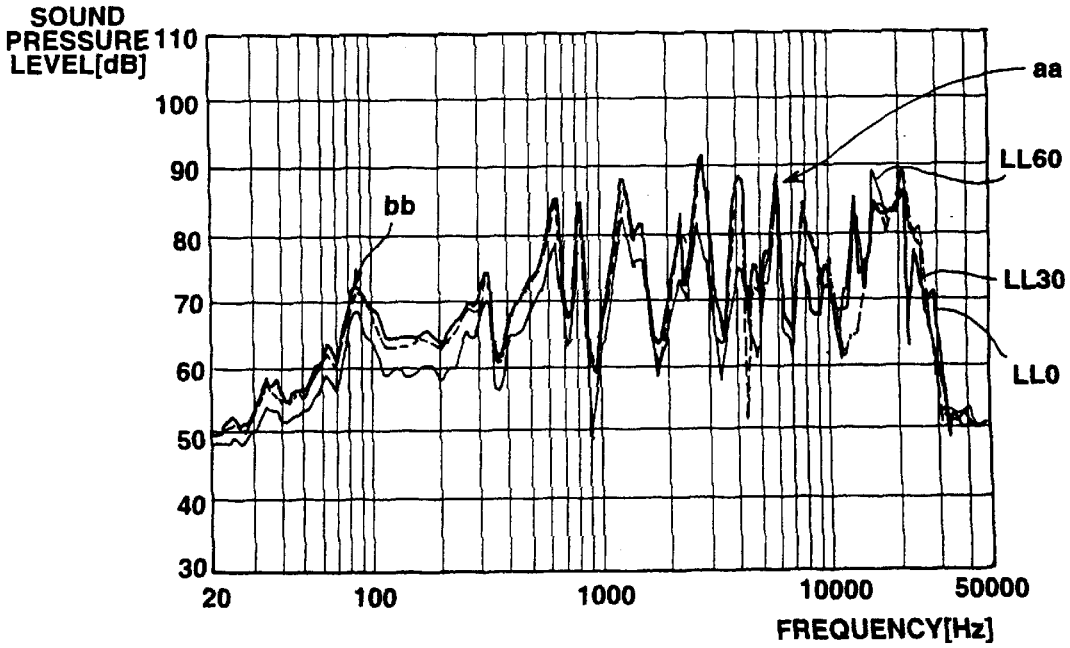
FIG. 39 is a graph showing the frequency response characteristics of a speaker apparatus according to the present invention in which the entire periphery of the outer rim of the diaphragm can be oscillated freely along the thickness direction.

As may be seen from the diagram of the frequency response characteristics of the speaker apparatus, the entire outer periphery of which can be freely oscillated along the direction of thickness, shown in FIG. 38, the sound pressure level is fluctuated significantly in a frequency range aa less than 1000 Hz, while the peak of the sound pressure level is measured at a frequency range bb on the order of 100 Hz. However, on the whole, the high frequency response characteristics are obtained in the mid to high frequency range. Conversely, with the speaker apparatus 201, a portion of the outer rim 202*c* of the diaphragm 202 of which is fixed, the sound pressure level is prevented from being varied significantly in a frequency range a not less than 1000 Hz, a sound pressure peak in the low frequency range bing observed in a frequency range lower than 100 Hz, as shown at b in FIG. 38, with the frequency response characteristics in the frequency range as a low as 50 Hz being improved on the whole, as may be seen from FIG. 39.

In the speaker apparatus 201, a portion of the outer rim 202*c* of the diaphragm 202 of which is fixed, the portion of the diaphragm 202 other than its portion 202*d* on its outer rim 202*c* connected to the diaphragm supporting portion 204*b* can be oscillated freely, so that the portion of the diaphragm 202 other than the connecting portion 202*d* to the diaphragm supporting portion 204*b* is flexurally oscillated with a large amplitude. Since the portion of the diaphragm 202 other than its fixed outer rim portion is flexurally oscillated in the direction along the thickness with a large amplitude, the speaker apparatus 201, employing this structure of the diaphragm 202, is improved in frequency response characteristics in the lower frequency range, as will be apparent from the diagram of the frequency response characteristics shown in FIG. 38. Also, since it is possible to suppress sound pressure level fluctuations in the mid to high frequency range, the playback frequency range can be enhanced, while the high quality playback sound can be produced which is free from sound pressure level fluctuation form the mid to frequency range.

With the speaker apparatus 201, a portion of the outer rim 202*c* of the diaphragm 202 of which is fixed, the frequency response characteristics can be improved not only on the front side of the diaphragm 202 but also in a direction of a pre-set angle with respect to the front side of the diaphragm 202, as may be seen from FIG. 38. That is, the frequency response characteristics for the low frequency range are improved in respective direction with respect to the diaphragm 202, such that the sound of the optimum sound quality can be radiated over a wide range.

With the speaker apparatus 201, a portion of the outer rim 202*c* of the diaphragm 202 of which is fixed, the rid portion of the diaphragm 202 is supported by the connecting member 215, while a portion of the outer rim 202*c* of the diaphragm 202 is supported by the diaphragm supporting portion 204*b*, the diaphragm 202 is improved in mechanical strength, while optimum frequency response characteristics are realized. That is, since the load of the diaphragm 202 is distributed into two points, that is to the connecting portion 203*a* to the driving unit 203 and the connecting portion 202*d* to the diaphragm supporting portion 204*b*, the diaphragm 202 is improved in connection strength to the diaphragm 202. Moreover, since the diaphragm 202 is supported at the two points, it is possible to suppress occurrence of the resonant mode of the diaphragm 202 to reproduce the sound of optimum sound quality.

With the above-described speaker apparatus 201, a mass member formed of a material liable to absorb oscillations, for example, a tape-shaped member formed of lead, may be provided on the diaphragm 202. This mass member is bonded to the entire periphery of the outer rim 202*c* on the sound radiating surface 202*a* of the diaphragm 202. Although it is possible to exclude the connecting portion 202*d* to the diaphragm supporting portion 204*b*, it is preferred to affix the mass member to the remaining portion of the outer rim 202*c*. By providing a mass member further in the outer rim 202*c* of the diaphragm 202, the resonant mode can be prevented from occurring in the outer rim for further improving the frequency response characteristics in the lower frequency range.

If the diaphragm 220 is of an increased size, oscillations may be imparted from plural driving units 203. If plural driving units 203 are used, it is possible to control the on/off switching of the playback input signal to the respective driving units 203, to control the phase of the playback input signal to the driving units 203 or to adjust the level of the playback input signal to the respective driving units 203. By varying the phase components of the playback input signal to the respective driving units 203 and by adjusting the signal level, the diaphragm 202 can be flexurally oscillated independently by the respective driving units 203 to freely change the sound field ort the sound quality of the acoustic sound radiated from the sole diaphragm 202.

With the speaker apparatus 201 having the plural driving units 203, the playback input signal can be split by a band-pass filter into plural frequency ranges, adjusted in phase, synthesized and subsequently routed to the driving units 203 to cause flexural oscillations of the diaphragm 202. With the present speaker apparatus 01, in which the in-phase components of the playback input signal are inputted to the respective driving units 203 and the reverse-phased components of the playback input signal are inputted in the mid to high frequency ranges, the minimum resonant frequencies can be diminished further as in the casse of affixing the mass member to the diaphragm 202, thus further improving the frequency response characterstics in the lower frequency range.

With the speaker apparatus according to the present invention, a piezoelectric type driving unit may be used.

Figure 40:
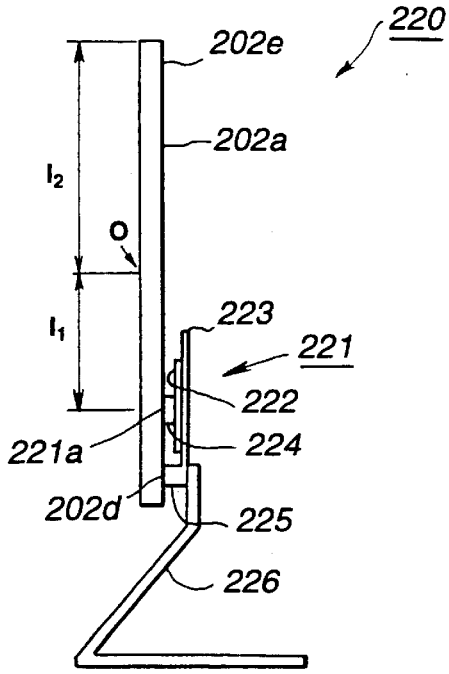
FIG. 40 is a side view showing another example of a speaker apparatus of the present invention in which a portion of the outer edge of a diaphragm is supported fixedly.
Figure 41:
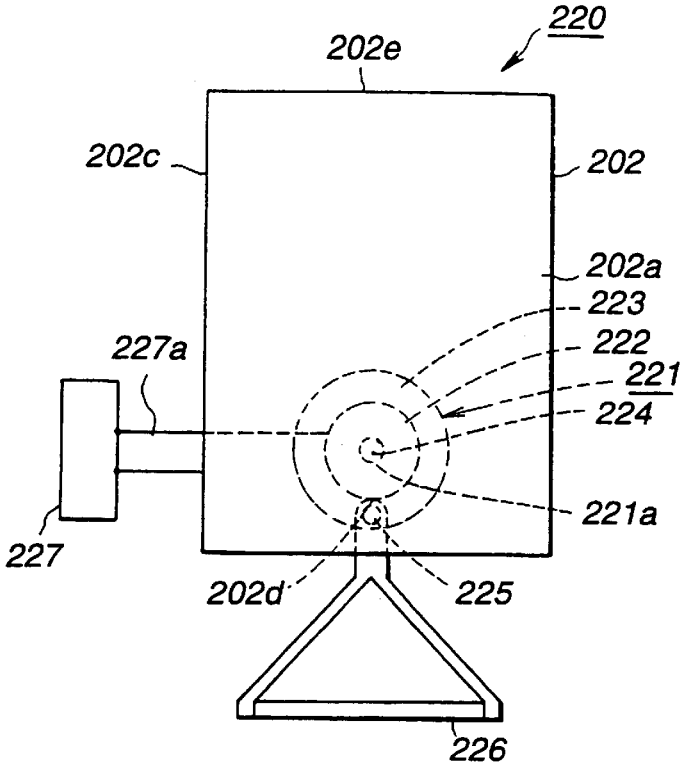
FIG. 41 is a front view of a speaker apparatus shown in FIG. 40.

A speaker apparatus 220 according to the present invention, employing a piezoelectric driving unit 221, is provided with a panel-shaped diaphragm 202 similar to one used in the above-described speaker apparatus 202, as shown in FIGS. 40 and 41.

In the piezoelectric driving unit 221 for setting the diaphragm 202 into flexural oscillations, a diaphragm 202 is affixed in position via a tubular connection member 224 mounted on an oscillating surface of a high-molecular piezoelectric member 222, as shown in FIG. 40. The driving unit 221 is mounted on a stand member 226 at the lower end of a base plate 223. On this stand member 226, currying the driver unit 221, a diaphragm connecting member 225 is protuberantly mounted on its major surface facing the driving surface 202*b* of the diaphragm 202 on the lower end of the diaphragm 202, with the distal end of the connecting member 225 being abutted against the driving surface 202*b* of the diaphragm 202. The driver unit 221*a* affords the flexural oscillations to the diaphragm 202 via the connecting member 225 which supports a portion of the outer rim 202*c* of the diaphragm 202. The driver unit 221 is fed with a high-voltage playback input signal from the sound source 227 over an input line 227*a*.

Referring to FIG. 40, the driver unit 221 is connected to the diaphragm 202 at a position in which the distance 11 from the connecting portion 221*a* of the diaphragm connecting member 225 to the diaphragm 202 is smaller than the distance 12 from the center Oxy of the diaphragm 202 to an upper edge 202*e* of the diaphragm 202. The driver unit 221*a* accords flexural oscillations to the diaphragm 202 from a position offset towards the connecting portion 202*d* to the diaphragm connecting member 225 affixing a portion of the outer rim 202*c* of the diaphragm 202. The diaphragm 202 is connected to the driver unit 221 supported on the stand member 226 in a state in which the outer rim 202*c* other than the diaphragm connecting member 225 can be oscillated freely in the direction of thickness.

With the above-described speaker apparatus 220, the playback input signal is supplied from the sound source 227 to the driver unit 221 to cause oscillations of the high-molecular piezoelectric member 222 of the driver unit 221 in a direction perpendicular to the diaphragm 202. Since the oscillations of the high-molecular piezoelectric member 222 are applied via the tubular connection member 224 to the diaphragm 202, the diaphragm 202 is set into flexural oscillations with the connecting portion to the tubular connection member 224 as center to reproduce the sound corresponding to the playback input signal.

The piezoelectric driver unit 221, used in the speaker apparatus 220 of the present invention, has in general such characteristics that large oscillations can be obtained only with difficulties in the lower frequency range. If the piezoelectric driver unit 221 is used, the amount of oscillations in the lower frequency range can be improved by attaching a suitable weight to an edge of the high-molecular piezoelectric member 222.

Plural driver units 221 may also be provided in the speaker apparatus 220 having the plural piezoelectric driver units 221. In this case, playback input signals processed in a variety of ways are supplied to the respective driver units 221.

In the speaker apparatus having a portion of the outer rim of the diaphragm fixed, the outer rim of the diaphragm may be surrounded by a protective frame.

For protecting the diaphragm, a speaker apparatus having a protective frame is explained with reference to FIGS. 42 and 43.

Meanwhile, those portions which are common to those of the above-described speaker apparatus are depicted by common reference numerals and are not explained specifically.

Figure 42:
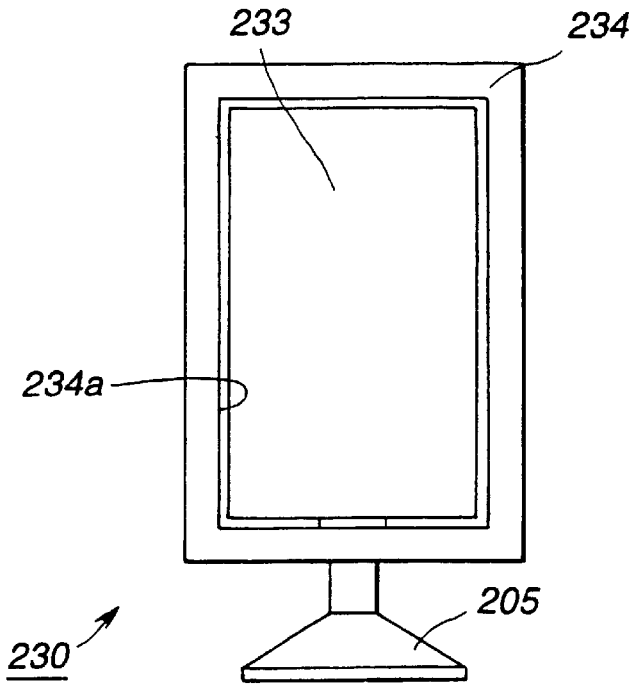
FIG. 42 is a front view showing a speaker apparatus of the present invention in which a diaphragm is arranged in a protective frame.
Figure 43:
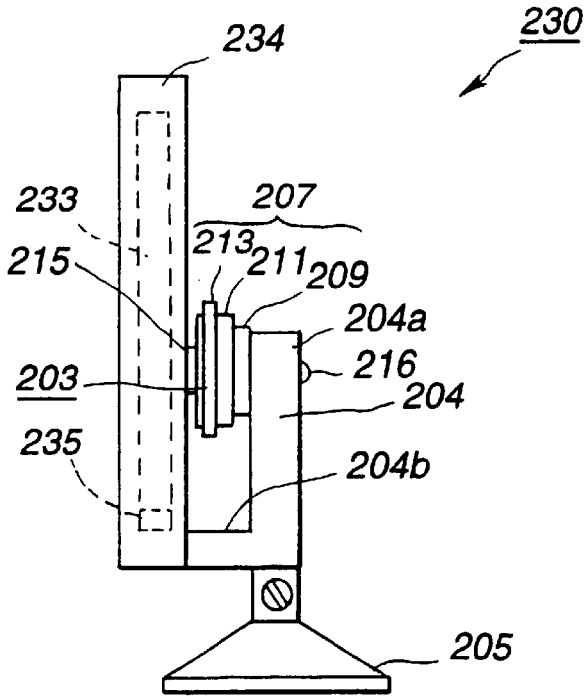
FIG. 43 is a side view thereof

A speaker apparatus 230, having a protective frame 234 for a diaphragm 233, includes a rectangular panel-shaped diaphragm 233*m* having substantially planar opposing major surfaces, and a protective frame 234 for protecting the outer rim of the diaphragm 233, as shown in FIGS. 42 and 43. The diaphragm 233 is connected via a connecting member 215 to the distal end of the voice coil bobbin 208 of the driving unit 203, and is afforded with the oscillations of the driving unit 203 through this connected portion, as shown in FIG. 43.

The protective frame 234 is formed as a substantially rectangular frame having an opening 234*a* sized to be large enough to surround the outer rim of the diaphragm 233. Within this opening 234 is housed the diaphragm 233. The protective frame 234 has a thickness larger than the thickness of the diaphragm 233. The diaphragm 233, arranged in this opening 234*a,* is arranged at a mid portion along the direction of thickness of the protective frame 234.

Within the opening 234*a* of the protective frame 234, the diaphragm 233 is supported via a supporting member 235 of a tough material, so that the mid portion of the short side of the diaphragm 233 is set on the mid portion of the lower inner rim side of the opening 234*a*. Thus, a slit which permits the oscillations of the diaphragm 233 is defined between the inner rim of the protective frame 234 and the diaphragm 233, such that the diaphragm 233 is supported for flexural oscillations in the opening of the protective frame 234 via the supporting member 235.

With the speaker apparatus 230, constructed as described above, direct impact on the diaphragm 233 can be prevented even if foreign matter from outside collides against the diaphragm 233 or inadvertent descent thus assuring reliable protection of the diaphragm 233 and the driving unit 203.

In the above-described speaker apparatus 230, the diaphragm 233 is supported by the protective frame 234 via the supporting member 235. A modified speaker apparatus, having a unitary oscillating unit, made up of a diaphragm, a protective frame and a supporting member, is hereinafter explained. Meanwhile, those members which are the same as those of the speaker apparatus 230 are depicted by the same reference numerals and are not explained specifically.

Figure 44:
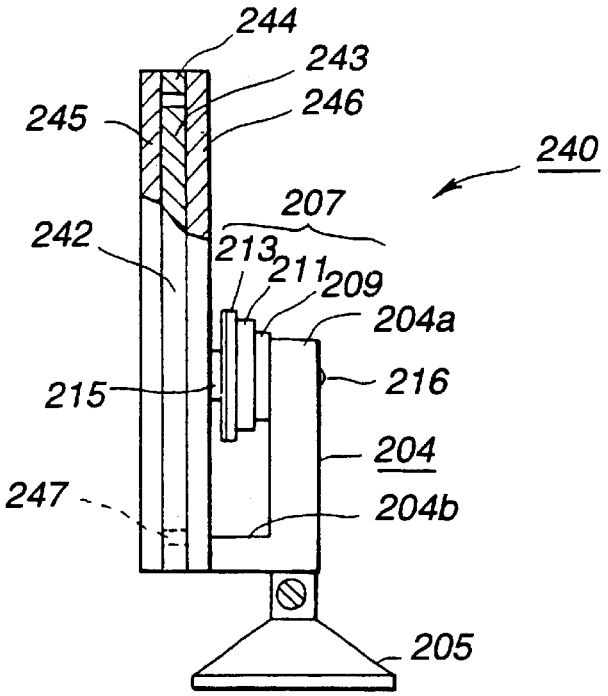
FIG. 44 is a side view showing a speaker apparatus of the present invention in which a diaphragm and a protective frame are formed as one, with a portion thereof being broken away.
Figure 45:
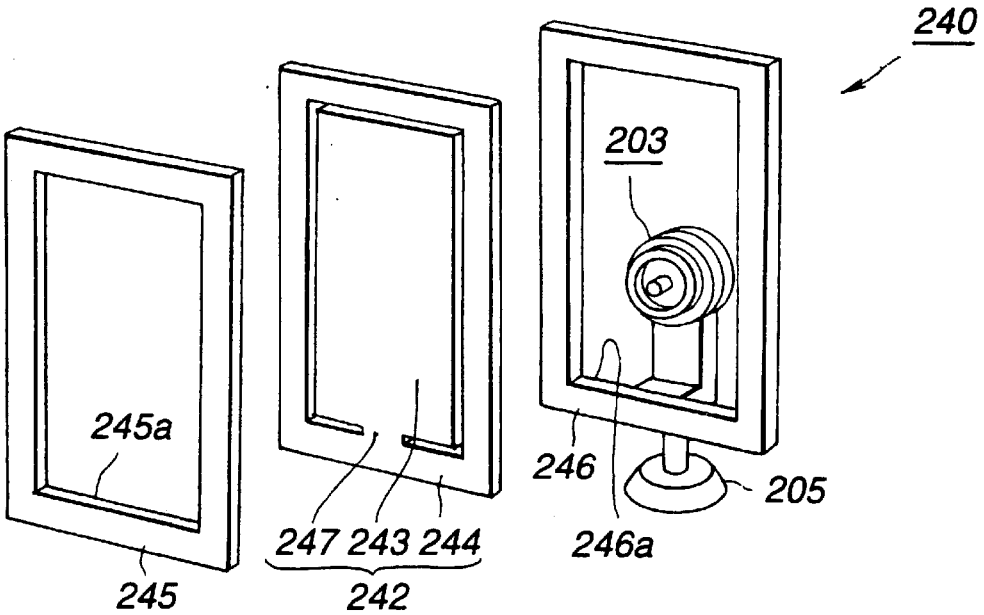
FIG. 45 is an exploded perspective view of a speaker apparatus shown in FIG. 44.

Referring to FIGS. 44 and 45, this speaker apparatus 240 includes a diaphragm 243, flexurally oscillated by the driving unit 203, a protective frame 244 for protecting the outer rim of the diaphragm 243 and a connecting member 247 for connecting a portion of the outer rim of the diaphragm 243 to the protective frame. These three members unitarily constitute an oscillating unit 242.

This oscillating unit 242 is formed as a flat plate from a material having toughness which is more than is sufficient to enable the diaphragm 243 to operate as a diaphragm independently and an attenuation factor small enough to permit propagation of the oscillation applied from the driving unit 203 adapted to flexurally oscillate the diaphragm 202 to respective portions of the diaphragm 243. The diaphragm 243, a protective frame 244 and the connecting portion 247 are formed as one by boring a partially connecting slit in the outer rim portions. That is, the oscillating unit 242 supports the diaphragm 243 in the inner rim of the protective frame 244 for flexural oscillations via the connecting member 247.

The present speaker apparatus 240 has a front side protective frame 245 and a back side a protective frame 246 for protecting the diaphragm 243 in the oscillating direction of the flexural oscillations of the diaphragm 243 of the oscillating unit 242, as shown in FIGS. 44 and 45.

The front side protective frame 245 and the back side a protective frame 246 are formed in substantially rectangular frame shape from a metal material of a higher mechanical strength, such as aluminum, as shown in FIGS. 44 and 45. The front side protective frame 245 and the back side a protective frame 246 are secured to the front and back sides of the protective frame 244 of the oscillating unit 242 with an adhesive or set screws, not shown. By providing the front side protective frame 245 and the back side a protective frame 246, the outer rim of the diaphragm 243 can be protected more reliably, thus preventing destruction of the corner etc of the diaphragm 243 due to an inadvertently applied external force etc.

Another modification of the speaker apparatus having the front side protective frame 245 and the back side a protective frame 246 protecting the front and back sides of the diaphragm 243 of the oscillating unit 242 is explained with reference to the drawings. This speaker apparatus 250 has the basic structure in common with the above-described speaker apparatus 240, as shown in FIGS. 46 and 47, so that the same members are depicted by the same reference numerals and are not explained specifically.

Figure 46:
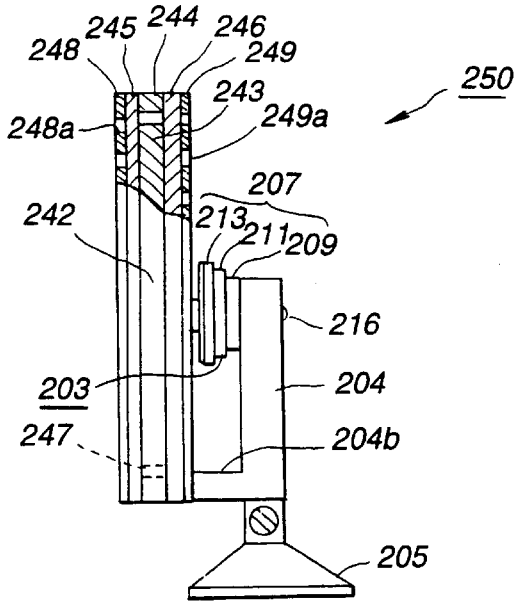
FIG. 46 is a side view showing a speaker apparatus of the present invention in which protection plates are provided for protecting the front and back sides of a diaphragm.
Figure 47:
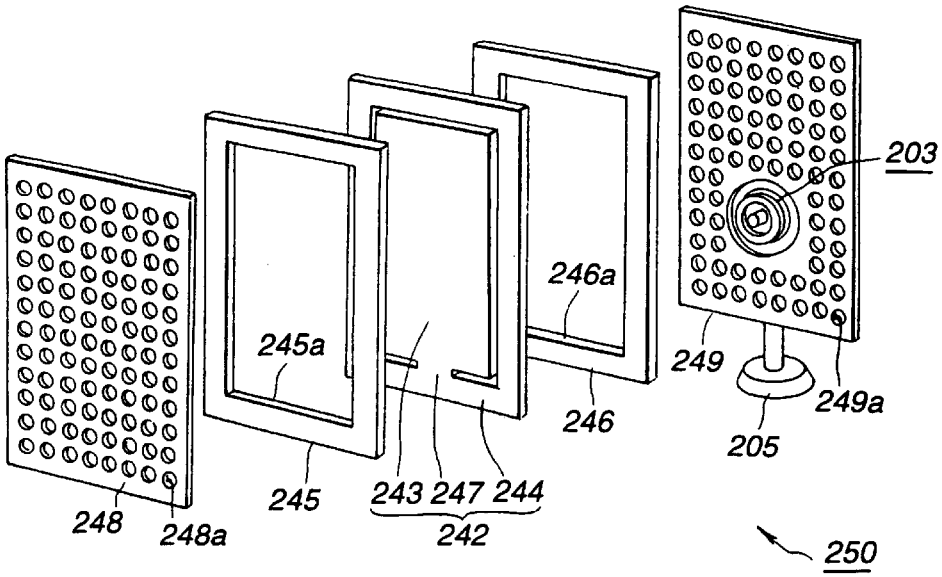
FIG. 47 is an exploded perspective view of the speaker apparatus shown in FIG. 46.

A front side protective frame 248 and a back side a protective frame 249 are formed substantially as rectangular plates, as shown in FIGS. 46 and 47, and are formed with plural through-holes 248*a*, 249*a* in major surfaces thereof to permit sound transmission. The front side protective frame 248 and the back side a protective frame 249 are secured to the front side of the front side protective frame 245 and to the back side of the back side protective frame 246 with an adhesive or set screws, not shown, for covering the front and back sides of the diaphragm 243. By providing the front side protective frame 248 and the back side a protective frame 249, the front and back sides of the diaphragm 243 of the oscillating unit 242 can be protected more reliably, thus preventing destruction of the diaphragm 243 due to an inadvertently applied external force etc to improve durability of the speaker apparatus 250.

Figure 48:
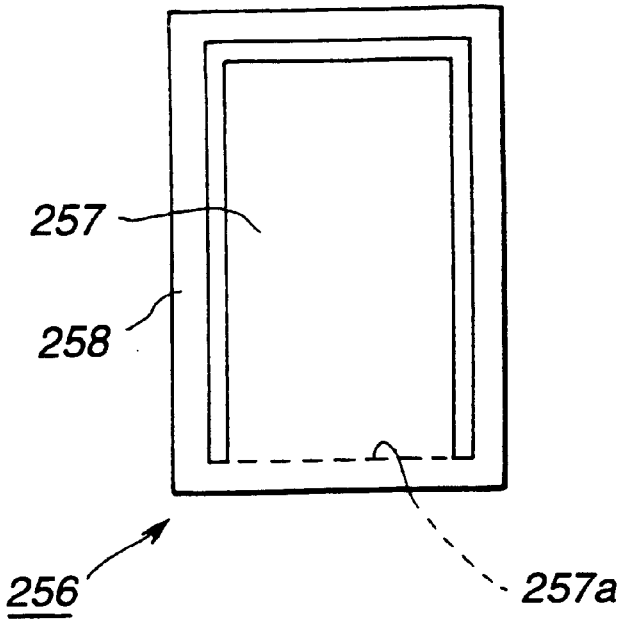
FIG. 48 is a front view showing another example of a diaphragm formed as-one with the protective frame.

The diaphragm used for the speaker apparatus 240 or 250 is not limited to the configuration described above. If the diaphragm is supported for oscillations on the inner rim of the protective frame, the diaphragm or slit shape or the position of the connecting portion can be changed suitably. Thus, the oscillating unit may be configured as shown in FIG. 48, in which the lower edge of a rectangular diaphragm 257 on the inner rim of the protective frame 258 is connected along its entire width to the protective frame 258.

Figure 49:
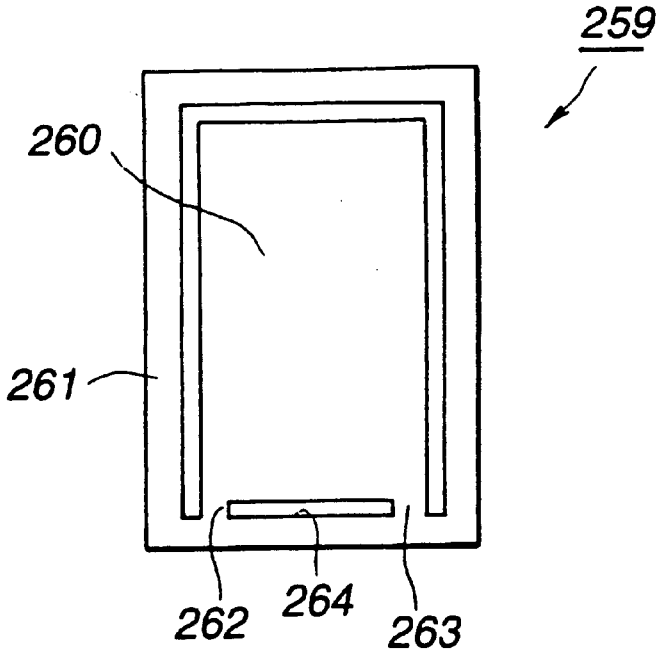
FIG. 49 is a front view showing a further example of a diaphragm.

Referring to FIG. 49, the oscillating unit 259 has a slit 264 in the lower edge of the diaphragm 260 interconnecting the diaphragm 260 and the protective frame 261 to connect the diaphragm 260 to the protective frame 261 via paired connecting portions 262, 263.

By varying the shape or the connecting volume of the diaphragm to the protective frame, it is possible to adjust the characteristics of the flexural oscillations of the diaphragm to variably adjust the frequency response characteristics of the speaker apparatus employing the diaphragm.

If the speaker apparatus is provided with a protective frame surrounding the diaphragm for protecting the diaphragm, plural such diaphragms may be provided within the protective frame.

Figure 50:
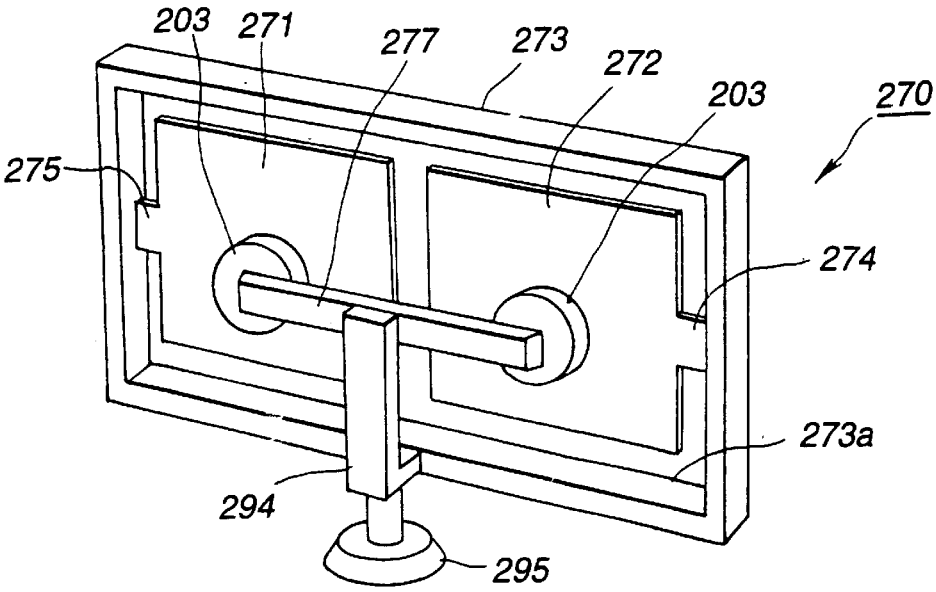
FIG. 50 is a perspective view showing a speaker apparatus of the present invention having plural diaphragms.

The speaker apparatus 230, having plural diaphragms within the protective frame, includes a set of first and second diaphragms 271, 273, respectively supported by driving units 203, and a protective frame member 273 for supporting the diaphragms 271, 272, as shown in FIG. 50.

Similarly to the above-described diaphragms, the first and second diaphragms 271, 273 are formed as rectangular panels having substantially flat opposing major surfaces. These diaphragms are each formed as a flat plate from a material having toughness which is more than is sufficient to enable the diaphragms to operate as a diaphragm by itself and an attenuation factor small enough to permit propagation of the oscillation applied from the driving units 203, 203 adapted to flexurally oscillate the diaphragm 202 to respective portions of the diaphragms 271, 272.

The first and second diaphragms 271, 272 are formed with supporting pieces 274, 275 at mid portions of the short sides thereof, with the supporting pieces 274, 275 being adapted to be supported by the inner rim portions of the protective frame member 273. The distal ends of the voice coil bobbins 8 of the driving units 203 are secured to the diaphragms 271, 272.

The protective frame member 273 is formed of a material having higher mechanical strength, such as aluminum. The inner periphery of the protective frame member 273 is formed substantially as a rectangular frame having an opening 273*a* sized to be sufficient to hold the first and second diaphragms 271, 272.

On the opposing inner rim portions of the protective frame member 273, supporting pieces 274, 275 for the diaphragms 271, 272 are secured at mid points for supporting the diaphragms 271, 272.

A sufficient gap is maintained between the first and second diaphragms 271, 272 provided on the inner rim of the protective frame 273 and the inner peripheral wall of the protective frame 273, whilst a sufficient gap is maintained between opposing sides of the first and second diaphragms 271, 272. Thus, the diaphragms 272, 272 are supported by the supporting pieces 274, 275 for flexural oscillations in the direction of thickness via these supporting pieces 274, 275. The protective frame member 273 has a thickness in a direction parallel to the direction of amplitude of the diaphragms 271, 272 sufficient to enable positive protection of the outer periphery of these diaphragms 271, 272.

The first and second driving units 203, 203, adapted for flexurally oscillating the first and second diaphragms 271, 272, are secured, such as with set screws, to both ends of a unit supporting member 277. This unit supporting member 277, adapted for supporting the respective driving units 203, 203, has a mid portion thereof in the longitudinal direction mounted on the upper end of a supporting member 294 provided on a supporting leg 295.

The speaker apparatus 270, having the first and second diaphragms 271, 272, is able to produce the stereo sound by causing flexural oscillations of the respective diaphragms 271, 272 by playback input signals of the left and right channels of the stereo playback input signals, thus enabling reduction in size of the entire apparatus. Although not shown, further diaphragms may be provided in the inner rim of the protective frame member 273.

Meanwhile, the voice coil bobbin of the driving unit 203 constituting the speaker apparatus of the present invention, is supported via a damper for performing piston movement in a direction parallel to the center axis. Alternatively, the voice coil bobbin may also be supported solely by the diaphragm.

Figure 51:
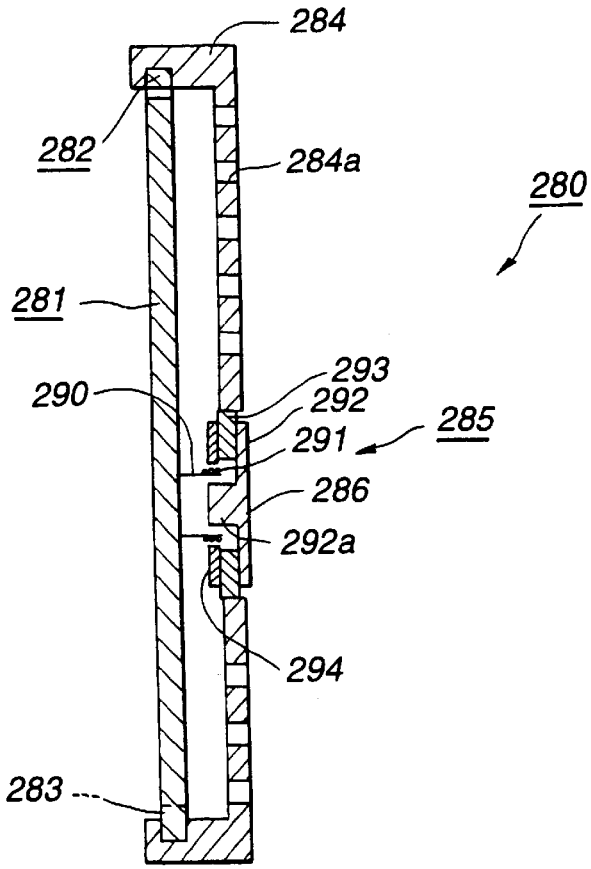
FIG. 51 is a cross-sectional view showing a further example of a driving unit used in a speaker apparatus according to the present invention.

A speaker apparatus 280, adapted for supporting the voice coil bobbin solely by the diaphragm, includes a diaphragm 281 which, similarly to the above-described diaphragms, is in the from of a rectangular panel and has substantially planar opposing surfaces, as shown in FIG. 51. This diaphragm 281 is formed as a flat plate from a material having toughness which is more than is sufficient to enable the diaphragms to operate as a diaphragm independently and an attenuation factor small enough to permit propagation of the oscillations applied from the driving unit 285 adapted to flexurally oscillate the diaphragm 281 to respective portions of the diaphragm 281.

This speaker apparatus 280 includes a protective frame 282 for protecting the outer rim of the diaphragm 281, a supporting member 283 for supporting the diaphragm 281 on the protective frame 282 and a back surface protecting member 284 for protecting the back surface of the diaphragm 281 opposite to the sound radiating surface.

The protective frame 282 is in the form of a substantially rectangular frame, in an inner rim of which the diaphragm 281 is supported for free flexural oscillations along the direction of thickness via the supporting member 283. A back side protecting member 284 holds the outer rim of the protective frame 282 and is formed with plural through-holes in a surface thereof facing the diaphragm 281.

Figure 52:
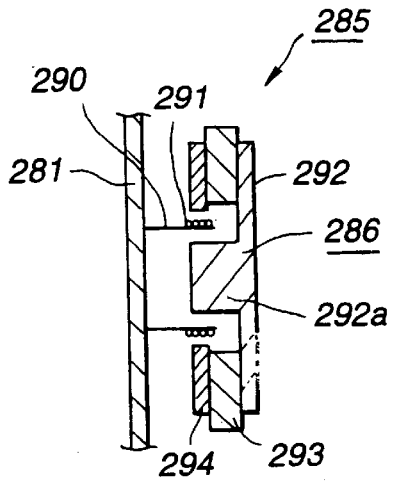
FIG. 52 is a cross-sectional view showing a magnetic circuit unit of the driving unit shown in FIG. 51.

The speaker apparatus 280 includes a driver unit 285 for driving the diaphragm 281, as shown in FIG. 51. Referring to FIGS. 51 and 52, the driver unit 285 is arranged by having a magnetic circuit unit 286 inserted into an opening formed in the back side protecting member 284. This magnetic circuit unit 286 is made up of a yoke 292, formed with a center pole 292*a,* a ring-shaped magnet 293 provided on the yoke 292 for encircling the center pole 292*a,* and a top plate 294 arranged on the magnet 293 for defining a magnetic gap between it and the center pole 292*a*.

A voice coil bobbin 290, constituting the driver unit 285, has its distal end connected to the diaphragm 281, with a voice coil 291 placed around the outer rim of the proximal end thereof being inserted into the magnetic gap of the magnetic circuit unit 285. The driver unit 285 is arranged by having the magnetic circuit unit 286 supported by the back side protecting member 284 and by having the voice coil bobbin 290 connected only to the diaphragm 281 without using dampers etc. By having the voice coil bobbin 290 supported solely by the diaphragm 281, the oscillating system including the diaphragm 281 can be reduced in weight to make effective utilization of the driving power of the driving unit 285. Moreover, the amount of movement of the voice coil bobbin 280 performing a piston movement is not regulated by the damper etc, thus improving playback characteristics for the lower frequency range in need of large amplitudes.

The voice coil 291 is connected to an external connection terminal, connected in turn to a sound source via a braided line arranged along the back side of the diaphragm 281, in a manner not shown.

The diaphragm of the speaker apparatus of the present invention has a panel shape having substantially flat opposing surfaces and is formed from a material having toughness which is more than is sufficient to enable the diaphragms to operate as a diaphragm independently and an attenuation factor small enough to permit propagation of the oscillation applied from the driving unit adapted to flexurally oscillate the diaphragm to respective portions of the diaphragm. Therefore, a portion of an outer casing of an electronic equipment enclosing a sound source, such as a personal computer, a disc recording and/or reproducing apparatus or a tape recorder, can be used as a diaphragm.

An embodiment of the present invention, applied to a personal computer 301, which is an electronic equipment having a speaker apparatus employing a panel-shaped diaphragm, subjected to flexural oscillations to reproduce the sound, is explained.

Figure 53:
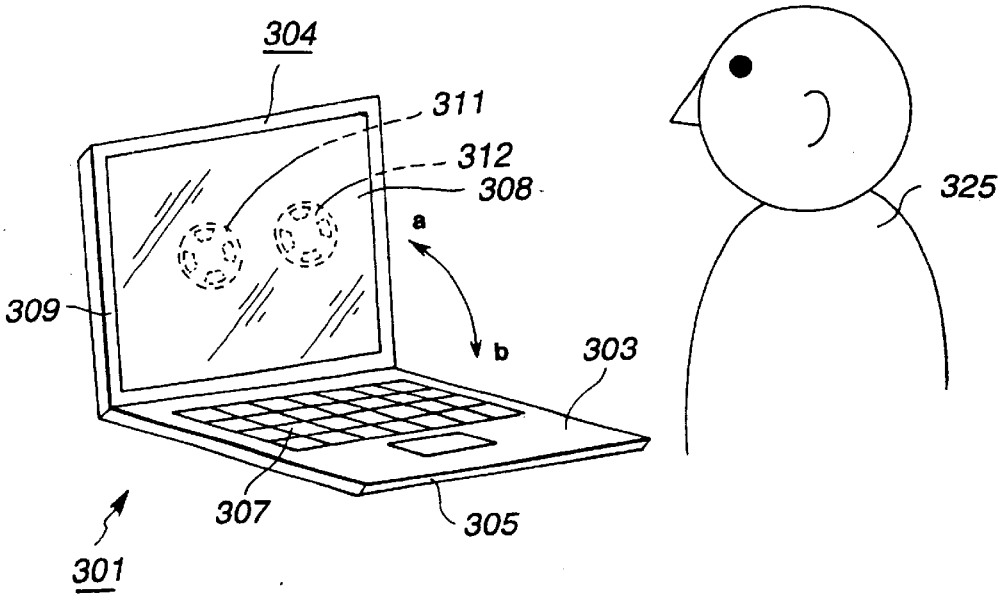
FIG. 53 is a perspective view showing a personal computer as an electronic equipment employing a speaker apparatus according to the present invention.
Figure 54:
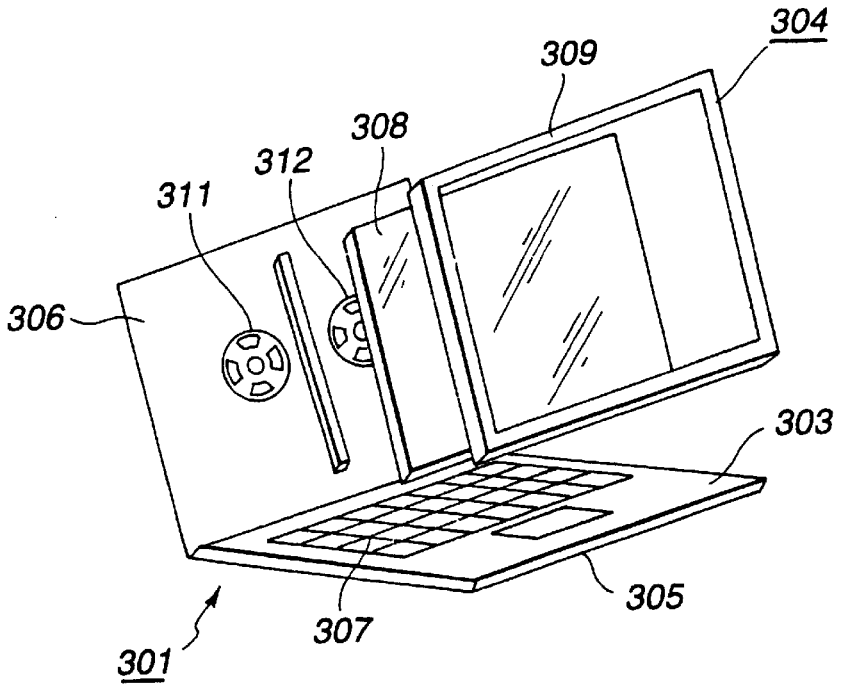
FIG. 54 is an exploded perspective view of a personal computer shown in FIG. 53.

The personal computer 301, as a notebook type computer embodying the present invention, includes a main body unit 303 enclosing a central processing unit (CPU), a memory and a disc driving device, as shown in FIG. 53. There is provided a lid 304 adapted for being opened and closed in the direction indicated by arrows a and b in FIG. 53 with respect to the main body portion 303.

The main body portion 303 and the lid 304 are provided with casings 305, 306, respectively. On the major surface of the main body portion 303 is arranged an operating panel 307, having a variety of actuating buttons, as shown in FIG. 53. On the major surface of the lid 304 is arranged an information displaying panel 308 for displaying various information, such as pictures or letters. As the information displaying panel 308, a liquid crystal display panel in the form of a substantially rectangular plate is used. The information displaying panel 308 has its outer periphery supported by a supporting frame member 309 and is mounted via the supporting frame member 309 on the casing 306 constituting the main body portion of the lid 304.

Figure 55:
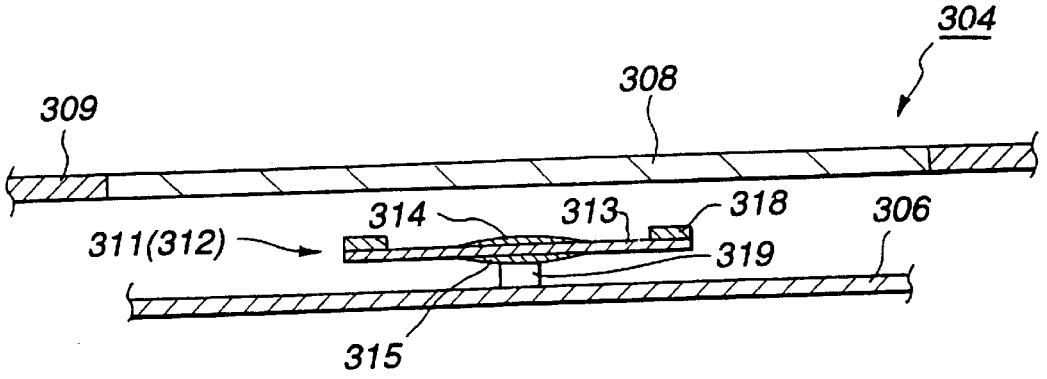
FIG. 55 is a schematic cross-sectional view of a personal computer shown in FIG. 53.
Figure 56:
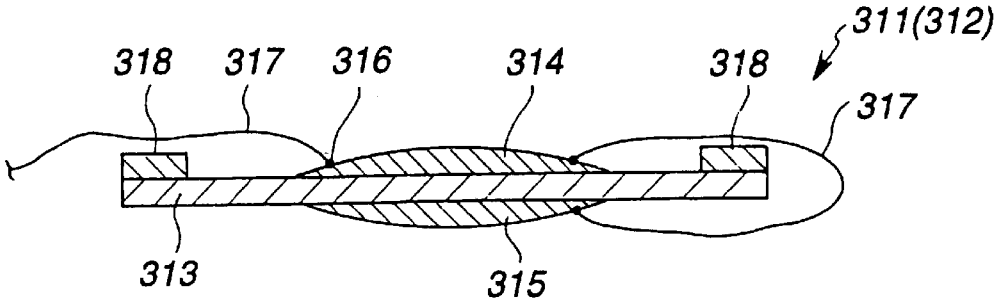
FIG. 56 is a cross-sectional showing a piezoelectric diaphragm for flexurally oscillating the casing.

The casing 306 constituting the lid 304 carries a set of piezoelectric oscillating plates 311, 312 constituting the driver unit as an oscillating source adapted for oscillating the casing 306 for causing flexural oscillations of a portion of the casing 306. Referring to FIGS. 55 and 56, these piezoelectric oscillating plates 311, 312 are each provided with a disc-shaped metal plate 313 and a set of piezoelectric ceramics 314, 315 mounted on the front and back sides of the metal plate 313, as shown in FIGS. 55 and 56. The set of the piezoelectric ceramics 314, 315 are provided at mid portions on both sides of the metal plate 313 and are connected to each other via a lead 317. On the piezoelectric ceramics 314 is formed an electrode 316, as shown in FIG. 56. This electrode 316 is connected via lead 317 to a sound source, as a current supply source, not shown.

Figure 57:
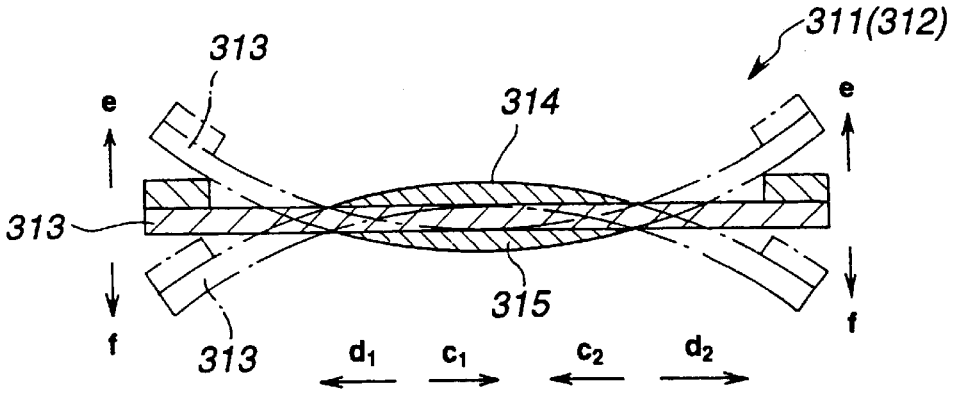
FIG. 57 is a cross-sectional view for illustrating the state of oscillations of the piezoelectric diaphragm.

The piezoelectric oscillating plates 311, 312, constructed as described above, cause the metal plate 313 to be bent in the direction indicated by arrow e in FIG. 5, that is in the direction of thickness, by the piezoelectric ceramics 314 being contracted in the direction indicated by arrows c1 and c2 in FIG. 57 and by the opposite side piezoelectric ceramics 315 being extended in the direction indicated by arrows d1 and d2 in FIG. 57, thereby causing the metal plate 313 to be bent in the direction indicated by arrow e in FIG. 57 corresponding to the direction of thickness. On the other hand, the piezoelectric oscillating plates 311,312, constructed as described above, cause the metal plate 313 to be bent in the direction indicated by arrow f in FIG. 5, that is in the direction of thickness, by the piezoelectric ceramics 314 being contracted in the direction indicated by arrows d1 and d2 in FIG. 57 and by the opposite side piezoelectric ceramics 315 being extended in the direction indicated by arrows d1 and d2 in FIG. 57, thereby causing the metal plate 313 to be bent in the direction indicated by arrow e in FIG. 57 corresponding to the direction of thickness.

Thus, the piezoelectric oscillating plates 311, 312 produce oscillations by being bent in the direction indicated by arrows e and f in FIG. 57. The oscillations produced by the piezoelectric oscillating plates 311, 312 are applied via the supporting member 319 to the casing 306 of the lid 304 to cause flexural oscillations to produce the sound. The sound generated by the piezoelectric oscillating plates 311, 312 are heard by a user 325 sitting at a position facing the information displaying panel 308, as shown in FIG. 53.

On pre-set points along the outer periphery of the piezoelectric oscillating plates 311, 312, a weight mass member 318 of, for example, lead, is arranged for operating as a weight mass component. The resonant point is lowered by arranging the mass member 318 to improve the frequency response characteristics in the lower frequency range.

With these piezoelectric oscillating plates 311, 312, the center points of the major surfaces thereof are secured and supported in position by supporting members 319 formed of a material larger in attenuation ratio than the piezoelectric oscillating plates 311, 312 or the casings 305, 306, as shown in FIG. 55. The supporting member 319 may, for example, be formed of a material undergoing large losses of oscillations, such as rubber, or an adhesive.

With the piezoelectric oscillating plates 311, 312 being supported by the supporting members 319, oscillations in the high frequency range can be sufficiently attenuated and are hardly propagated to avoid resonant sound in the higher range. Since the piezoelectric oscillating plates 311, 312 are supported at the mid portions of the major surfaces thereof, it is possible to realize frequency resonance in the lower frequency range in comparison with other structures, such as those supporting the outer rim portions.

Thus, with the piezoelectric oscillating plates 311, 312, particular peaks are perceived less pronouncedly than with the routine piezoelectric oscillating plates, such that oscillation up to lower frequency sound area can be transmitted to the casing.

Figure 58:
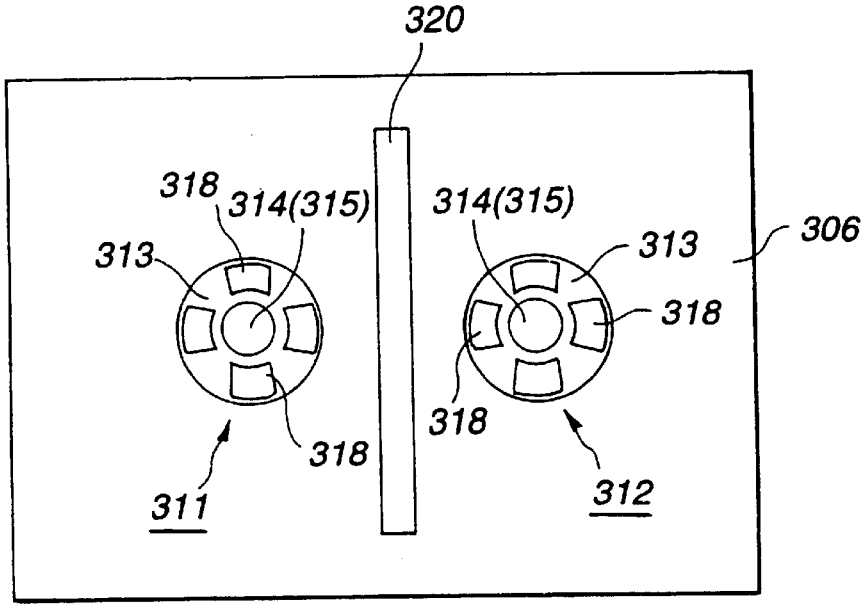
FIG. 58 is a plan view showing the state of arranging a set of piezoelectric diaphragms.

Referring to FIG. 58, there is provided an attenuation mechanism 320 for attenuating oscillations propagated from one to the other of the piezoelectric oscillating plates 311, 312 arranged on the casing 306. As this attenuation mechanism 320, a weight mass, formed e.g., of lead, or an oscillation controlling mechanism, experiencing oscillation losses to a lesser extent, is used.

With the electronic equipment 301 of the present invention, in which the attenuation mechanism 320 is arranged between the paired piezoelectric oscillating plates 311, 312, propagation of oscillations in the low to high frequency range of the piezoelectric oscillating plates 311, 312 is suppressed to realize optimum separation of the oscillations in the low to high frequency range, with the result that the fixed position feeling of the piezoelectric oscillating plates 311, 312 becomes clear to render it possible to allow the user 325 to hear the two-channel acoustic stereo sound. Since the low frequency sound area is low in the fixed position feeling, there is no problem even if the attenuation mechanism 320 is not effective to suppress propagation in the low frequency sound area.

As other attenuating means, there may be formed a shape of attenuating the oscillations propagated from one to the other of the piezoelectric oscillating plates 311, 312, although such form is not shown. The form of attenuating the oscillations may be the changing of the thickness of the casing, such as by a reduced thickness portion of the casing 306 located between the piezoelectric oscillating plates 311, 312, or a reduced thickness casing 306 for interrupting the propagation of the entire oscillations.

The electronic equipment 301 according to the present invention may also be provided with other piezoelectric oscillating plates between neighboring one of which an attenuation mechanism 320 is arranged. Although the piezoelectric oscillating plates 311, 312 are disc-shaped, these may, of course, be of any other suitable shape, such as rectangular shape, provided that the major surface thereof is supported at a mid portion thereof.

With the electronic equipment 301, since a larger oscillation area can be procured by exploiting the casing 306 itself of the lid 304 as an oscillating member, acoustic properties can be improved. Moreover, with the present electronic equipment 301, since the space within the casing 306 can be effectively used by arranging the piezoelectric oscillating plates 311, 312 on the inner surface of the casing 306 of the lid 304, the equipment in its entirety can be reduced in thickness and size.

With the electronic equipment 301, since the resonant point of the piezoelectric oscillating plates 311, 312 can be lowered by arranging the weight mass member 318 on the outer rim of the metal plate 313 constituting the piezoelectric oscillating plates 311, 312, it is possible to improve playback characteristics in the low range sound area.

With the electronic equipment 301, since the resonant point of the piezoelectric oscillating plates 311, 312 can be lowered by supporting the mid portion via the supporting member 319 having an attenuation factor higher than that of the casing 306 of the lid 304 or the piezoelectric oscillating plates 311, 312, it is possible to improve playback characteristics in the low range sound area.

With the electronic equipment 301, since the attenuation mechanism 320 is provided between the piezoelectric oscillating plates 311, 312 of each set, propagation of the oscillations of the piezoelectric oscillating plates 311, 312 can be suppressed to split the oscillations in the mid to high sound ranges of the piezoelectric oscillating plates 311, 312 to maintain the fixed position feeling of the piezoelectric oscillating plates 311, 312 satisfactorily.

The electronic equipment 301 of the present invention can be arranged with advantage in, for example, a bathroom as a water-proofed electronic equipment. That is, with the water-proofed electronic equipment, in which the inside and the outside of the casing can be isolated completely from each other, clear sound may be produced by causing oscillations of the casing itself by the piezoelectric oscillating plates arranged in the casing, while assuring optimum waterproofing properties.

A few of the specified applications of the driver unit as a source of oscillations for flexurally oscillating a portion of the casing 306 are hereinafter explained. As this driver unit, a driver unit employing the piezoelectric oscillating plates as described previously, or a dynamic type driver unit equipped with the magnetic circuit unit as described previously, may be used.

Figure 59:
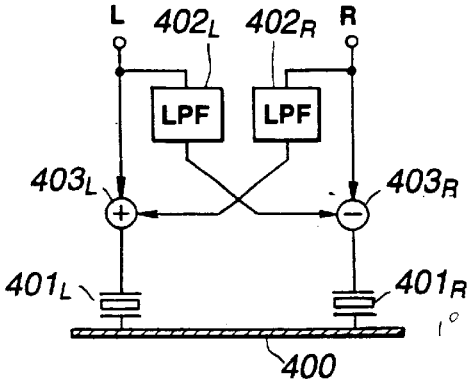
FIG. 59 is a circuit diagram showing a speaker driving circuit for driving a speaker apparatus constituting the electronic equipment according to the present invention.

FIG. 59 is a block diagram showing a specified structure employing this driver unit for e.g., a notebook type personal computer. Referring to FIG. 59, this electronic equipment is provided with a low-pass filter (LPF) $\mathbf{402}_R$ for passing the low-frequency components of right channel audio signals (R signals) from an audio stereo signal source, not shown, a high-pass filter (HPF) $\mathbf{402}_L$ for passing the low-frequency components of left channel audio signals (L signals) from the audio stereo signal source, a subtractor $\mathbf{403}_R$ for subtracting an output of the LPF $\mathbf{402}_L$ from the R signals, a subtractor $\mathbf{403}_L$ for subtracting an output of the LPF $\mathbf{402}_R$ from the L signals, a driver unit $\mathbf{401}_R$ driven by an output of the subtractor $\mathbf{403}_R$ and a driver unit $\mathbf{401}_L$ driven by an output of the subtractor $\mathbf{403}_L$.

The LPF $402_R$ extracts the low-frequency components of the R signals from the audio stereo signal source to supply the extracted components to the subtractor $403_L$, while the LPF $402_L$ extracts the low-frequency components of the R signals from the audio stereo signal source to supply the extracted components to the subtractor $403_R$. The subtractor $403_R$ subtracts the low-frequency components of the L signals from the R signals, that is adds the reverse-phase components of the low-frequency components of the L signals to the R signals, to drive the driver unit $401_R$. On the other hand, the subtractor $403_L$ subtracts the low-frequency components of the R signals from the L signals, that is adds the reverse-phase components of the low-frequency components of the R signals to the L signals, to drive the driver unit $401_L$. The driver unit $401_R$ and the driver unit $401_L$ are comprised of piezoelectric elements, as described above, and drive an oscillation plate 400 comprised of the entire or partial portion of the casing 306 based on the supplied audio signals.

By so doing, the high-frequency components of both channels are directly transmitted to the driver units $401_R$ and $401_L$ to give the user the directivity feeling. On the other hand, since the reverse-phased portions of the low-frequency components of each channel are supplied to the driver unit of the opposite side channel, thus giving the user a spread sound image feeling. That is, an optimum stereo feeling can be achieved on near-field reception where the distance between the user and an oscillation plate 400 is small, as in the case of a notebook type personal computer.

Figure 60:
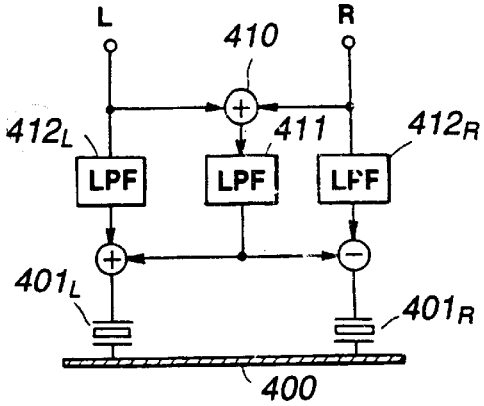
FIG. 60 is a circuit diagram showing another example of the speaker apparatus.

FIG. 60 is a block diagram showing a specified structure of a modified electronic equipment shown in FIG. 59. The components corresponding to those of FIG. 59 are depicted by the same reference numerals and are not explained specifically.

Referring to FIG. 60, the electronic equipment includes an adder 410 for adding the R and L signals from the audio stereo signal source, an LPF 411 for passing the low-frequency components of the output of the adder 410, a high-pass filter (HPF) $412_R$ for passing the high-frequency components of the R signals, a HPF $412_L$ for passing the high-frequency components of the L signals, a subtractor $413_R$ for subtracting an output of the LPF 411 from the HPF $412_R$, an adder $413_L$ for adding the output of the LPF 411 to the output of the HPF $412_R$, a driver unit $401_R$ driven by an output of the subtractor $413_R$ and, a driver unit $401_L$ driven by an output of the adder $413_L$.

The adder 410 sums the R and L signals and routes the audio signal comprised of the audio signals of both channels to the LPF 411 which then extracts the low-frequency components of the audio signals to send the extracted low-frequency components to the subtractor $413_R$ and to the adder $413_L$. The HPF $412_R$ extracts the high-frequency components of the R signals to route the extracted high-frequency components to the subtractor $413_R$, while the HPF $412_L$ extracts the high-frequency components of the L signals to route the extracted high-frequency components to the adder $413_R$. The subtractor $413_R$ sums the reversed-phased components of the low-frequency components of both channels to the high-frequency components of the R signals supplied from the HPF $412_R$ to drive the driver unit $401_R$. The adder $413_L$ sums the low-frequency components of both channels to the high-frequency components of the L signals supplied from the HPF $412_L$ to drive the driver unit $413_R$ Since directivity is not accorded to the user by the low-frequency components of the audio signals, the acoustic effects similar to those of the electronic equipment shown in FIG. 59 may be obtained if the cut-off frequencies of the LPF 411 and HPFs 412R and 412L are of the same frequencies. However, if the cut-off frequencies are not overlapped or do not cross each other, the sound of a given frequency range can be emphasized or attenuated. If the cut-off frequencies are adapted to be changed by the user, it becomes possible to realize the acoustic effects desired by the user.

Figure 61:
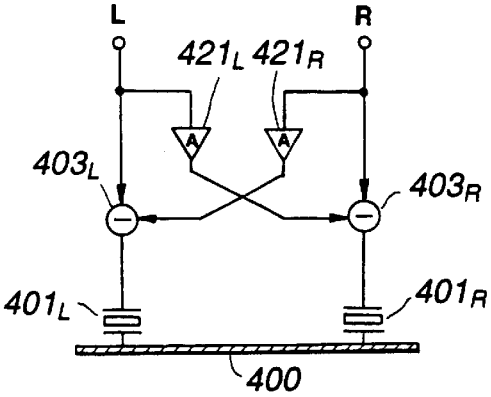
FIG. 61 is a circuit diagram showing another example of the driving circuit.

FIG. 61 shows a block diagram showing a detailed structure of an electronic equipment in which the LPFs $402_R$, $402_L$ of the electronic equipment are replaced by level adjustment units, such as amplifier or a volume resistor.

Referring to FIG. 61, this electronic equipment includes a level adjustment unit $421_R$ for attenuating the R signals from the audio stereo signal source, a level adjustment unit $421_L$ for attenuating the R signals from the audio stereo signal source, a subtractor $403_R$ for subtracting the output of the level adjustment unit $421_L$, a driver unit $401_R$ driven by an output of the subtractor $403_R$, and a driver unit $401_L$ driven by an output of the subtractor $403_L$.

It is noted that the gain A of the level adjustment units $421_L$ and $421_R$ is less than unity, such as 0.1 to 0.5. In this manner, reverse-phase components of the audio signals of one of the channels are attenuated and routed the driver unit of the opposite side channel. Thus, the user can have a spread sound image feeling.

Figure 62:
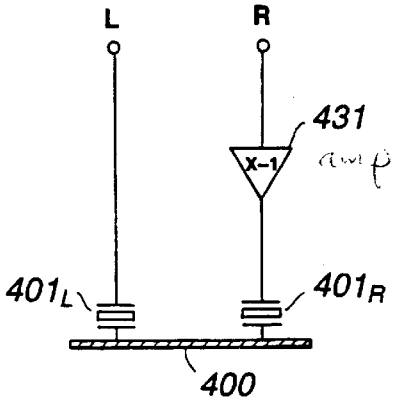
FIG. 62 is a circuit diagram showing still another example of the driving circuit.

FIG. 62 shows a block diagram showing a detailed structure of the simplest electronic equipment employing the speaker apparatus according to the present invention.

This electronic equipment includes an amplifier 431 for reversing the phase of the R signals from an audio stereo signal source, not shown, a driver unit $401_R$ driven by an output of the amplifier 431, and a driver unit $401_L$ driven by the R signals.

In the driver unit of the present invention, the correlation between the two channels is lower than in the conventional speaker apparatus, so that, if the electronic equipment is used for a near-field reception type device, such as in the case of a notebook type personal computer, a unique sound image feeling can be realized.

Although a specified Embodiment in which the electronic equipment adapted to the speaker apparatus according to the present invention is designed as an analog electric circuit, it is of course possible to constitute the circuit making up the respective electronic equipments by e.g., a digital signal processor (DSP) and its software.

Industrial Applicability

The speaker apparatus according to the present invention includes a diaphragm in the form of a substantially flat panel that can be oscillated substantially freely at least in the direction of thickness and at least one driver unit connected to the diaphragm surface to constitute an oscillation source applying oscillations to the diaphragm, with the diaphragm being set into flexural oscillations by the oscillations applied from the driver unit driven by the playback input signal. Thus, optimum frequency response characteristics can be obtained over a wide frequency range from the low to high frequency range. Moreover, the acoustic sound may be reproduced with optimum sound quality over a wide frequency range from the low to high frequency range with minimum variations in the sound pressure level.

Since the speaker apparatus for flexural oscillations of the panel-shaped diaphragm need not be housed in a cabinet, the apparatus in tis entirety, an be reduced in size and in thickness.

What is claimed is:

1. An electronic equipment comprising:

a main body portion;

a lid mounted on said main body portion for opening and closing;

a plurality of piezoelectric driver units arranged in said lid mounted on said main body portion, wherein sound radiation is realized by flexural oscillations induced in said lid by oscillations applied from said plurality of piezoelectric driver units in response to an input signal fed thereto; and means for attenuating oscillations transmitted by each said of plurality of piezoelectric driver units is provided on said lid and arranged between said plurality of piezoelectric driver units, wherein said attenuation means is formed in said lid to render a thickness of said lid nonuniform across the lid.

2. The electronic equipment according to claim 1 wherein each of said plurality of piezoelectric driver units has a weight mass component arranged on an outer rim thereof.

3. The electronic equipment according to claim 1, wherein each of said plurality of piezoelectric driver units has a mid portion of a major surface thereof supported by a supporting member formed of a material having a large attenuation factor for said piezoelectric driver unit and said lid.

4. An electronic equipment comprising:

a main body portion;

a lid mounted on said main body portion for opening and closing;

a plurality of piezoelectric driver units arranged in said lid mounted on said main body portion, wherein sound radiation is realized by flexural oscillations induced in said lid by oscillations applied from said driver unit in response to an input signal fed thereto;

a liquid crystal display unit arranged on one surface of said lid and an opposite surface of said lid has said driver unit connected thereto; and means for attenuating oscillations transmitted by each of said plurality of piezoelectric driver units provided on said lid between said plurality of piezoelectric driver units, wherein said means for attenuating comprises an oscillation regulating member having a weight mass different from a weight mass of each of said plurality of piezoelectric driver units on said lid.

5. The electronic equipment according to claim 4 further comprising a plurality of piezoelectric driver units arranged on said lid and wherein means for attenuating oscillations transmitted by each piezoelectric driver unit is provided on said lid between the plurality of piezoelectric driver units.

6. The electronic equipment according to claim 4 wherein said attenuation means comprises an oscillation regulating member having a weight mass different from a weight mass of a piezoelectric driver of said driver unit in said lid.

7. The electronic equipment according to claim 4 wherein each of said plurality of piezoelectric driver units has a weight mass component arranged on an outer rim thereof.

8. The electronic equipment according to claim 4 wherein each of said plurality of piezoelectric driver units has a mid portion of a major surface thereof supported by a supporting member formed of a material having a large attenuation factor for said piezoelectric driver unit and said lid.

9. The electronic equipment according to claim 4 wherein said means for attenuation is formed in said lid to render a thickness of said lid nonuniform across the lid.

* * * * *